US009519273B2

(12) United States Patent
Nishijima

(10) Patent No.: US 9,519,273 B2
(45) Date of Patent: Dec. 13, 2016

(54) ELECTRONIC TIMEPIECE AND MOVEMENT

(71) Applicant: Seiko Epson Corporation, Tokyo (JP)

(72) Inventor: Hirokazu Nishijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/632,479

(22) Filed: Feb. 26, 2015

(65) Prior Publication Data

US 2015/0253740 A1 Sep. 10, 2015

(30) Foreign Application Priority Data

Mar. 6, 2014 (JP) ..... 2014-043603
Mar. 20, 2014 (JP) ..... 2014-057394
Mar. 25, 2014 (JP) ..... 2014-062049

(51) Int. Cl.
*G04G 5/00* (2013.01)
*G04G 9/00* (2006.01)
*G04C 9/08* (2006.01)
*G04G 5/04* (2006.01)

(52) U.S. Cl.
CPC *G04G 9/00* (2013.01); *G04C 9/08* (2013.01); *G04G 5/00* (2013.01); *G04G 5/04* (2013.01)

(58) Field of Classification Search
CPC ..... G04G 5/04; G04G 5/041; G04G 5/043; G04G 9/00; G04C 9/08
See application file for complete search history.

(56) References Cited

U.S. PATENT DOCUMENTS 4,150,535 A * 4/1979 Morokawa ..... G04C 3/005 368/156
4,283,784 A * 8/1981 Horan ..... G04G 5/04 368/155
5,095,469 A * 3/1992 Leuenberger ..... G04G 5/04 368/187

(Continued)

FOREIGN PATENT DOCUMENTS

EP 2085835 A2 8/2009
EP 2615508 A2 7/2013

(Continued)

OTHER PUBLICATIONS

"GoodsPress Tokuma Shoten, Jul. 10, 2013, pp. 75-81."

*Primary Examiner* — Sean Kayes

(57) ABSTRACT

An electronic timepiece has a display device that displays display information, a drive mechanism that drives the display device, a crown that can perform a rotary operation, and a control device that corrects the display information displayed on the display device by the rotary operation of the crown. The control device has a single correction mode and a continuous correction mode which are selected by the rotary operation of the crown. In the single correction mode, a single correction signal is output to the drive mechanism so that the display device is corrected as much as a single correction quantity. In the continuous correction mode, a continuous correction signal is output to the drive mechanism so that the display device is corrected as much as a continuous correction quantity. The continuous correction quantity is set depending on types of the display information to be corrected in the continuous correction mode.

7 Claims, 40 Drawing Sheets

169A 169B 169C 169D 169E 169

| DISPLAY CORRECTION MODE | SINGLE CORRECTION QUANTITY | CONTINUOUS CORRECTION QUANTITY | CROWN STAGE NUMBER | BUTTON OPERATION |
|---|---|---|---|---|
| TIME ZONE SELECTION MODE | 1 | 1 | 1 | |
| ONE-FIFTH SECOND CHRONOGRAPH HAND CORRECTION MODE | 1 | 300 | 2 | C3 SECOND |
| MINUTE CHRONOGRAPH HAND CORRECTION MODE | 1 | 60 | | C |
| HOUR CHRONOGRAPH HAND CORRECTION MODE | 1 | 60 | | C |
| DATE CORRECTION MODE | 1 | 31 | 1 | C3 SECOND |
| CURRENT TIME-SECOND CORRECTION MODE | 1 | 60 | 2 | |
| CURRENT TIME-HOUR-MINUTE CORRECTION MODE | 1 | 720 | | A |

(56) References Cited

U.S. PATENT DOCUMENTS

| | | | | |
|---|---|---|---|---|
| 7,258,481 | B2 * | 8/2007 | Zachmann | G04G 5/04 368/185 |
| 9,058,022 | B2 * | 6/2015 | Tokiwa | G04B 27/02 |
| 2010/0164426 | A1 * | 7/2010 | Honmura | G04C 3/143 318/696 |

FOREIGN PATENT DOCUMENTS

| | | | |
|---|---|---|---|
| JP | 58-87231 | U | 6/1983 |
| JP | 60-102838 | U | 7/1985 |
| JP | 60-140179 | A | 7/1985 |
| JP | 2001-221870 | A | 8/2001 |
| JP | 2005-300377 | A | 10/2005 |
| JP | 2008-134129 | A | 6/2008 |
| JP | 2009-175044 | A | 8/2009 |

* cited by examiner

169

| 169A DISPLAY CORRECTION MODE | 169B SINGLE CORRECTION QUANTITY | 169C CONTINUOUS CORRECTION QUANTITY | 169D CROWN STAGE NUMBER | 169E BUTTON OPERATION |
|---|---|---|---|---|
| TIME ZONE SELECTION MODE | 1 | 1 | 1 | |
| ONE-FIFTH SECOND CHRONOGRAPH HAND CORRECTION MODE | 1 | 300 | 2 | C3 SECOND |
| MINUTE CHRONOGRAPH HAND CORRECTION MODE | 1 | 60 | | C |
| HOUR CHRONOGRAPH HAND CORRECTION MODE | 1 | 60 | | C |
| DATE CORRECTION MODE | 1 | 31 | 1 | C3 SECOND |
| CURRENT TIME-SECOND CORRECTION MODE | 1 | 60 | 2 | |
| CURRENT TIME-HOUR-MINUTE CORRECTION MODE | 1 | 720 | | A |

FIG. 7

169

| 169A DISPLAY CORRECTION MODE | 169B SINGLE CORRECTION QUANTITY | 169C CONTINUOUS CORRECTION QUANTITY | 169D CROWN STAGE NUMBER | 169E BUTTON OPERATION |
|---|---|---|---|---|
| TIME ZONE SELECTION MODE | 1 | 1 | 1 | |
| CURRENT TIME-SECOND CORRECTION MODE | 1 | 60 | 2 | |
| CURRENT TIME-HOUR-MINUTE CORRECTION MODE | 1 | 60 | | A |
| DATE CORRECTION MODE | 1 | 31 | 1 | AB 6 SECOND |
| DAY CORRECTION MODE | 1 | 1 | | A |

FIG. 21

| CORRECTION TARGET | NUMBER OF STEPS | DRIVE FREQUENCY DURING CONTINUOUS DRIVE (FORWARD ROTATION) | DRIVE FREQUENCY DURING CONTINUOUS DRIVE (REARWARD ROTATION) | TIME REQUIRED FOR ONE ROUND (FORWARD ROTATION) | TIME REQUIRED FOR ONE ROUND (REARWARD ROTATION) | CONTINUOUS CORRECTION QUANTITY (FIRST EMBODIMENT) | CONTINUOUS CORRECTION QUANTITY (ANOTHER EMBODIMENT) |
|---|---|---|---|---|---|---|---|
| SECOND HAND | 60 | 64Hz | 42.7Hz | 0.937 SECONDS* | 1.405 SECONDS | 60 | 1 * |
| HOUR-MINUTE HAND | 720 (12x60 MINUTES) | 85.3Hz | 51.2Hz | 8.440 SECONDS | 14.062 SECONDS | 720 | 720 |
| CHRONOGRAPH SECOND HAND | 300 | 85.3Hz | 51.2Hz | 3.516 SECONDS* | 5.859 SECONDS | 300 | 1 * |
| CHRONOGRAPH MINUTE HAND | 60 | 32Hz | 32Hz | 1.875 SECONDS* | 1.875 SECONDS | 60 | 1 * |
| CHRONOGRAPH HOUR HAND | 60 | 32Hz | 32Hz | 1.875 SECONDS* | 1.875 SECONDS | 60 | 1 * |
| DATE INDICATOR | 4650 (150x31 DAYS) | 64Hz | 42.7Hz | 72.656 SECONDS* | 108.899 SECONDS | 31 | 31 |

FIG. 25

ELECTRONIC TIMEPIECE AND MOVEMENT

BACKGROUND

1. Technical Field

The present invention relates to an electronic timepiece and a movement.

2. Related Art

In the related art, an electronic timepiece is known which corrects display information by using an electronic crown (for example, JP-A-2008-134129).

The electronic timepiece disclosed in JP-A-2008-134129 can display the display information such as time by using a display unit such as an indicating hand on a dial, and can correct the display information by using the electronic crown.

In the electronic timepiece disclosed in JP-A-2008-134129, when the display information is corrected by using an electronic crown, depending on an axially pulled-out position of the crown, a measurement condition of a rotation signal is variable when the crown is rotatably operated. Based on the measurement condition, a correction quantity of the correction-targeted information is variable.

Since the correction quantity is variable in this way, a weak point of the crown whose operability differs depending on an operation position of the crown is redeemed so as to facilitate a correction operation using the crown.

In the related art, a timepiece is known which includes a rotary switch mechanism for detecting the rotation of the crown (for example, refer to JP-A-2005-300377).

The electronic timepiece disclosed in JP-A-2005-300377 includes a switch wheel which rotates integrally with a winding stem, and a switch lever which is rotated by a distal end portion thereof being pressed by a cam shape of the switch wheel (distal end portion configures a switch contact point spring body). The switch lever is moved in response to the rotation of the crown, and comes into contact with a correction detection pattern disposed on a circuit board, thereby allowing conduction. Then, this conduction state is detected so as to detect the rotation of the crown.

In the electronic timepiece disclosed in JP-A-2005-300377, when the crown is located at a normal position (zero stage position) where the crown is pressed into a timepiece case, the electronic timepiece is set so that an input operation cannot be performed even if the switch lever is moved and brought into contact with the correction detection pattern by the crown being rotated.

In the related art, an electronic timepiece is known which includes a world time function for displaying local time in the current location by receiving the satellite signal. For example, JP-A-2009-175044 discloses a wrist timepiece which includes a dial for displaying a map and multiple indicating hands, and which displays a time zone and the local time of the current location. In addition, according to "Goods Press, July 2013", Tokuma Shoten Publishing Co., Ltd, Jul. 10, 2013, pp. 75 to 81, a wrist timepiece is introduced in which time zone display indicated by a time difference with the Coordinated Universal Time (UTC) is provided on an outer peripheral section of the dial, and which displays the time zone and the local time of the current location. These wrist timepieces include a reception unit which receives a satellite signal from a navigation satellite such as a Global Positioning System (GPS), and obtains position information and time information of the current location by receiving the satellite signal from four navigation satellites, thereby automatically correcting the time zone and the time.

However, when it is necessary to perform a button operation without using an axial position of the crown in order to switch from the existing information to the correction-targeted information, the electronic timepiece disclosed in JP-A-2008-134129 cannot change the measurement condition of the rotation signal and the correction quantity when the crown is rotatably operated, thereby causing a problem in that delicate correction satisfying a user's intention cannot be performed.

For example, in an electronic timepiece including a chronograph function which enables measurement for the maximum six hours by being provided with three chronograph hands such as a one-fifth second chronograph hand, a minute chronograph hand, and an hour chronograph hand, in some cases, a user pulls out the crown by two stages so as to be shifted to a mode for correcting a reference position (position zero) of the chronograph hands, and selects a correction target from three types of chronograph hands by performing the button operation.

In the electronic timepiece disclosed in JP-A-2008-134129, if a case of correcting the reference position of these chronograph hands is assumed, the pulled-out position of the crown is not changed. Therefore, even if the correction target is changed by performing the button operation, it is not possible to change the measurement condition of the rotation signal and the correction quantity. Therefore, if the user can select a normal correction mode (single correction mode) for moving the indicating hand step by step and a continuous correction mode for continuously moving the indicating hand by multiple steps, the correction quantity in the continuous correction mode also becomes the same correction quantity as long as the pulled-out position of the crown is the same.

For this reason, if the user performs setting suitable for the correction of any chronograph hand, there is a problem in that the correction of other chronograph hands becomes inconvenient.

For example, when the reference position (zero position) of the one-fifth second chronograph hand is corrected by using the crown, the total correction quantity of the one-fifth second chronograph hand is as large as 300 (0 to 299). Therefore, when the crown is pulled out to a second stage position, if the correction quantity in the normal correction mode is set to "1" and the correction quantity in the continuous correction mode is set to "300", the correction operation of the one-fifth second chronograph hand is facilitated.

However, in a case of the hour chronograph hand, since the total correction quantity is as small as 6 (0 to 5), the operation for correcting the hand step by step is sufficiently performed, and the operation for continuous correcting causes the hand to be less likely to align with an intended scale. That is, when the continuous correction quantity is 300, if the mode is unintentionally shifted to the continuous correction mode, the correction quantity which reaches 50 times the total correction quantity (6) is input. Consequently, the hour chronograph hand is rotated multiple times, thereby causing a problem in that a user has difficulty in aligning the hour chronograph hand with the reference position.

Without being limited to the indicating hand, this problem is common to a case where a display unit such as a calendar wheel is corrected by performing a rotary operation of an operation member such as the crown.

In the timepiece disclosed in JP-A-2005-300377, the switch contact point spring body always meshes with the switch wheel without depending on the position of the crown. Consequently, even when the crown is located at the zero stage position, if the crown is rotated, a user feels a sense of resistance.

Therefore, when the crown is rotated at the zero stage position, the user feels the sense of resistance and may misunderstand that the input has been performed in spite of the fact that any input has not been performed. In addition, if the user feels the sense of resistance at the zero stage position where no input is performed, the sense of resistance may cause a possibility that the user cannot determine whether or not the input is performed. Consequently, even if the user feels the sense of resistance by rotating the crown at positions (first stage position and second stage position) other than the zero stage position where the input is performed, the user cannot intuitively determine that the input is performed. For this reason, usability becomes poor.

In the electronic timepieces in the related art, each of which is disclosed in JP-A-2009-175044 and is introduced in "Goods Press, July 2013", Tokuma Shoten Publishing Co., Ltd, Jul. 10, 2013, pp. 75 to 81, in a state where the satellite signal cannot be received, or under an environment where it is difficult to receive the satellite signal, it is necessary to manually set the time zone when the time zone of the current location is not automatically set, or when the user wants to correct the time to the local time of his or her travelling destination in advance. However, since these electronic timepieces have multiple functions, the user needs to use multiple input devices in order to manually set the time zone. Therefore, there is a problem in that it is difficult to perform the input operation for manually setting the time zone.

SUMMARY

An advantage of some aspects of the invention is to solve at least a part of the problems described above, and the invention can be implemented as the following forms of application examples.

APPLICATION EXAMPLE 1

An electronic timepiece according to this application example includes: a display unit that displays measurement information; a drive mechanism that drives the display unit; an operation member that is rotarily operated; and a control unit that corrects the measurement information displayed on the display unit in accordance with the rotary operation of the operation member. The control unit has a single-measurement correction mode (or single correction mode) and a continuous-measurement correction mode (or continuous correction mode) that are selectable by the rotary operation of the operation member. In the single-measurement correction mode, a single correction signal is output to the drive mechanism so that the measurement information on the display unit is corrected by a single measurement unit. In the continuous-measurement correction mode, a continuous correction signal is output to the drive mechanism so that the measurement information on the display unit is corrected by continuously altering the measurement information in continuous measurement units up to a maximum of a continuous correction quantity. The continuous correction quantity is set depending on the type of the measurement information to be corrected in the continuous correction mode.

Examples of the measurement information (or display information) may include current time information, the date, the day, chronograph measured time information, the current position acquired by receiving a satellite signal, a time zone selected based on the current position, and the time (home time) of the time zone different from the current location. Examples of the display unit include an indicating hand and a display wheel such as a calendar wheel. As the operation member, a crown can be used.

In this application example, the display unit displays the measurement information (or display information). The display information on the display unit can be corrected by the rotary operation of the operation member. In this case, the control unit selects the single correction mode or the continuous correction mode by using the rotary operation of the operation member.

In the single correction mode, each time the control unit detects the rotary operation of the operation member, the control unit outputs the single correction signal to the drive mechanism, and corrects the display unit such as the indicating hand as much as the single correction quantity. Therefore, the display unit such as the indicating hand can correct the display information to be corrected for every one scale portion, thereby enabling delicate setting.

In the continuous correction mode, the control unit outputs the continuous correction signal to the drive mechanism, and corrects the display unit such as the indicating hand as much as the continuous correction quantity. The continuous correction quantity is set depending on the display information to be corrected. While the continuous correction signal is output, the correction of the display unit is continuously performed without operating the operation member. Accordingly, the display unit can be fast-forwarded, and the correction operation can be quickly performed. In addition, the continuous correction is configured to be stoppable by the rotary operation of the operation member during the continuous correction. Accordingly, during the continuous correction, the continuous correction can be stopped near a user's intended correction position, and the operation member can be moved to the correction position in the single correction mode. Therefore, as compared to a case where the single correction operation is repeatedly performed, it is possible to save labor in the correction operation.

In this application example, the control unit sets the number of the continuous correction quantity in the continuous correction mode depending on the types of display information. This allows the continuous correction quantity to be variable depending on the types of information. Accordingly, it is possible to perform delicate correction depending on the total correction quantity of the display information.

For example, when the total correction quantity of the display information is as small as 2 to 60, or when the correction time period required for the total correction quantity is as short as four seconds or shorter than four seconds, if the continuous correction operation is performed, there remains a short time period until the correction of the display unit is completed. Consequently, in many case, the display unit goes past the user's intended correction position.

On the other hand, when the total correction quantity of the display information is as large as 60 to 720, or when the correction time period required for the total correction quantity is as long as five seconds or longer than five seconds, if the display unit is corrected as much as the continuous correction quantity which is suitable for the information whose total correction quantity is small, one-time continuous correction operation may result in insufficiently corrected quantity. Consequently, the continuous correction operation has to be performed multiple times.

As described above, in any case, it becomes necessary to repeatedly perform the correction operation using the operation member. Accordingly, correction operability becomes poor.

In contrast, according to this application example, the continuous correction quantity is set depending on the types of the display information to be corrected in the continuous correction mode. Accordingly, for example, the continuous correction quantity matching the total correction quantity can be set for each display information. Therefore, even in the continuous correction mode, a user can easily correct the display unit to the user's intended scale, and thus, it is possible to improve operability during the correction of the display unit.

APPLICATION EXAMPLE 2

In the electronic timepiece according to the application example described above, it is preferable that: the rotary operation is detected if the operation member is rotated by a predetermined angle in a first direction or in a second direction opposite the first direction; the control unit selects the single-measurement correction mode if rotary operation is detected once within a predetermined time period; and the control unit selects the continuous-measurement correction mode if multiple rotary operations are consecutively detected in a single one of said first or second directions within the predetermined time period.

In this application example, a user can select the single correction mode or the continuous correction mode by merely changing the rotary operation quantity of the operation member within the predetermined time period. Therefore, as compared to a case where each mode is selected by performing the button operation, it is possible to improve operability during the correction of the display unit.

APPLICATION EXAMPLE 3

In the electronic timepiece according to the application example described above, it is preferable that: the display unit has a predefined, maximum displayable range for each type of measurement information; and the control unit sets the continuous correction quantity to the maximum displayable range of the type of measurement information that is to be corrected in the continuous correction mode.

Here, the total correction quantity of the display information represents the correction quantity until the display unit such as the indicating hand returns to the original position for starting the correction, that is, until the display unit displays the same information. For example, in a case of the indicating hand such as the second hand which indicates the same second if the indicating hand is rotated by one round (360 degrees), the total correction quantity means the correction quantity required for rotating the indicating hand by one round.

In this application example, the continuous correction quantity is set to the correction quantity which is the same as the total correction quantity of the display information. Accordingly, even if a user who attempts to perform the correction operation in the single correction mode performs the continuous correction operation by mistake, the display unit returns to the original position after being rotated by one round. Therefore, even if the user performs the continuous correction operation by mistake, the display unit is not considerably deviated from the user's intended correction position. Therefore, the display unit can be easily corrected to the user's intended correction position by continuously performing the correction operation in the single correction mode.

APPLICATION EXAMPLE 4

In the electronic timepiece according to the application example described above, it is preferable that: a first type of measurement information can be corrected by incrementing and decrementing its displayed measurement information; a second type of measurement information can be corrected only by incrementing its displayed measurement information; a third type of measurement information can be corrected only by decrementing its displayed measurement information; the control unit sets the continuous correction quantity equal to a value of one if the type of measurement information to be corrected in the continuous correction mode is of the second type or third type.

Some display units are changed in only one direction. For example, in some cases, when a thick hand is attached to a timepiece, a motor rotating in only one direction has to be used due to restricted specifications (restricted operation voltage of the timepiece) of the motor for driving the indicating hand. In this case, the rotation direction of the indicating hand becomes one direction (only a forward rotation direction).

When the correction operation of the display information in one direction is performed in this way, if the correction quantity for the continuous correction operation is large, there is high possibility that the display unit may go past the user's intended correction position when the user performs the continuous correction operation by mistake.

In order to recover this going-past, the optimum method is an operation in a rearward direction. However, in the display information in which the display unit is changed in only one direction as described above, the operation for returning the display unit in the rearward direction cannot be performed. Therefore, it is necessary to move the display unit to the intended position by the single correction operation. Thus, the correction operation becomes cumbersome.

In contrast, in this application example, the continuous correction quantity is set to be the same as the single correction quantity. Accordingly, even if the continuous correction operation is performed by mistake, the correction operation is restricted to the movement of the single correction quantity. Therefore, it is possible to prevent the display unit from going past the intended correction position, and thus, it is possible to improve correction operability.

APPLICATION EXAMPLE 5

In the electronic timepiece according to the application example described above, it is preferable that: the display unit has a predefined, maximum displayable range for each type of measurement information; and the control unit sets the continuous correction quantity to a value of one if the type of measurement information to be corrected in the continuous correction mode has a maximum displayable range that is equal to or smaller than a preset setting value.

When the total correction quantity of the display information is small, if the continuous correction quantity is increased, there is high possibility that the display unit may go past the user's intended correction position when the continuous correction operation is performed by mistake.

In contrast, in this application example, the continuous correction quantity is set to be the same as the single correction quantity. Accordingly, even if the continuous correction operation is performed by mistake, the correction operation is restricted to the movement of the single correction quantity. Therefore, it is possible to prevent the display unit from going past the intended correction position, and thus, it is possible to improve correction operability.

Furthermore, the total correction quantity of the display information is small. Accordingly, even if the continuous correction quantity is set to be the same as the single correction quantity, it is possible to prevent the correction operability from becoming poor without increasing the user's burden of the correction operation.

APPLICATION EXAMPLE 6

In the electronic timepiece according to the application example described above, it is preferable that: the display unit has a predefined, maximum displayable range for each type of measurement information; and the control unit sets the continuous correction quantity to a value of if a preset time period for correcting the measurement information from its lowest value to its maximum displayable value is equal to or shorter than a preset setting time period.

When the time period during which only the total correction quantity of the display unit is corrected, that is, the time period during which the display unit is rotated by one round (time period until the display unit is rotated by one round and returns to the original position) is short (for example, when drive frequency of the indicating hand for indicating the display information is high, or when the total correction quantity of the display information is small), the correction can be easily performed by only the single correction operation.

When a user instructs the continuous correction operation by mistake, if the continuous correction quantity is large, the display unit is rotated by one round within a short time period. Therefore, the display unit is less likely to align with the user's intended correction position.

In contrast, in this application example, the continuous correction quantity is set to be the same as the single correction quantity. Accordingly, even if the continuous correction operation is performed by mistake, the correction operation is restricted to the movement of the single correction quantity. Therefore, it is possible to prevent the display unit from going past the intended correction position, and thus, it is possible to improve correction operability.

Furthermore, the total correction quantity of the display information is small. Accordingly, even if the continuous correction quantity is set to be the same as the single correction quantity, it is possible to prevent the correction operability from becoming poor without increasing the user's burden of the correction operation.

APPLICATION EXAMPLE 7

In the electronic timepiece according to the application example described above, it is preferable that: the control unit sets the continuous correction quantity to a value of one if the type of measurement information to be corrected in the continuous correction mode is any one of a type of measurement information dependent upon receiving a satellite signal, a type of measurement information whose consecutive unit changed are not constant, and a type of measurement information has no continuity.

For example, the information which is set by receiving the satellite signal includes time zone information. For example, the information in which the movement quantity of the display unit is not constant during the correction includes information configured so that the days are displayed in a fan shape, and so that the indicating hand is moved to each scale of the respective days when the indicating hand is moved in one direction from the reference position and the indicating hand is moved to the reference position at a time after being moved to an end portion. The information in which the display information displayed on the display unit has no continuity includes the time zone information to be corrected from −12 hours to the zero hour after the information is corrected from the zero hour to +14 hours during correction.

In this application example, the correction quantity of the display information is not constant. Accordingly, if the continuous correction quantity is increased, it is sometimes difficult to correct the display unit to the user's intended position. In contrast, in this application example, the continuous correction quantity is set to be the same as the single correction quantity. Accordingly, even if the continuous correction operation is performed by mistake, the correction operation is restricted to the movement of the single correction quantity. Therefore, it is possible to prevent the display unit from going past the intended correction position, and thus, it is possible to improve correction operability.

APPLICATION EXAMPLE 8

A movement according to this application example includes: a winding stem that is rotatable at least at a zero stage position and a first stage position; a switch wheel that engages with the winding stem so as to rotate integrally with the winding stem; and a switch contact point spring body that comes into contact with the switch wheel in response to the rotation of the switch wheel when the winding stem is located at the first stage position; and that does not come into contact with the switch wheel; even if the switch wheel is rotated when the winding stem is located at the zero stage position.

Here, the zero stage position is a normal position where the crown is pressed inward to the movement, and the first stage position is a position where the crown is pulled by one stage from the zero stage position.

In this application example, when the crown is located at the zero stage position, even if the switch wheel is rotated, the switch contact point spring body does not come into contact with the switch wheel.

Therefore, when the crown is located at the zero stage position, even if the crown is rotated, a user does not feel a sense of resistance. Accordingly, the user can intuitively recognize that an input operation is not performed. In addition, the sense of resistance enables the user to determine whether or not the input operation is performed. Therefore, when the crown is located at the first stage position, the user feels the sense of resistance by rotating the crown, thereby enabling the user to intuitively recognize that the input operation is performed. This can improve usability.

APPLICATION EXAMPLE 9

In the movement according the application example described above, it is preferable that the movement further includes: a setting lever that engages with the winding stem and is moved in response to a movement of the winding stem; and a yoke that engages with the setting lever and is moved in response to a movement of the setting lever; wherein the switch wheel is disposed so as to be movable in an axial direction of the winding stem, and in response to a movement of the yoke, the switch wheel is moved to any of a position in contact with the switch contact point spring body and a position not in contact with the switch contact point spring body.

In this application example, the switch wheel is moved in mechanical conjunction with the winding stem by the setting lever and the yoke. Accordingly, the switch wheel can be reliably moved to a position corresponding to the position of the winding stem (the zero stage position and the first stage position). In this manner, it is possible to reliably set the movement so that the switch wheel and the switch contact point spring body come into contact with each other in response to the rotation of the switch wheel, when the winding stem is located at the first stage position, and so that the switch wheel and the switch contact point spring body do not come into contact with each other, when the winding stem is located at the zero stage position and even if the switch wheel is rotated.

APPLICATION EXAMPLE 10

In the movement according the application example described above, it is preferable that the setting lever includes a protruding portion and that the yoke be positioned by the protruding portion.

In this application example, the yoke can be positioned by the protruding portion disposed in the setting lever which is directly operated in conjunction with the winding stem. Accordingly, the yoke can be reliably arranged at a position corresponding to the position of the winding stem. As a result, the switch wheel can be reliably arranged at a position corresponding to the position of the winding stem.

APPLICATION EXAMPLE 11

In the movement according the application example described above, it is preferable that: the yoke is disposed so as to be movable in a first direction that is a direction for causing the switch wheel to move close to the switch contact point spring body, and in a second direction that is a direction for causing the switch wheel to move away from the switch contact point spring body; and that the protruding portion is disposed at a position where the movement of the yoke is regulated in the first direction and is not regulated in the second direction.

In this application example, when the yoke is moved in the first direction, the tooth of the switch wheel collides with the switch contact point spring body. When the switch wheel and the switch contact point spring body do not mesh with each other, the yoke can escape in the second direction. In this manner, it is possible to prevent the movement from being damaged due to the operation of the crown.

APPLICATION EXAMPLE 12

In the movement according the application example described above, it is preferable that the movement further includes a setting lever spring that holds the setting lever, and the setting lever spring includes a return spring portion that returns a position of the switch contact point spring body that is moved by coming into contact with the switch wheel to an original position.

In this application example, as compared to a case where the return spring for returning the position of the switch contact point spring body to the original position is configured to have a member which is different from the setting lever spring, it is possible to reduce the number of components. Therefore, it is possible to reduce the cost of the movement.

APPLICATION EXAMPLE 13

In the movement according the application example described above, it is preferable that the movement further includes a switch lever for detecting a position of the winding stem, the winding stem is further rotatable to a second stage position in addition to the zero stage position and the first stage position; and that the switch contact point spring body comes into contact with the switch wheel in response to the rotation of the switch wheel, when the winding stem is located at the second stage position.

In this application example, when the crown and the winding stem are located at the first stage position and the second stage position, the position can be detected by using the switch lever. In addition, when the crown and the winding stem are located at the first stage position and the second stage position, it is possible to rotate and bring the switch wheel into contact with the switch contact point spring body. Therefore, when the crown is located at the second stage position, it is possible to input a command of different types from the input at the first stage position. Accordingly, for example, as compared to a case where the input operation can be performed only when the crown is located at the first stage position, it is possible to increase the types of the command which can be input. In this manner, it is possible to increase functions which can be realized by operating the crown.

APPLICATION EXAMPLE 14

An electronic timepiece according to this application example includes the movement described above.

In this application example, it is possible to obtain advantageous effects which are the same as those in the above-described movement.

APPLICATION EXAMPLE 15

An electronic timepiece according to this application example includes a crown, a time zone display, a function by which a time zone of the current location is automatically set based on position information of a current location that is calculated using a satellite signal, and a function by which an arbitrary time zone selected from the time zone display is manually set. The arbitrary time zone is selected by operating the crown.

In this application example, the electronic timepiece includes the time zone display which indicates the time zone for the displayed time. The electronic timepiece includes the function of receiving the satellite signal, calculating the position information and the time information of the current location, and displaying the current time by automatically setting the time zone of the current location, and the function of manually setting the arbitrary time zone selected from the time zone display and displaying the local time of the set time zone. The arbitrary time zone which is manually set is selected from the time zone display by the input operation of the crown provided in the electronic timepiece. In this manner, the electronic timepiece according to the application example is configured so that the time zone can be manually set by using one input device (crown). Therefore, it is possible to provide the electronic timepiece which can manually set the time zone by using a simple input operation.

APPLICATION EXAMPLE 16

In the electronic timepiece according to the application example described above, it is preferable that the crown includes an operation position of multiple stages, and that the arbitrary time zone is selected at an operation position where the crown is pulled to the first stage.

In this application example, the electronic timepiece has the crown including multiple stage operation positions. For example, if a position (regular position) where the crown is pressed into a main body of the electronic timepiece is set to the zero stage, the crown generally includes the operation positions such as the first stage portion where the crown is pulled out by one stage and the second stage portion where the crown is pulled out by two stages. The arbitrary time zone is selected from the time zone display by operating the crown when the crown is fixed to the operation position of the first stage portion. Accordingly, the time zone can be manually set by using the simple input operation. Therefore, it is possible to provide the electronic timepiece which can manually set the time zone by a simple and easily understandable input operation.

APPLICATION EXAMPLE 17

In the electronic timepiece according to the application example described above, it is preferable that the crown includes an operation position of multiple stages; and the arbitrary time zone is selected at an operation position where the crown is pulled to the second stages.

In this application example, the arbitrary time zone is selected from the time zone display by operating the crown when the crown is fixed to the operation position of the second stage portion. The operation position of the second stage portion is a position where the crown is pulled out to the maximum. Accordingly, a user is likely to understand the input operation for manually setting the time zone. Therefore, it is possible to provide the electronic timepiece which can manually set the time zone by the simple and easily understandable input operation.

APPLICATION EXAMPLE 18

In the electronic timepiece according to the application example described above, it is preferable that the crown is configured to be capable of performing a rotary operation, and the arbitrary time zone is selected by the rotary operation of the crown.

In this application example, the crown includes a rotary operation function for performing the input operation by rotating the crown. The time zone displayed on the time zone display is switched over to another time zone in response to the rotary operation of the crown. The arbitrary time zone is selected from the time zone display by stopping the rotary operation of the crown. Accordingly, the time zone can be manually set by the simple input operation. Therefore, it is possible to provide the electronic timepiece which can manually set the time zone by the simple and easily understandable input operation.

APPLICATION EXAMPLE 19

In the electronic timepiece according to the application example described above, it is preferable that the crown is configured to be capable of performing a button operation for pressing the crown, and the arbitrary time zone is selected by the button operation of the crown.

In this application example, the crown includes a button operation function for performing the input operation by pressing the crown. The time zone displayed on the time zone display is switched over to another time zone in response to the button operation of the crown. The arbitrary time zone is selected from the time zone display in response to the button operation of the crown. Accordingly, the time zone can be manually set by the simple input operation. Therefore, it is possible to provide the electronic timepiece which can manually set the time zone by the simple and easily understandable input operation.

BRIEF DESCRIPTION OF THE DRAWINGS

The invention will be described with reference to the accompanying drawings, wherein like numbers reference like elements.

FIG. 7 is a view illustrating display correction data according to the first embodiment.

FIG. 21 is a view illustrating display correction data according to the first embodiment.

FIG. 25 is a view illustrating an example of a required time period during which display information is corrected and rotated by one round according to the embodiment of the invention.

DESCRIPTION OF EXEMPLARY EMBODIMENTS

Hereinafter, specific embodiments of the invention will be described with reference to the drawings. Additionally, Japanese Patent Application Nos. 2014-62049, filed Mar. 25, 2014; 2014-57394, filed Mar. 20, 2014; and 2014-43063, filed Mar. 6, 2014 are herein expressly incorporated by reference in their entirety.

First Embodiment

Figure 1:
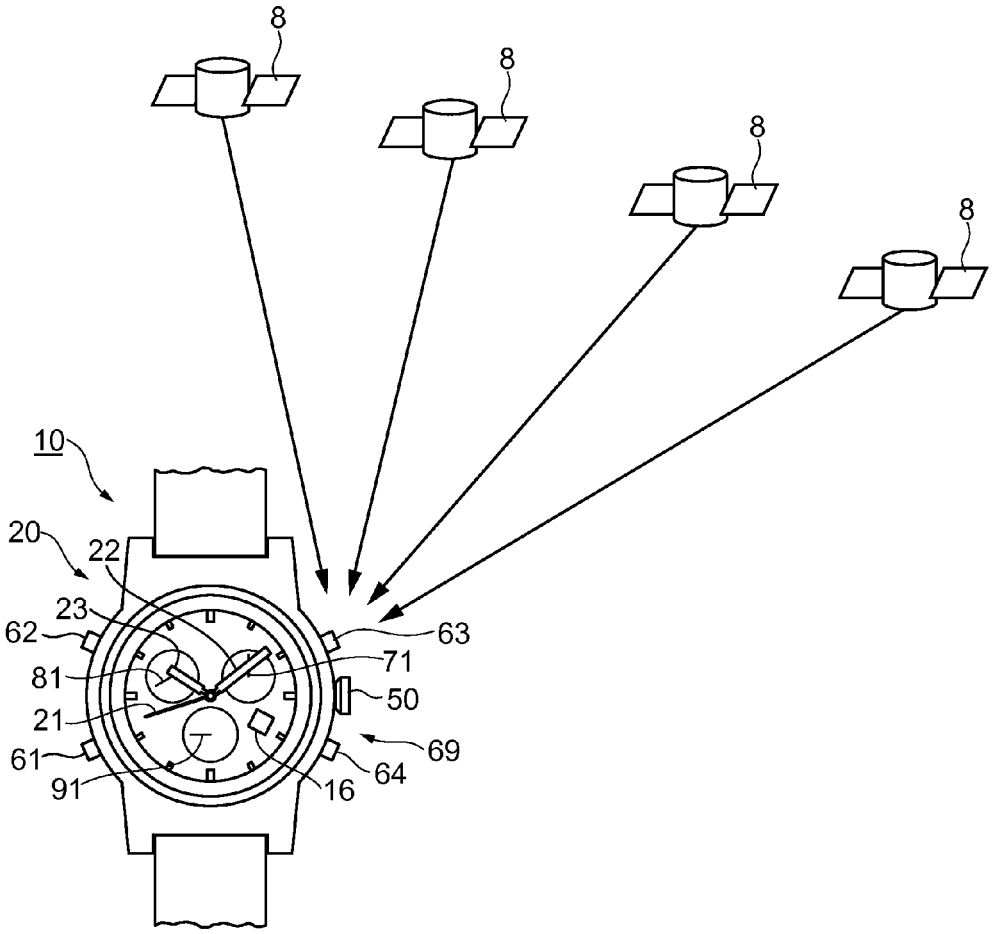
FIG. 1 is a schematic front view of an electronic timepiece according to a first embodiment of the invention.

FIG. 1 is a schematic front view of an electronic timepiece 10 according to a first embodiment of the invention.

As illustrated in FIG. 1, the electronic timepiece 10 is configured to acquire time information by receiving a satellite signal from at least one GPS satellite 8 within multiple GPS satellites 8 following a predetermined orbit of the earth in space, and to calculate position information by receiving the satellite signal from at least three GPS satellites 8. The GPS satellite 8 is an example of position information satellites, and is present at multiple locations in the sky above the earth. Currently, approximately 30 GPS satellites 8 are turning around.

Schematic Configuration of Electronic Timepiece

Figure 2:
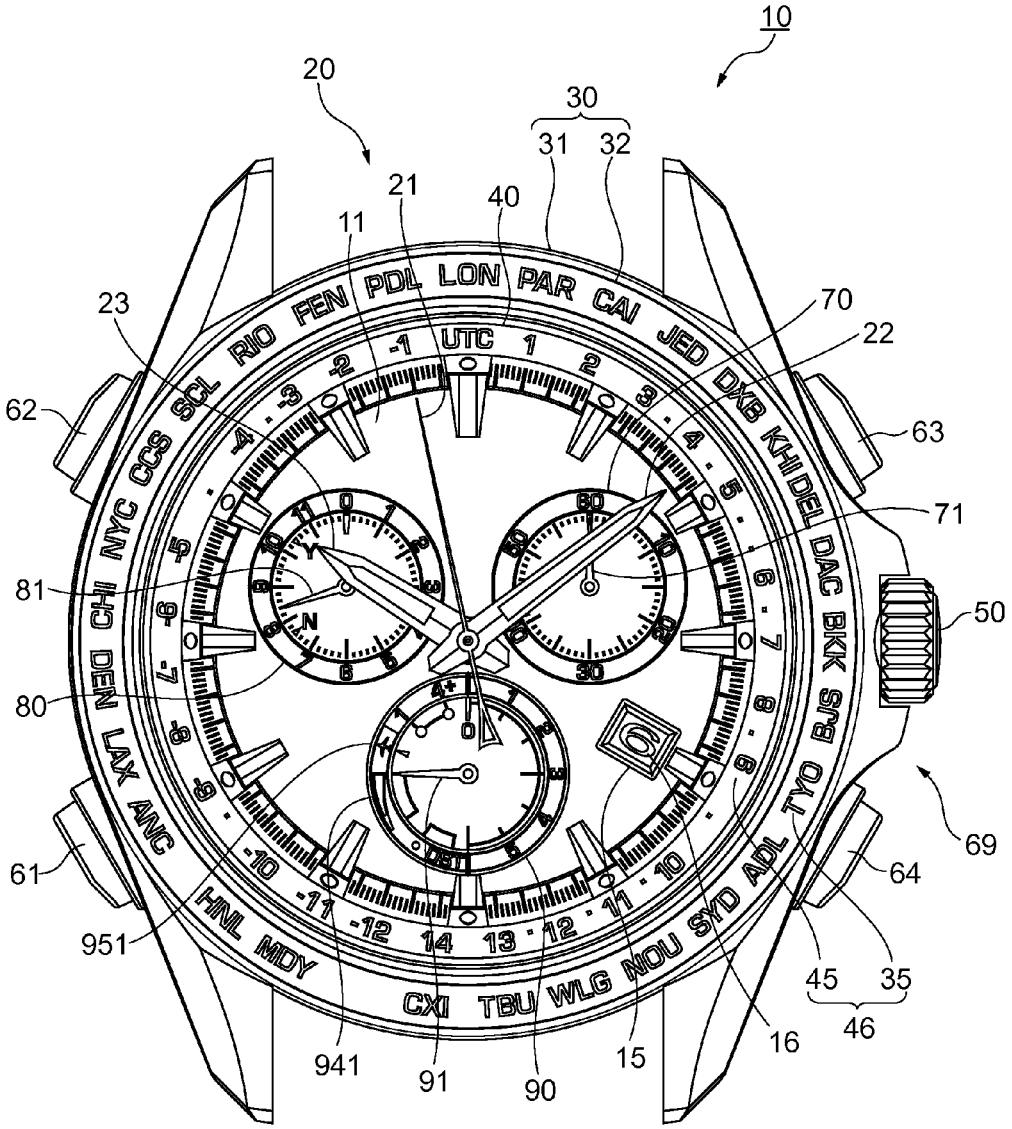
FIG. 2 is a front view illustrating the electronic timepiece according to the first embodiment.
Figure 3:
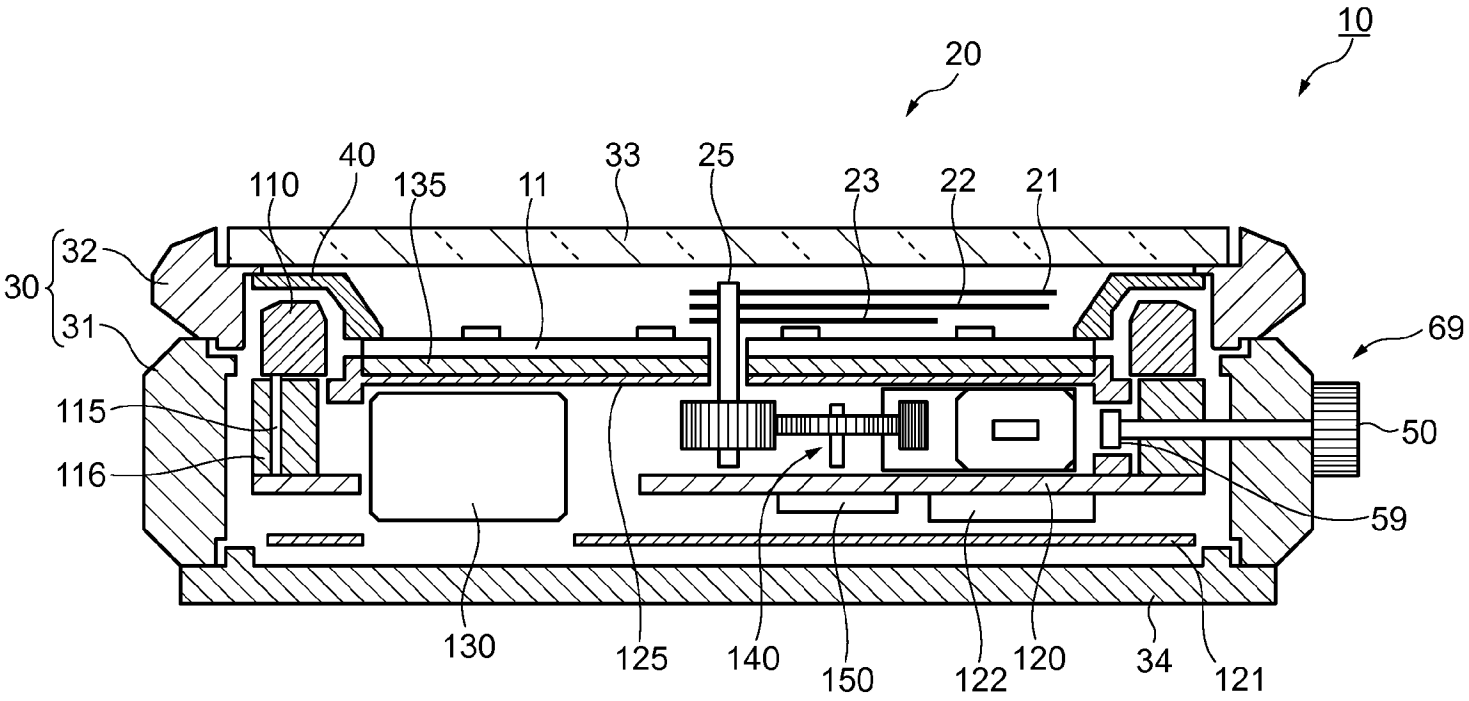
FIG. 3 is a schematic cross-sectional view of the electronic timepiece according to the first embodiment.

FIG. 2 is a detailed front view of the electronic timepiece 10. FIG. 3 is a schematic cross-sectional view of the electronic timepiece 10.

The electronic timepiece 10 is a wrist timepiece which a user wears on his or her wrist. The electronic timepiece 10 according to the embodiment includes a world time function and a chronograph function.

As illustrated in FIGS. 2 and 3, the electronic timepiece 10 includes an exterior case 30, a cover glass 33, and a case back 34.

The exterior case 30 is configured so that a bezel 32 formed of ceramic is fitted to a cylindrical case 31 formed of metal. A disc-shaped dial 11 is arranged on an inner peripheral side of the bezel 32 via an annular dial ring 40 formed of plastic.

Indicating hands 21, 22, and 23 are disposed on a front surface side (cover glass 33 side) of the dial 11.

The dial 11 has a circular first small window 70 and an indicating hand 71 in the direction of 2 o'clock from the center, a circular second small window 80 and an indicating hand 81 in the direction of 10 o'clock from the center, a circular third small window 90 and an indicating hand 91 in the direction of 6 o'clock from the center, and a rectangular small calendar window 15 in the direction of 4 o'clock.

The dial 11, the indicating hands 21, 22, and 23, the first small window 70, the indicating hand 71, the second small window 80, the indicting hand 81, the third small window 90, the indicating hand 91, and the small calendar window 15 are visible through the cover glass 33.

A calendar wheel (date indicator) 16 is arranged on a rear surface side of the dial 11, and the calendar wheel 16 is partially visible through the small calendar window 15.

In the embodiment, the above-described indicating hands 21, 22, 23, 71, 81, and 91, and the calendar wheel 16 configure a display device 20. The display device 20 corresponds to a display unit according to the invention.

In the display device 20, the measured current time is displayed by the indicating hand 81 serving as a second hand, the indicating hand 22 serving as a minute hand, and the indicating hand 23 serving as an hour hand, and the measured current date is displayed by the calendar wheel 16. A time measurement result of the chronograph function is displayed by the indicating hand 21 serving as a one-fifth second chronograph hand, the indicating hand 71 serving as a minute chronograph hand, and the indicating hand 91 serving as an hour chronograph hand.

As will be described later, the indicting hand 91 is also used for indicating various mode information items such as setting ON/OFF of the summer time (i.e. daylights saving time), a battery residual capacity level, and a reception mode.

In the embodiment, the current time (second, minute, and hour), the current date, a chronograph time measurement result (one-fifth second, minute, and hour), various mode information items which are displayed on the display device correspond to display information (e.g. displayed measurement information) according to the invention.

Aside surface of the exterior case 30 has an A-button 61 at the position in the direction of 8 o'clock from the center of the dial 11, a B-button 62 at the position in the direction of 10 o'clock from the center of the dial 11, a C-button 63 at the position in the direction of 2 o'clock from the center of the dial 11, a D-button 64 at the position in the direction of 4 o'clock from the center of the dial 11, and a crown 50 at the position in the direction of 3 o'clock from the center of the dial 11.

The A-button 61, the B-button 62, the C-button 63, the D-button 64, and the crown 50 are operated so as to output an operation signal in response to the operation.

In the embodiment, the crown 50 corresponds to an operation member according to the invention. Then, the crown 50, the A-button 61, the B-button 62, the C-button 63, and the D-button 64 configure an input device 69 (operation unit). A rotary operation of the crown 50 is detected by a rotation detection unit 59, as shown in FIG. 3, (to be described later, refer to FIGS. 4A and 4B).

Internal Structure of Electronic Timepiece

As illustrated in FIG. 3, in the electronic timepiece 10, out of two front and rear openings of the metallic exterior case 30, the front surface side opening is closed by the cover glass 33 via the bezel 32, and the rear surface side opening is closed by the case back 34 formed of metal.

An inner side of the exterior case 30 includes a dial ring 40 attached to an inner periphery of the bezel 32, the light transmitting dial 11, an indicating hand axle 25 penetrating the dial 11, and a drive mechanism 140 that drives the display device 20 including the indicating hands 21, 22, and 23 which turn around the indicating hand axle 25 (including the indicating hands 71, 81, and 91, and the calendar wheel 16 which are not illustrated in FIG. 3).

The indicating hand axle 25 passes through the center of the exterior case 30 in a plan view, and is disposed along the central axis extending in the forward and rearward direction.

The dial ring 40 includes a flat plate section in which an outer peripheral end comes into contact with an inner peripheral surface of the bezel 32 and one surface is parallel to the cover glass 33, and a tilting section which tilts to the dial 11 side so that an inner peripheral end comes into contact with the dial 11. The dial ring 40 has an annular shape in a plan view, and has a bowl shape in a cross-sectional view. A doughnut-shaped accommodation space is formed by the flat plate section and the tilting section of the dial ring 40 and the inner peripheral surface of the bezel 32. An annular antenna body 110 is accommodated inside the accommodation space.

This antenna body 110 is formed in such a way that an annular dielectric is used as a base material and a metallic antenna pattern is printed thereon by means of plating or silver paste. The antenna body 110 is arranged on the outer periphery of the dial 11, and is covered with the dial ring 40 arranged on the inner peripheral surface side of the bezel 32 and further formed of plastic and the cover glass 33. Accordingly, favorable reception can be ensured. The dielectric can be formed by mixing a dielectric material such as titanium oxide used at high frequency into a resin. In this manner, in cooperation with wavelength shortening of the dielectric, the antenna can be further miniaturized.

The dial 11 is a circular plate member which displays the time inside the exterior case 30, is formed of a light transmitting material such as plastic, includes the indicating hands 21, 22, and 23 between the cover glass 33 and the dial 11, and is arranged inside the dial ring 40.

A solar panel 135 for performing photovoltaic power generation is provided between the dial 11 and a main plate 125 to which the drive mechanism 140 is attached.

The solar panel 135 is a circular flat plate in which multiple solar cells (photovoltaic elements) converting light energy into electrical energy (electric power) are connected in series. In addition, the solar panel 135 also has a sunlight detection function. The dial 11, the solar panel 135, and the main plate 125 respectively have a hole through which the indicating hand axle 25, and each indicating hand axle (not illustrated) of the indicating hand 71 of the first small window 70, the indicating hand 81 of the second small window 80, and the indicating hand 91 of the third small window 90, and have an opening section for the small calendar window 15.

The drive mechanism 140 is attached to the main plate 125, and is covered with a circuit board 120 from the rear surface side.

Figure 5:
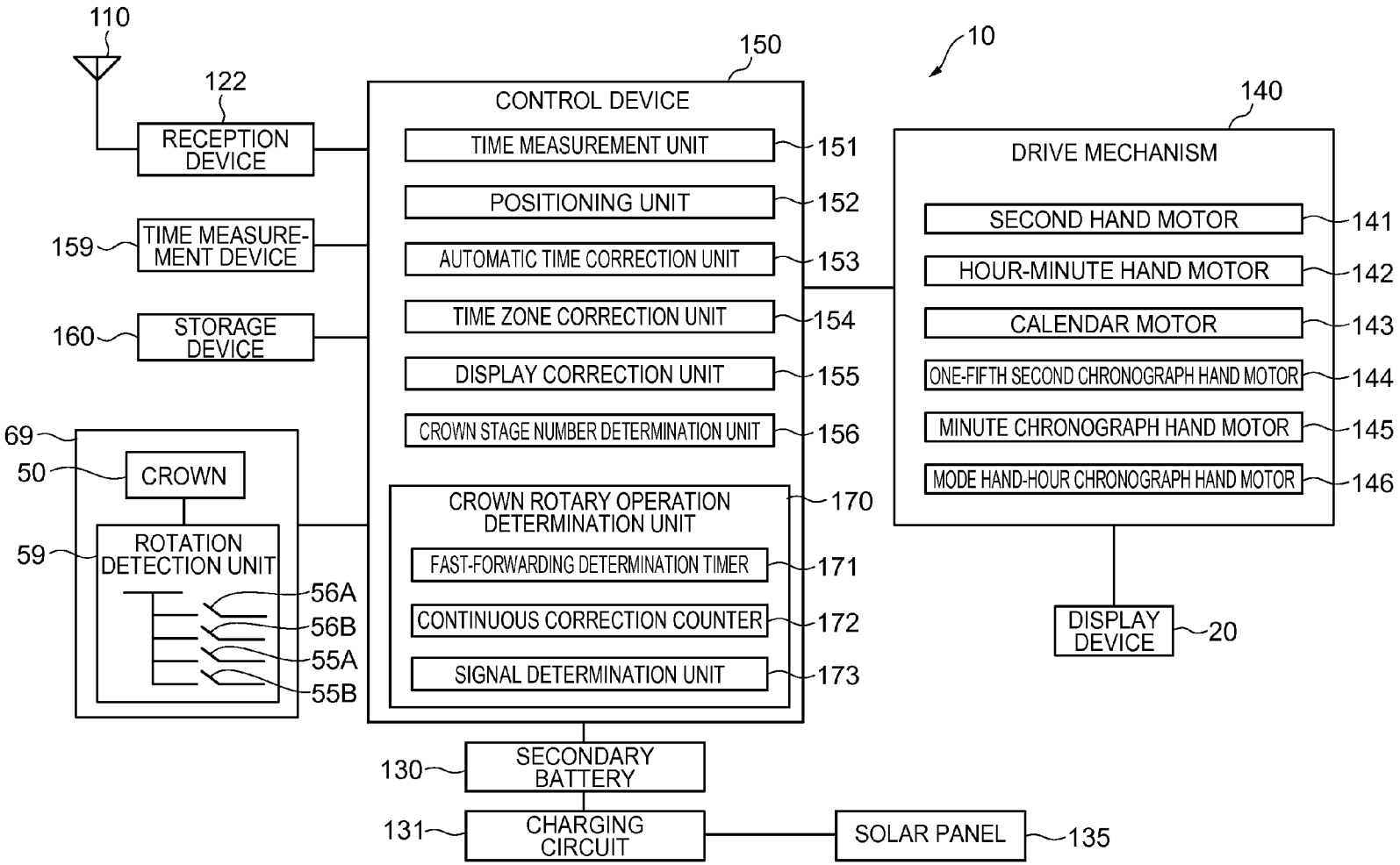
FIG. 5 is a block diagram illustrating a configuration of the electronic timepiece according to the first embodiment.

As illustrated in FIG. 5, the drive mechanism 140 includes a second hand motor 141, an hour-minute hand motor 142, a calendar motor 143, a one-fifth second chronograph hand motor 144, a minute chronograph hand motor 145, and a mode hand-hour chronograph hand motor 146.

The second hand motor 141 drives the indicating hand 81 so as to display the second of the current time.

The hour-minute hand motor 142 drives the indicating hands 22 and 23 so as to display the minute and the hour of the current time.

The calendar motor 143 drives the calendar wheel 16 so as to display the measured current date.

The one-fifth second chronograph hand motor 144 drives the indicating hand 21 so as to display the second in the chronograph function.

The minute chronograph hand motor 145 drives the indicating hand 71 so as to display the minute in the chronograph function.

The mode hand-hour chronograph hand motor 146 drives the indicating hand 91 so as to display the hour in the chronograph function, or mode information of the electronic timepiece 10.

The respective motors 141 to 146 of the drive mechanism 140 are step motors, and drive the respective indicating hands 21, 22, 23, 71, 81, and 91, and the calendar wheel 16 which configure the display device 20 via a train wheel of a gear. A control device (to be described later) 150 controls an input of a drive signal to the respective motors 141 to 146, and drives each unit of the display device 20. In the following description, a correction quantity (drive quantity of the step motor) when the respective indicating hands 21, 22, 23, 71, 81, and 91, and the calendar wheel 16 are moved by one scale of the displayed measurement information (minimum correction unit (i.e. minimum displayable measurement unit) of display information, e.g. displayed measurement information) is referred to one step, in some cases.

The circuit board 120 includes a reception device 122 (GPS module) serving as reception means and an information acquisition unit according to the invention, and the control device 150.

The case back 34 side (rear surface side on which the reception device 122 and the control device 150 are disposed) of the circuit board 120 has a circuit holder 121 for covering these circuit components. A secondary battery 130 such as a lithium ion battery is disposed between the main plate 125 and the case back 34.

A charging circuit 131 (refer to FIG. 5) charges the secondary battery 130 with electric power generated by the solar panel 135.

The circuit holder 121 has an opening for accommodating the secondary battery 130 inside the exterior case 30. In addition, a main plate support ring 116 formed annularly is arranged between the circuit board 120 and the antenna body 110.

The electric power is supplied to the antenna body 110 through a power supply point, and an antenna connection pin 115 is connected to the power supply point. The antenna connection pin 115 is a metallic and a pin-shaped connector, is arranged to penetrate the main plate support ring 116, and is in contact with the circuit board 120. In this manner, the circuit board 120 and the antenna body 110 inside the accommodation space are connected to each other using the antenna connection pin 115.

Rotation Detection Unit

The rotation detection unit 59 for detecting the rotation of the crown 50 is disposed in the circuit board 120.

The rotation detection unit 59 detects a rotation direction and a rotation quantity thereof, when the crown 50 performs the rotary operation.

Figure 4A:
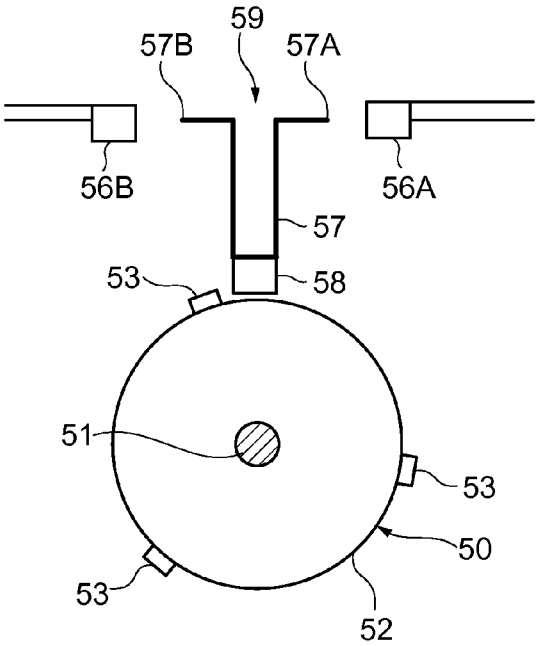
FIG. 4A is a view illustrating a schematic configuration of a rotation detection unit according to the first embodiment.
Figure 4B:
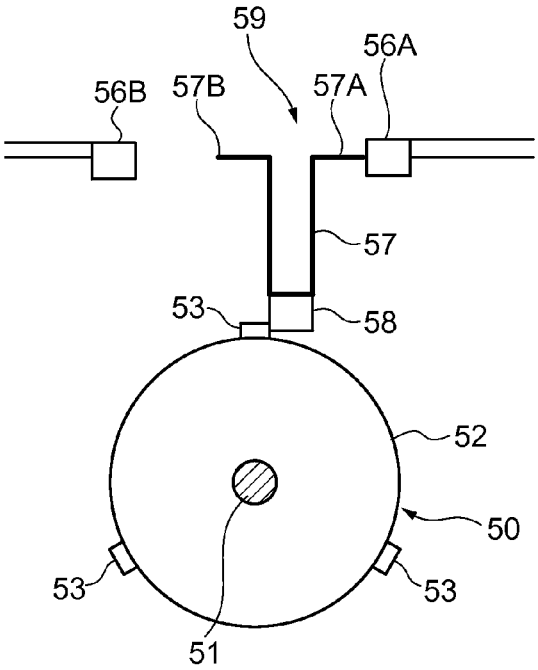
FIG. 4B is a view illustrating a schematic configuration of the rotation detection unit according to the first embodiment.

As illustrated in FIGS. 4A and 4B, the crown 50 includes a winding stem 51 and a switch wheel 52 whose center is fixed to the winding stem 51. An outer peripheral edge of the switch wheel 52 includes multiple teeth 53 (in the embodiment, three at an interval of 120 degrees).

As illustrated in FIGS. 4A and 4B, the rotation detection unit 59 includes a moving body 58, a contact point spring 57 having contact points 57A and 57B, a first switch 56A, and a second switch 56B.

The moving body 58 is disposed on a movement route of the teeth 53 of the switch wheel 52 so as to be movable in a tangential direction of the outer peripheral edge of the switch wheel 52. Then, if the teeth 53 of the switch wheel 52 come into contact with the moving body 58, the moving body 58 moves in a rotation direction of the switch wheel 52 (rotary operation direction of the crown 50) as illustrated in FIG. 4B.

The contact point spring 57 is fixed to the moving body 58, and biases the moving body 58 against an initial position (position illustrated in FIG. 4A) side which is located on the movement route of the teeth 53. Therefore, if the crown 50 performs the rotary operation (rightward rotation, forward rotation direction), the moving body 58 is moved by the teeth 53 as illustrated in FIG. 4B. Furthermore, if the crown 50 is rotated in the same direction, the moving body 58 is moved by the teeth 53. In this manner, the contact point spring 57 is deflected, and the teeth 53 are moved by climbing over the moving body 58. Then, if the teeth 53 are separated from the moving body 58, the moving body 58 returns to the initial position due to a biasing force of the contact point spring 57.

The contact point spring 57 is connected to the control device 150 (to be described later, refer to FIG. 5), and a predetermined power supply voltage (VDD) is applied thereto. Therefore, when the moving body 58 moves to the first switch 56A side, one contact point 57A of the contact point spring 57 comes into contact with the first switch 56A. In addition, when the moving body 58 moves to the second switch 56B side, the other contact point 57B of the contact point spring 57 comes into contact with the second switch 56B.

The first switch 56A and the second switch 56B are respectively connected to the control device 150, and the control device 150 can detect whether the contact point spring 57 comes into contact with both the first switch 56A and the second switch 56B.

In this rotation detection unit 59, if the crown 50 is rotated clockwise, the contact point 57A and the first switch 56A come into contact with each other, thereby bringing the first switch 56A into a turned-on state. In this manner, a voltage signal (VDD) of the contact point spring 57 is input to the control device 150 via the first switch 56A as a detection signal.

Similarly, if the crown 50 performs the rotary operation in the rearward direction (rotated counterclockwise), the contact point 57B and the second switch 56B come into contact with each other, thereby bringing the second switch 56B into a turned-on state. In this manner, the voltage signal (VDD) of the contact point spring 57 is input to the control device 150 via the second switch 56B as the detection signal.

Therefore, it is possible to detect the rotation direction of the crown 50 by determining whether the first switch 56A is in the turned-on state or the second switch 56B is in the turned-on state.

In the embodiment, as described above, the teeth 53 are arranged at the interval of 120 degrees. Accordingly, the rotation detection unit 59 outputs the detection signal to the control device 150 each time the crown 50 is rotated by 120 degrees.

The crown 50 is configured to be movable at three stages (zero to second stages) in the axial direction of the winding stem 51. Then, the rotation detection unit 59 includes a third switch 55A (refer to FIG. 5) and a fourth switch 55B (refer to FIG. 5) which output a signal in response to the number of stage where the crown 50 is pulled out, to the control device 150.

The third switch 55A outputs a pulling-out detection signal to the control device 150 when the crown 50 is pulled out to the first stage. The fourth switch 55B outputs the pulling-out detection signal to the control device 150 when the crown 50 is pulled out to the second stage.

The control device 150 determines the switch which outputs the pulling-out detection signal, and thus, can determine the number of stage where the crown 50 is pulled out.

Details of Display Section of Electronic Timepiece

As illustrated in FIG. 2, a scale which divides the outer periphery into 60 portions and further a one-fifth scale which divides the scale into five portions are marked on the outermost periphery of the dial 11. Using these scales, the indicating hand 21 indicates the "second" of the chronograph function, the indicating hand 22 indicates the "minute" of the internal timepiece, and the indicating hand 23 indicates the "hour" of the internal timepiece. The chronograph function can be used by operating any button among the A-button 61, the B-button 62, the C-button 63, and the D-button 64.

A scale which divides the outer periphery into 60 portions and ten-digit numbers from "10" to "60" are marked on the outer periphery of the first small circular window 70 which is disposed in the dial 11. The indicating hand 71 indicates the "minute" of the chronograph function using the scale.

A scale which divides the outer periphery into 60 portions and numbers from "0" to "11" are marked on the outer periphery of the second small circular window 80 which is disposed in the dial 11. The indicating hand 81 indicates the "second" of the internal timepiece using the scale.

A letter "Y" is marked at the position of 52 seconds in the second small window 80, and a letter "N" is marked at the position of 38 seconds. These letters correspond to display indicating an information reception result which is disposed in the small window, and indicate an acquisition result of various information items (first information and second information) based on the satellite signal received from the satellite (Y: reception (acquisition) successful, N: reception (acquisition) in failure) and setting for automatic reception of the satellite signal (Y: automatic reception ON, N: automatic reception OFF).

If a user operates the B-button 62 and thus the mode is shifted to a display mode of the information reception result, the indicating hand 81 indicates either "Y" or "N", and displays the acquisition result of the first information and the second information based on the satellite signal. In addition, the user operates the A-button 61 and the B-button 62 so as to align the indicating hand 81 with "Y" or "N". In this manner, it is possible to set ON/OFF of the automatic reception of the satellite signal.

The second small window 80 is located in the left half region of the dial 11 in a plan view, that is, when the dial 11 is viewed from the front surface side. Accordingly, even when the wide indicating hands 22 and 23 are located so as to overlap the second small window 80, the letters "Y" and "N" are arranged near the outer edge in the left half region of the second small window 80 so as to easily recognize the letters "Y" and "N".

In the embodiment, the mark "Y" is disposed at the position of 52 seconds, and the mark "N" is disposed at the position of 38 seconds, but the positions are not limited thereto. Depending on the position for disposing the other small window for the reception result display, it is preferable to dispose the marks "Y" and "N" at an easily visible position. For example, when the second small window 80 is located in the right half region of the dial 11, the letters "Y" and "N" may be arranged near the outer edge of the right half region of the second small window 80.

Description will be made with regard to the outer periphery of the third small circular window 90 disposed in the dial 11. In the following description of a range of the outer periphery, although a "direction of n o'clock" (n is an arbitrary natural number) will be used, this direction represents a direction when the circular outer periphery is viewed from the center of the third small window 90.

A scale dividing the range into six portions and numbers from "0" to "5" are marked on the outer periphery of the range in the direction from 12 o'clock to 6 o'clock of the third small window 90. The indicating hand 91 displays the "hour" of the chronograph function by using the scale. The chronograph function enables the time to be measured for 59 seconds, 59 minutes and five hours by using the indicating hands 21, 71, and 91.

Letters "DST" and a symbol "O " are marked on the outer periphery of the range in the direction from 6 o'clock to 7 o'clock of the third small window 90. Daylight saving time (DST) means summer time. The letters and the symbol represent setting for the summer time (DST: summer time ON, O: summer time OFF). A user operates the crown 50 and the B-button 62 so as to align the indicating hand 91 with "DST" or "O ". In this manner, it is possible to set ON/OFF of the summer time in the electronic timepiece 10.

A crescent sickle-shaped symbol 941 in which a proximal end in the direction of 9 o'clock is thick and a distal end in the direction of 7 o'clock is thin is marked along the outer circumference on the outer periphery of the range in the direction from 7 o'clock to 9 o'clock of the third small window 90. The symbol 941 is a power indictor of the secondary battery 130 (refer to FIG. 3), and the indicating hand 91 indicates any one of the proximal end, the middle, and the distal end, depending on the battery residual capacity. The indicating hand 91 indicates the power indicator when the electronic timepiece 10 displays the normal time, or when the time is manually corrected.

An airplane-shaped symbol 951 is marked on the outer periphery of the range in the direction from 9 o'clock to 10 o'clock of the third small window 90. The symbol represents a flight mode. During takeoff and landing of aircraft, reception of the satellite signal is prohibited by the Aviation Law. A user operates the A-button 61, and selects the symbol 951 (flight mode) by using the indicating hand 91. In this manner, it is possible to cause the electronic timepiece 10 to stop the reception of the satellite signal.

A number "1" and a symbol "4+" are marked on the outer periphery of the range in the direction from 10 o'clock to 12 o'clock of the third small window 90. The number and the symbol represent reception content (reception mode) of the satellite signal. The number "1" means that the internal time is corrected by receiving the GPS time information (time measurement mode), and the symbol "4+" means that the internal time and a time zone (to be described later) are corrected by receiving the GPS time information and orbit information.

The electronic timepiece 10 performs the reception operation by the user pressing the B-button 62, but the reception mode is set according to a time period while the B-button 62 is pressed.

During the normal time display, if the B-button 62 is pressed for a first setting time period (for example, three seconds or more and less than six seconds), the electronic timepiece 10 causes the drive mechanism 140 to drive the indicating hand (second hand) 81 indicating the time so as to move to a zero second position, and to drive the indicating hand 91 so as to move to a position of "1" in FIG. 2. Then, if the B-button 62 pressed for three seconds or more is separated therefrom within the first setting time period (less than six seconds from when a user starts to press the B-button 62), the electronic timepiece 10 performs the reception processing in the time measurement mode.

On the other hand, if the B-button 62 is continuously pressed without being separated therefrom within the first setting time period, beyond the first setting time period (after six seconds have passed), the electronic timepiece 10 drives the indicating hand 81 located at the zero second position so to move forward to a 30 second position, and drives the indicating hand 91 so as to move to a position of "4+" in FIG. 2.

Furthermore, during the normal time display, if the B-button 62 is pressed for a third setting time period (for example, less than three seconds), as will be described later, the electronic timepiece 10 displays the reception result of the satellite signal received immediately before.

The small calendar window 15 is disposed in an opening section which is rectangularly open in dial 11, and numbers printed in the calendar wheel 16 are visible through the opening section. The numbers represent the "date" in the date, the month, and the year.

Here, a relationship among the Universal Time Coordinated (UTC), a time difference, the standard time, and a time zone will be described.

The time zone represents a territory which uses a local standard time common to that territory, and currently, 40 types of the time zone are present. Unless otherwise specified, the term "stand time" will hereinafter refer to the local standard time of given territory (i.e. corresponding to any of the 40 represented time zones). The respective time zones are distinguished from each other by a time difference between a given standard time and the UTC. For example, Japan belongs to a time zone of plus nine hours, which identifies its standard time as being nine hours ahead of the UTC. The standard time used in the respective time zones can be obtained by the UTC and the time difference between the UTC and the standard time.

As described above, the scale for displaying the minute and the second which are divided into 60 portions is engraved on the dial 11. Time difference information 45, which shows the time difference between the Universal Time Coordinated (UTC) and the standard time of different territories, is marked along the scale by using numbers and symbols such as a dot, ".", (i.e. symbols other than the numbers), in the dial ring 40 surrounding the outer peripheral section of the dial 11. The time difference information 45 specified in integer numbers represents a time difference as an integer whole (i.e. in whole hours), and the time difference information 45 specified in symbol "." represents a time difference other than an integer whole (i.e. in fractions of an hour). For example, the symbol "." between the numbers "3" and "4" represents that the time difference is "30 minutes and three hours". Two symbols "." are set between the numbers "5" and "6", thereby respectively representing that the time difference is "30 minutes and five hours" and "45 minutes and five hours". In the embodiment, the setting is made so that a total of 40 time zones can be selected.

The time difference between the internal time indicated by the indicating hands 22, 23, and 81 and the UTC can be confirmed using the time difference information 45 indicated by the indicating hand 21 through the operation of the crown 50.

In the bezel 32 disposed around the dial ring 40, city information 35 showing a representative city name in a given time zone (whose standard time is defined by the corresponding time difference information 45 marked in the dial ring 40) is marked together with its corresponding time difference information 45. Here, the marks of the time difference information 45 and the city information 35 are referred to as a time zone display 46. In the embodiment, the time zone display 46 is preferably marked so that the number of display items is equal to the number of time zones used all over the world.

Circuit Configuration of Electronic Timepiece

FIG. 5 is a block diagram illustrating a circuit configuration of the electronic timepiece 10.

The electronic timepiece 10 includes the display device 20, the input device 69, the reception device 122, and the control device 150, and further includes a time measurement device 159 and a storage device 160.

Reception Device

The reception device 122 receives the satellite signal which is a load driven by electric power accumulated in the secondary battery 130 and is transmitted from the GPS satellite 8 through the antenna body 110 if the reception device 122 is driven by the control device 150. Then, when the reception device 122 successfully receives the satellite signal, the reception device 122 transmits information such as the acquired orbit information and the GPS time information to the control device 150. On the other hand, when the reception device 122 fails to receive the satellite signal, the reception device 122 transmits information indicating the failure to the control device 150. A configuration of the reception device 122 is the same as a configuration of a known GPS reception circuit, and thus, description thereof will be omitted.

Time Measurement Device

The time measurement device 159 includes a quartz crystal vibrator driven by the electric power accumulated in the secondary battery 130, and updates time data using a reference signal, based on an oscillation signal of the quartz crystal vibrator.

Storage Device

Figure 6:
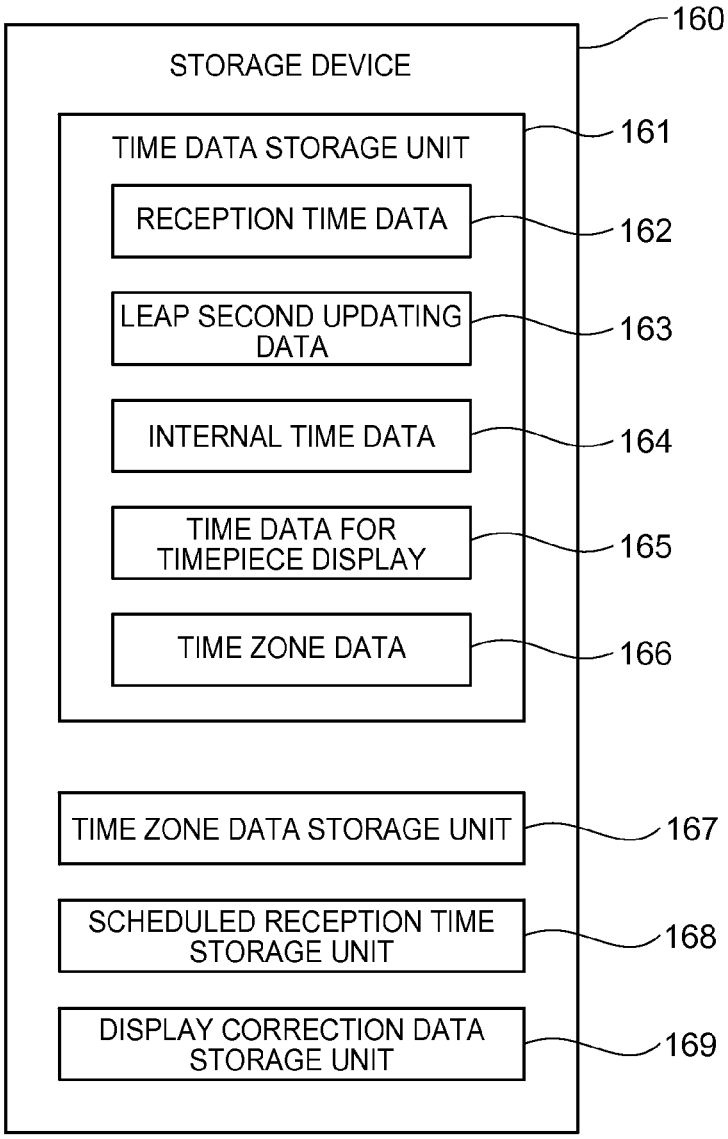
FIG. 6 is a block diagram illustrating a configuration of a storage device according to the first embodiment.

As illustrated in FIG. 6, the storage device 160 includes a time data storage unit 161, a time zone data storage unit 167, a scheduled reception time storage unit 168, and a display correction data storage unit 169.

The time data storage unit 161 stores reception time data 162, leap second updating data 163, internal time data 164, time data for timepiece display 165, and time zone data 166.

The reception time data 162 stores the time information (GPS time) acquired from the satellite signal. The reception time data 162 is generally updated every second by the time measurement device 159. When the satellite signal is received, the reception time data 162 is corrected by the acquired time information (GPS time).

The leap second updating data 163 stores data of at least the current leap second. That is, as data related to the leap second, "page 18, subframe 4" of the satellite signal includes each data such as the "current leap second", the "week for updating the leap second", the "date for updating the leap second", and the "leap second after the updating". In the embodiment, at least data related to the "current leap second" among these is stored in the leap second data 163.

The internal time data 164 stores internal time information. The internal time information is updated by the GPS time stored in the reception time data 162 and the "current leap second" stored in the leap second updating data 163. That is, the internal time data 164 stores the Universal Time Coordinated (UTC). When the reception time data 162 is updated in the time measurement device 159, the internal time information is also updated.

The time data for timepiece display 165 stores time data in which the time zone data (time zone information and time difference information) of the time zone data 166 is added to the internal time information of the internal time data 164. The time zone data 166 is set by the position information acquired when the position information is received in the positioning mode. In addition, as will be described later, the time zone data 166 can also be manually set by the rotary operation of the crown 50.

The time zone data storage unit 167 stores the position information (latitude and longitude) and the time zone information (time difference information) by associating both of these with each other. Therefore, when the position information is acquired in the positioning mode, the control device 150 can acquire the time zone data, based on the position information (latitude and longitude).

The time zone data storage unit 167 further stores a city name and the time zone data by associating both of these with each other. Therefore, if a user selects a city name of which the user wants to know the local time by moving the indicating hand 21 using the operation of the input device 69, the control device 150 searches for the city name set by the user from the time zone data storage unit 167. In this manner, the time zone data corresponding to the city name may be acquired and set in the time zone data 166.

The scheduled reception time storage unit 168 stores scheduled reception time for performing scheduled reception processing in the time measurement unit 151. The scheduled reception time storage unit 168 stores the time when preceding forced reception is successful.

Display Correction Data Storage Unit of Storage Device

The display correction data storage unit 169 stores display correction data used for an operation in a display correction unit 155 of the control device 150 (to be described later).

As illustrated in FIG. 7, the display correction data storage unit 169 stores each of a single correction quantity 169B which is a correction quantity using a single correction operation for each display correction mode 169A, that is, for each display information (e.g. displayed measurement information) of a correction target, a continuous correction quantity 169C which is a correction quantity using a continuous correction operation, a crown stage number 169D and a button operation 169E which are used for selecting a display correction mode.

Here, the single correction quantity 169B is a correction quantity for single correction, that is, the number of "1". The number "1" of the single correction quantity 169B is the minimum correction quantity for each display information (e.g. displayed measurement information). For example, as illustrated in FIG. 2, since the total 40 time zones are set in the time difference information 45 of the dial ring 40, the total number of correction quantity is "40", and the number "1" of the single correction quantity corresponds to one time zone portion. Display positions of the respective time zones in the dial ring 40 are not arranged at equal interval. Accordingly, a hand operation angle of the indicating hand 21 using a single correction signal of the single correction quantity is not also constant. For example, the hand operation angle (number of drive steps of the one-fifth second chronograph hand motor 144) of the indicating hand 21 when the time zone is moved from "2" to "3" is different from the hand operation angle (number of drive steps of the one-fifth second chronograph hand motor 144) of the indicating hand 21 when the time zone is moved from "3" to the subsequent".", that is, "3:30". However, any case shows the correction using the single correction quantity.

Then, if the display correction mode 169A is the "time zone selection mode", the single correction quantity 169B is "1", and the continuous correction quantity 169C is "1". Then, the operation for selecting the "time zone selection mode" is performed in such a way that the crown stage number 169D shows the "first" stage portion and the button operation 169E shows "nothing".

Within the items stored in the display correction data storage unit 169, the single correction quantity 169B represents single correction, and thus, is basically set to start from "1".

On the other hand, the continuous correction quantity 169C is set based on a correction target of each display correction mode 169A and the total correction quantity. Here, the total correction quantity means the correction quantity required until the respective indicating hands 21, 22, 23, 71, 81, and 91, and the calendar wheel 16 which serve as a display unit return to their respective original positions.

For example, in the "one-fifth second chronograph hand correction mode", the total correction quantity "300" of the indicating hand 21, which is the correction target, is set into the continuous correction quantity 169C.

Similarly, in the "date correction mode", the total correction quantity "31" of the calendar wheel 16, which is the correction target, is set into the continuous correction quantity 169C.

On the other hand, in a case of some display correction modes, the total correction quantity is corrected by the correction quantity which is the same as that in the single correction mode even if the continuous correction operation is performed. As a result, the continuous correction is not performed.

For example, in the "time zone selection mode", "1" which is the same as the single correction quantity 169B is set as the continuous correction quantity 169C.

This reason is based on that the correction target in the "time zone selection mode" is the time zone display 46 (refer to FIG. 2) on the dial ring 40 indicated by the indicating hand 21, and that the time difference information 45 has portions which are partially not arranged at equal interval, or has a discontinuous portion (portion between "−4" and "−5", or portion between "5" and "6").

When the correction target is any one of (1) information set by receiving the satellite signal (for example, time zone information), (2) information in which a movement quantity of the display unit is not constant during the correction (for example, time zone information or day information which is arranged in a fan shape and is indicated by a reciprocating indicating hand), and (3) information whose display on the display unit is not continuous (−12 hours subsequent to +14 hours in the time zone information), the above-described continuous correction operations are similarly and respectively excluded.

Control Device

The control device 150 is a control unit, and is configured to include a CPU for controlling the electronic timepiece 10, as illustrated in FIG. 5.

The control device 150 includes the time measurement unit 151, a positioning unit 152, an automatic time correction unit 153, a time zone correction unit 154, a display correction unit 155, a crown stage number determination unit 156, and a crown rotary operation determination unit 170.

Time Measurement Unit

The time measurement unit 151 operates the reception device 122, and performs the reception processing in the time measurement mode.

During the reception processing in the time measurement mode, the time measurement unit 151 captures at least one GPS satellite 8 by suing the reception device 122, and acquires the time information by receiving the satellite signal transmitted from the GPS satellite 8.

In the embodiment, the time measurement unit 151 performs the reception processing in the time measurement mode during automatic reception processing and manual reception processing.

The automatic reception processing is classified into two types of scheduled automatic reception processing and photo automatic reception processing. That is, the time measurement unit 151 operates the reception device 122 so as to perform the scheduled automatic reception processing in the time measurement mode, when measured internal time data 164 shows scheduled reception time stored in the scheduled reception time storage unit 168.

The time measurement unit 151 operates the reception device 122 so as to perform the photo automatic reception processing in the time measurement mode, when a generated voltage or a generated current of the solar panel 135 has a setting value or greater, and if it is determined that sunlight illuminates the solar panel 135 outdoors. The number of processing for operating the reception device 122 in a power generating state of the solar panel 135 may be limited to once a day.

As described above, the manual reception processing is performed in such a way that a user presses the B-button 62 of the input device 69 for the first setting time period and performs a forced reception operation. The time measurement unit 151 operates the reception device 122 so as to perform the manual reception processing in the time measurement mode.

Positioning Unit

As described above, the positioning unit 152 operates the reception device 122 so as to perform the reception processing in the positioning mode, when the user presses the B-button 62 of the input device 69 for the second setting time period and performs the forced reception operation.

The reception processing may be performed in the setting mode during the automatic reception processing (scheduled automatic reception processing or the photo automatic reception processing) by selecting and setting the time measurement mode, the positioning mode, and the leap second reception mode in advance.

If the positioning unit 152 starts the reception processing in the positioning mode, the positioning unit 152 causes the reception device 122 to capture at least three, preferably four or more GPS satellites 8, and calculates and acquires the position information by receiving the satellite signal transmitted from the respective GPS satellites 8. In addition, the positioning unit 152 can also acquire the time information when receiving the satellite signal.

Automatic Time Correction Unit

The automatic time correction unit 153 corrects the reception time data 162 using the acquired time information, when the time information is successfully acquired by the reception processing of the time measurement unit 151 or the positioning unit 152. The internal time data 164 and the time data for timepiece display 165 are also corrected by correcting the reception time data 162. If the time data for timepiece display 165 is corrected, the current time display is also corrected in the display device 20 which is synchronized with the time data for timepiece display 165 by a hand position detection unit.

Time Zone Correction Unit

When the position information is calculated and successfully acquired by the positioning unit 152, the time zone correction unit 154 sets the time zone data, based on the acquired position information (latitude and longitude). Specifically, the time zone correction unit 154 selects and acquires the time zone data corresponding to the position information (time zone information, that is, time difference information) from the time zone data storage unit 167, and stores the time zone information in the time zone data 166.

For example, Japanese Standard Time (JST) is nine hours ahead of the UTC (i.e. UTC+9). Accordingly, if the position information acquired by the positioning unit 152 corresponds to Japan, the time zone correction unit 154 reads out the time difference information (+nine hours) of Japanese Standard Time from the time zone data storage unit 167, and stores the time information in the time zone data 166.

After setting the time zone information, the time zone correction unit 154 corrects the time data for timepiece display 165 by using the time zone data. Therefore, the time data for timepiece display 165 is the time obtained by adding the time zone data (i.e. the difference information) to the internal time data 164 which is the UTC.

Display Correction Unit

In response to the operation of the crown 50 by the user, the display correction unit 155 causes the drive mechanism 140 to be driven separately from a normal operation, and performs display correction of the display device 20 (Steps S85 to S88 in FIG. 8, to be described later; hereinafter, Steps are abbreviated to "S").

For example, when the time of the time data for timepiece display 165 stored in the storage device 160 and the display time of the indicating hands 22 and 23 in the display device 20 do not coincide with each other for some reason, the hour-minute hand motor 142 of the drive mechanism. 140 is driven in response to the operation of the crown 50 so as to align the indicating hands 22 and 23 with the reference position (position of zero minute, zero o'clock). Then, if a reference position alignment mode is released by pressing the crown 50 into the zero stage, the indicating hands 22 and 23 are automatically corrected to a position for indicating the time of the time data for timepiece display 165.

With regard to the display correction, as an operation mode for the display correction, the display correction unit 155 has a "single correction mode" in which a display position of any correction target within the indicating hands of the display device 20 is changed on a unit-by-unit basis by operating the crown 50, and a "continuous correction mode" in which the display position is continuously changed and is stopped at an arbitrary display position by operating the crown 50.

In the "single correction mode", the display correction unit 155 outputs a single correction signal to the drive mechanism 140, and corrects the display device 20 by a single correction quantity (one unit).

In the "continuous correction mode", the display correction unit 155 outputs a continuous correction signal to the drive mechanism 140, and corrects the display device 20 by a continuous correction quantity.

In order to perform this display correction operation, the control unit 150 causes the crown stage number determination unit 156 and the crown rotary operation determination unit 170 to detect the operation of the crown 50 which is performed by a user (S81 to S90 in FIG. 8, to be described later).

The control device 150 (display correction unit 155, crown stage number determination unit 156, and crown rotary operation determination unit 170) sets any one of an "initial mode", a "fast-forwarding determination mode", and a "fast-forwarding stop determination mode" as a signal determination mode.

The "initial mode" is a mode performed when the rotary operation of the crown 50 is not detected. If the first rotary operation of the crown 50 is detected in the "initial mode", the mode proceeds to the "fast-forwarding determination mode".

The "fast-forwarding determination mode" is a mode for detecting whether or not the continuous rotary operation of the crown 50 is performed. If the continuous rotary operation of the crown 50, that is, the rotary operation continuously performed multiple times in the same direction within a predetermined time period is detected in the "fast-forwarding determination mode", the "continuous correction mode" is set in the operation mode for the display correction. In addition, the signal determination mode is to detect whether or not the stop operation is performed during the continuous correction. Accordingly, the mode proceeds to the "fast-forwarding stop determination mode".

On the other hand, when the rotary operation continuously performed multiple times in the same direction within the predetermined time period is not detected in the "fast-forwarding determination mode", that is, when the rotary operation is detected once, the "single correction mode" is set in the operation mode for the display correction. In addition, the signal determination mode proceeds to the "initial mode".

Therefore, the "continuous correction mode" and the "single correction mode" which serve as the display correction operation are performed while the "fast-forwarding determination mode" and the "fast-forwarding stop determination mode" are performed for any correction target of the display device 20. These specific operations will be described later.

Crown Stage Number Determination Unit

The crown stage number determination unit 156 determines whether or not the crown 50 is pulled out, based on a pulling-out detection signal transmitted from the third switch 55A or the fourth switch 55B in the rotation detection unit 59.

In a state where the crown 50 is not pulled out, both the third switch 55A and the fourth switch 55B are in a turned-off state. In this case, the crown stage number detection unit 156 determines that the crown 50 is not pulled out (pulling-out stage number is "0").

If the crown 50 is pulled out to the first stage, the third switch 55A is in a turned-on state, and the fourth switch 55B is in a turned-off state. The pulling-out detection signal is input to the control device 150 from the third switch 55A. In this case, the crown stage number detection unit 156 determines that the pulling-out stage number of the crown 50 is "1".

If the crown 50 is pulled out to the second stage, the third switch 55A is in a turned-off state, and the fourth switch 55B is in a turned-on state. The pulling-out detection signal is input to the control device 150 from the fourth switch 55B. In this case, the crown stage number detection unit 156 determines that the pulling-out stage number of the crown 50 is "2".

Crown Rotary Operation Determination Unit

The crown rotary operation determination unit 170 includes a fast-forwarding determination timer 171, a continuous correction counter 172, and a signal determination unit 173.

The signal determination unit 173 determines that the current signal determination mode in the control device 150 corresponds to any one among the "initial mode", the "fast-forwarding determination mode", and the "fast-forwarding stop determination mode".

The fast-forwarding determination timer 171 performs countdown in response to a lapse of time until a preset initial value thereof becomes a zero count value.

The fast-forwarding determination timer 171 starts countdown at the time when the signal determination mode is the "initial mode" and the signal detected first (first detection signal) is input from the rotation detection unit 59 to the control device 150 (refer to FIG. 10 to be described later).

An initial value of the fast-forwarding determination timer 171 is set to a preset time period for fast-forwarding determination (for example, 160 ms).

During a period until the countdown of the fast-forwarding determination timer 171 shows the zero count value, when the signal detected for the second time (second detection signal) is input from the rotation detection unit 59 to the control device 150 and the second rotary operation continuously performed in the same direction is detected, it is determined whether the continuous rotary operation (fast-forwarding operation) of the crown 50 is performed. Therefore, the fast-forwarding determination timer 171 stops the countdown (S119 in FIG. 11 to be described later). At this time, the fast-forwarding determination timer 171 resets the count value (return to the initial value of 160 ms).

On the other hand, if the time period for fast-forwarding determination elapses (count value becomes zero) until the detection of the first detection signal while the second detection signal is not detected, the fast-forwarding determination timer 171 stops the countdown, since the first operation (single turning operation) of the crown 50 has been detected. Then, the fast-forwarding determination timer 171 resets the count value (return to the initial value of 160 ms).

The continuous correction counter 172 sets a correction quantity in the continuous correction mode, and performs countdown each time the display correction unit 155 performs the display correction (S85 to S88 in FIG. 8 to be described later) until the preset initial value becomes the zero count value (refer to S89 in FIG. 8 to be described later).

Figure 11:
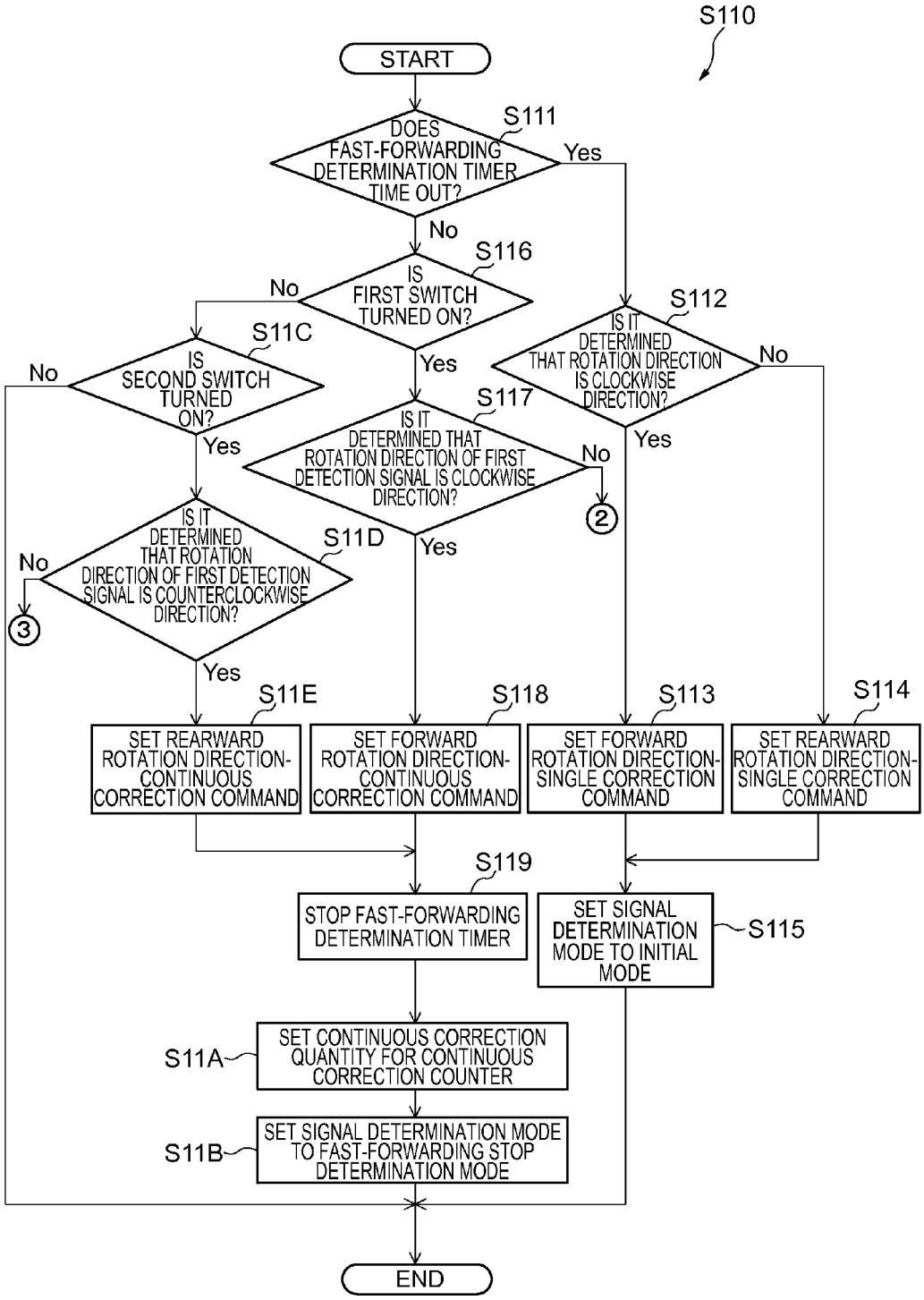
FIG. 11 is a flowchart of the signal determination processing in a fast-forwarding determination mode in FIG. 7.

The continuous correction counter 172 set a continuous correction quantity depending on types of information of a correction target as the initial value, at the time when the signal determination mode is the "fast-forwarding determination mode", the signal detected for the second time (second detection signal) is input from the rotation detection unit 59 to the control device 150, and the second rotary operation continuously performed in the same direction is detected refer to FIG. 11 to be described later).

The initial value of the continuous correction counter 172 is set with reference to the continuous correction quantity 169C in FIG. 7.

Basic Operation of Control Device

In the electronic timepiece 10, if a user performs a manual operation of the input device 69 (crown 50 and respective buttons 61 to 64), the control device 150 performs processing in response to the operation.

For example, if the crown 50 is operated, manual correction processing for correcting the display time is performed in response to the operation. In addition, if the B-button 62 is pressed for the first setting time period, the manual reception processing is performed in the time measurement mode. If the B-button 62 is pressed for the second setting time period, the manual reception processing is performed in the positioning mode.

Display Correction Operation

Referring to a flowchart in FIG. 8, display correction processing of the display device 20 which is performed by a user to pull out the crown 50 to the first stage or the second stage will be described.

Figure 8:
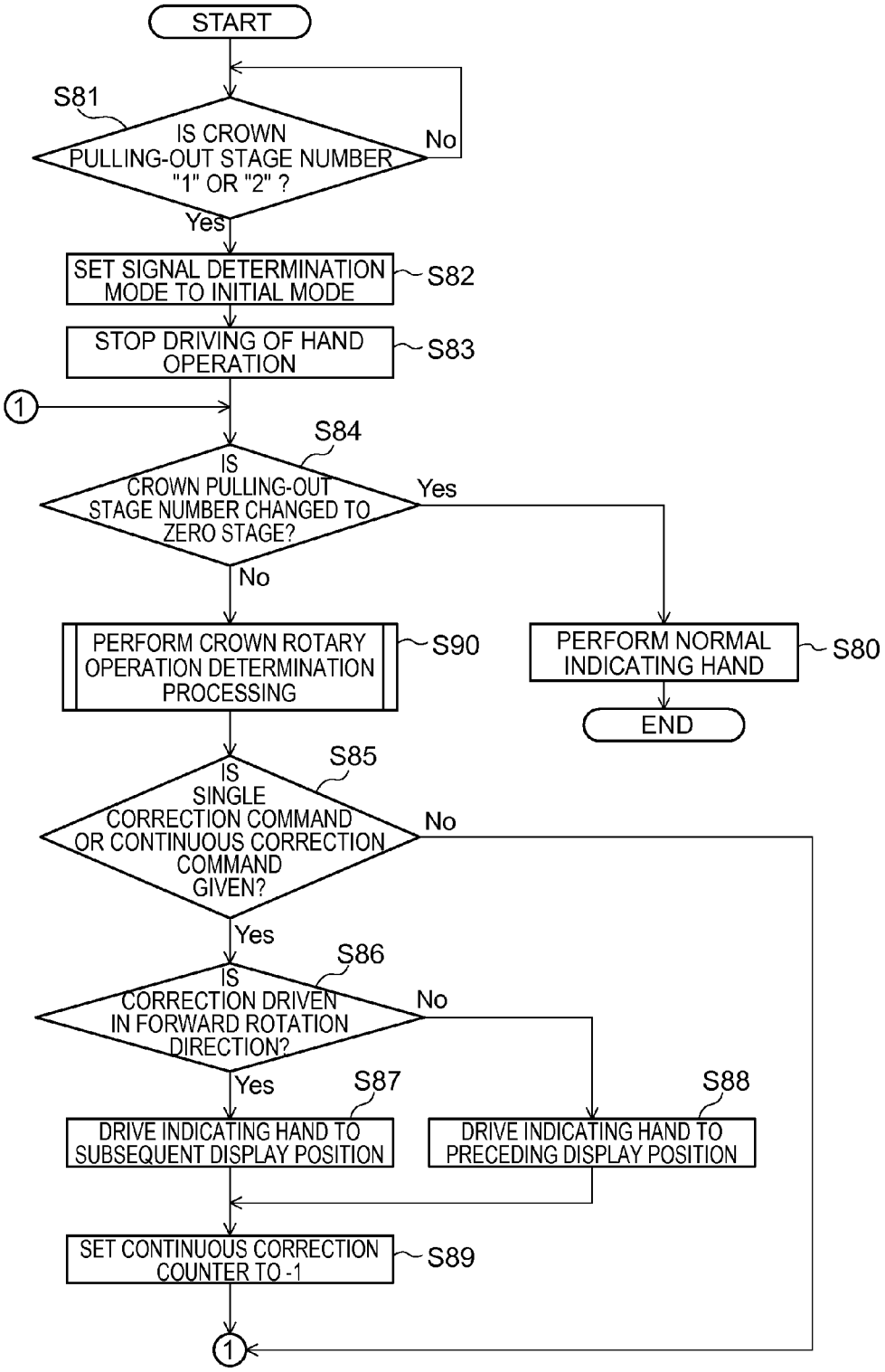
FIG. 8 is a flowchart of display correction according to the first embodiment.

In FIG. 8, the display correction unit 155 of the control device 150 monitors an output of the crown stage number determination unit 156, and continuously perform the monitoring unless the pulling-out number of the crown 50 is "1" or "2" (if the pulling-out number is "0") (S81). On the other hand, if the pulling-out number of the crown 50 becomes "1" or "2" (Yes in S81), the display correction unit 155 starts the display correction processing subsequent to S82.

In FIG. 8, if the crown 50 is pulled out to the first stage or the second stage, the crown stage number determination unit 156 detects a change in the stage number, and it is determined as Yes in S81. Therefore, the control device 150 sets the signal determination mode to the "initial mode" (S82), and instructs the drive mechanism 140 to stop driving for the hand operation (S83).

The control device 150 confirms whether or not the crown 50 returns to the zero stage (S84). If the crown 50 returns to the zero stage (Yes in S84), the control device 150 causes the drive mechanism 140 to restart the normal hand operation (S80). On the other hand, unless the crown 50 returns to the zero stage, the control device 150 causes the crown rotary operation determination unit 170 to perform rotary operation determination processing of the crown 50 (S90).

Crown Rotary Operation Determination Processing

Figure 9:
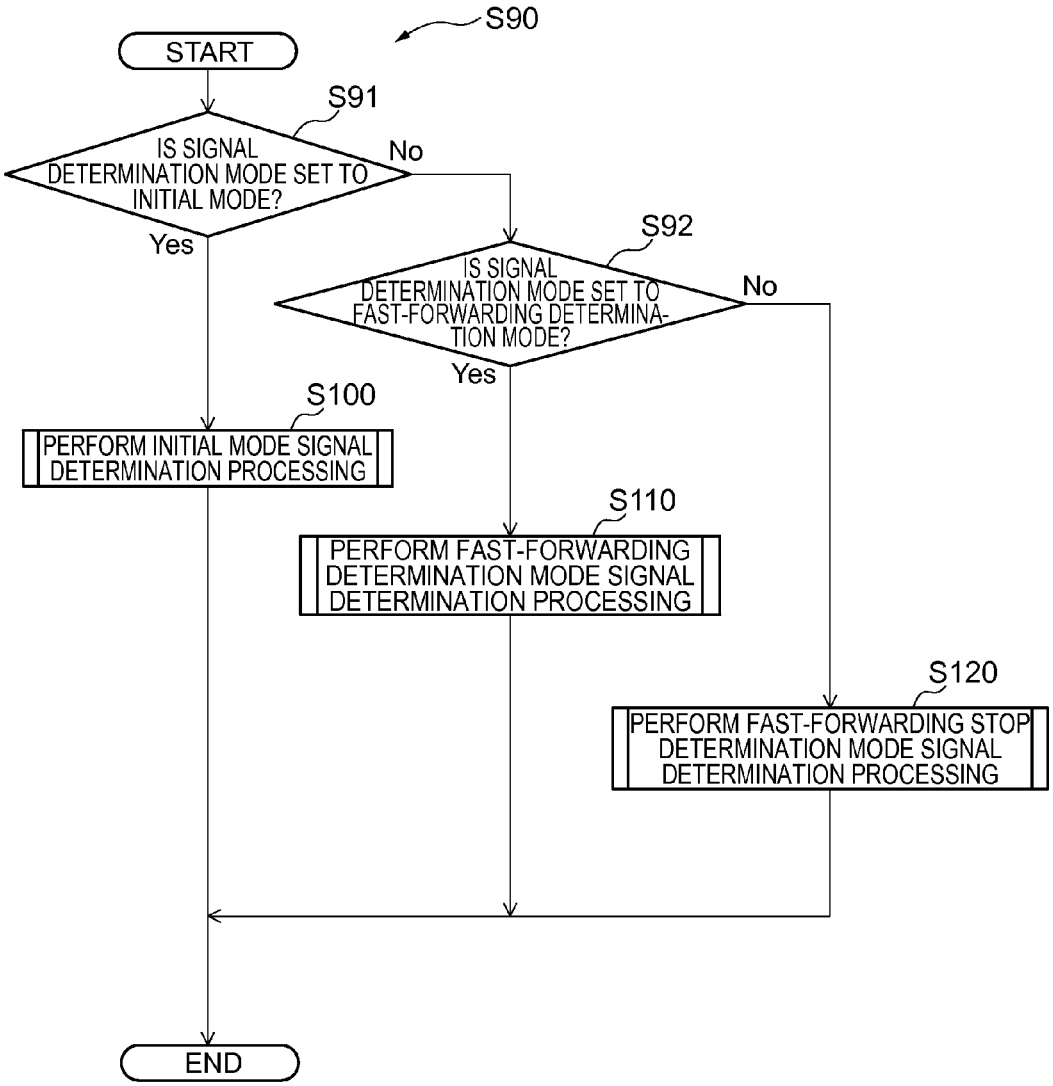
FIG. 9 is a flowchart of crown rotary operation determination processing in FIG. 8.

As illustrated in FIG. 9, crown rotary operation determination processing S90 performed by the crown rotary operation determination unit 170 is divided to processing steps corresponding to each mode, depending on the current signal determination mode.

If the current signal determination mode is the "initial mode" (Yes in S91), initial mode signal determination processing S100 (refer to FIG. 10) is performed.

If the current signal determination mode is the "fast-forwarding determination mode" (Yes in S92), fast-forwarding determination mode signal determination processing 5110 (refer to FIG. 11) is performed.

If the current signal determination mode is the other mode, that is, the "fast-forwarding stop determination mode" (No in S91 and S92), fast-forwarding stop determination mode signal determination processing 5120 (refer to FIG. 12) is performed.

Initial Mode Signal Determination Processing

Figure 10:
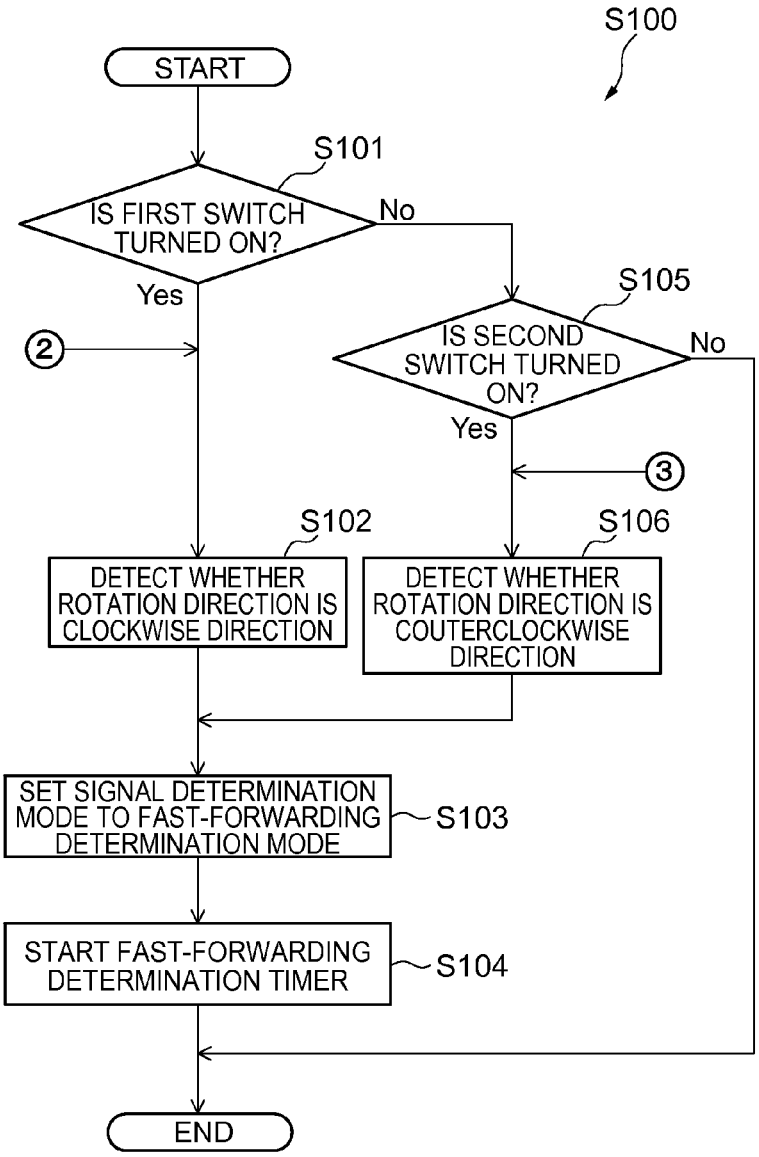
FIG. 10 is a flowchart of signal determination processing in an initial mode in FIG. 7.

As illustrated in FIG. 10, in initial mode signal determination processing S100, the control device 150 first determines whether or not the first switch 56A is turned "ON" (S101).

If the first switch 56A is turned "ON" (Yes in S101), it is determined that the rotary operation of the crown 50 is performed (first detection signal) and the rotation direction is a "clockwise direction" (S102).

On the other hand, if it is determined as No in S101, the control device 150 determines whether or not the second switch 56B is turned "ON" (S105). If the second switch 56B is turned "ON" (Yes in S105), it is determined that the rotary operation of the crown 50 is performed and the rotation direction is a "counterclockwise direction" (S106).

In the embodiment, the display device 20 such as the indicating hand is set so as to be corrected in a forward rotation direction when the crown 50 is rotated clockwise, and so as to be corrected in a rearward rotation direction when the crown 50 is rotated counterclockwise.

Then, after the processing in S102 and S106, the signal determination mode is set to the "fast-forwarding determination mode" (S103), the fast-forwarding determination timer 171 is started (S104).

In a case of No in S105, neither the first switch 56A nor the second switch 56B is input. Accordingly, the initial mode signal determination processing S100 is completed, and returns to the processing in FIG. 9. Then, since the crown rotary operation determination processing S90 in FIG. 9 is also completed, the control device 150 returns to the processing in FIG. 8.

Determination Processing of Correction Command

In FIG. 8, if the control device 150 returns from the crown rotary operation determination processing S90, the control device 150 determines whether there is a single correction command or a continuous correction command (S85). Here, the "initial mode" remains unchanged in which neither the first switch 56A nor the second switch 56B is input after passing through the initial mode signal determination processing S100 from the crown rotary operation determination processing S90, or the one-time input of either the first switch 56A or the second switch 56B is detected so that the mode is just changed to the "fast-forwarding determination mode". Accordingly, since neither the single correction command nor the continuous correction command is given, it is determined as No in S85.

Therefore, without processing steps S86 to S89 (to be described later) being performed, the processing from S84 (confirmation on whether or not the crown 50 returns to the zero stage) is repeatedly performed.

Then, when the crown rotary operation determination processing S90 is performed again, if the "fast-forwarding determination mode" is set during the preceding initial mode signal determination processing S100 (refer to FIG. 10), it is determined as Yes in S92, and it is determined as No in S91. Accordingly, the fast-forwarding determination mode signal determination processing 5110 (refer to FIG. 11) is performed.

Fast-Forwarding Determination Mode Signal Determination Processing (Case of Single Correction Operation)

As illustrated in FIG. 11, in the fast-forwarding determination mode signal determination processing 5110, it is first determined whether or not the fast-forwarding determination timer 171 which starts in S104 of the initial mode signal determination processing S100 times out (S111).

If the fast-forwarding determination timer 171 times out (Yes in S111), the rotation direction of the crown 50 is determined using the first switch 56A and the second switch 56B in a manner similar to S101 and S105 described above (S112). If the rotation direction is the "clockwise direction" (Yes in S112), "forward rotation direction-single correction command" is set (S113). If the rotation direction is the "counterclockwise direction" (No in S112), "rearward rotation direction-single correction command" is set (S114).

Then, the signal determination mode is returned to the "initial mode" (S115), the determination mode signal determination processing 5110 is completed, and the processing step returns to the processing in FIG. 9. Then, since the crown rotary operation determination processing S90 in FIG. 9 is also completed, the processing step returns to S85 in FIG. 8.

Determination Processing of Correction Command (Case of Single Correction Operation)

In FIG. 8, the control device 150 determines whether the single correction command or the continuous correction command is given (S85). Here, the fast-forwarding determination mode signal determination processing 5110 sets "forward rotation direction-single correction command" or "rearward rotation direction-single correction command". Accordingly, it is determined as Yes in S85.

Subsequently, the forward rotation or the rearward rotation is determined (S86). In a case of the forward rotation (Yes in S86), a single correction signal for the forward rotation is output to the motor which drives the display device 20 such as the indicating hand of the correction target, and the indicating hand is moved to the subsequent display position (S87). In addition, in a case of the rearward rotation (No in S86), a single correction signal for the rearward rotation is output to the motor which drives the display device 20 such as the indicating hand of the correction target, and the indicating hand is moved to the preceding display position (S88). At this time, the correction quantity of the single correction signal is the single correction quantity. Accordingly, the correction is performed so as to move the display device 20 such as the indicating hand to the subsequent scale.

Thereafter, the continuous correction counter 172 is set to "−1" (S89). Since the continuous correction counter 172 is used in controlling for the continuous correction operation, the continuous correction counter 172 does not directly relate to the single correction operation. Thereafter, the processing from S84 is repeatedly performed.

Fast-Forwarding Determination Mode Signal Determination Processing (Case of Continuous Correction Operation)

Referring back to FIG. 11, when the fast-forwarding determination timer 171 does not time out, the control device 150 determines whether or not the first switch 56A is turned on (S116).

Case of Clockwise Continuous Correction Operation

If the first switch 56A is turned "ON", it shows that the crown 50 is additionally operated (second detection signal), and the rotation direction of the operation is determined as the "clockwise direction".

Here, the control device 150 examines the rotation direction of the first detection signal (S102 or S106), and determines whether the rotation direction of the first detection signal is the "clockwise direction" (S117).

When the rotation direction of the first detection signal is not the "clockwise direction" (No in S117), it means that the current rotation direction of the crown 50 becomes different from the preceding rotation direction of the crown 50. Accordingly, the preceding rotation direction of the crown 50 is cancelled, and the current rotation operation is performed so as to bring the first detection signal into a turned-on state. In this state, the step returns to S102 of the initial mode signal determination processing S100 (refer to FIG. 10) so as to perform the fast-forwarding determination mode signal determination processing 5110 again.

When the rotation direction of the first detection signal is the "clockwise direction", it means that the clockwise rotary operation of the crown 50 is continuously input twice. Accordingly, the control device 150 sets "forward rotation direction-continuous correction command" (S118), and stops the fast-forwarding determination timer 171 (S119). Then, the control device 150 sets the continuous correction quantity corresponding to the current correction target in the continuous correction counter 172 (S11A).

Specifically, the display correction unit 155 selects the current correction target from the display correction mode 169A of the display correction data storage unit 169 (refer to FIG. 7) stored in the storage unit 160, reads out the continuous correction quantity 169C corresponding to the mode, and sets the continuous correction quantity 169C in the continuous correction counter 172. For example, if the display correction mode 169A is the time zone selection mode, the continuous correction quantity "1" is set in the continuous correction counter 172. In addition, if the display correction mode 169A is the one-fifth second chronograph hand correction mode, the continuous correction quantity "300" is set in the continuous correction counter 172.

Next, the control device 150 sets the signal determination mode to the "fast-forwarding stop determination mode" (S11B), and completes the fast-forwarding determination mode signal determination processing 5110.

Case of Counterclockwise Continuous Correction Operation

On the other hand, when it is determined as No in S116, the control device 150 determines whether or not the second switch 56B is turned on (S11C).

If the second switch 56B is turned "ON", the control device 150 determines that the crown 50 is additionally operated by the user (second detection signal), and that the rotation direction of the operation is the "counterclockwise direction".

Here, the control device 150 examines the rotation direction of the first detection signal (S102 or S106), and determines whether the rotation direction of the first detection signal is the "counterclockwise direction" (S11D).

When the rotation direction of the first detection signal is not the "counterclockwise direction" (No in S11D), it means that the current rotation direction of the crown 50 becomes different from the preceding rotation direction of the crown 50. Accordingly, the preceding rotation direction of the crown 50 is cancelled, and the current rotation operation is performed so as to bring the second detection signal into a turned-on state. In this state, the step returns to S106 of the initial mode signal determination processing S100 (refer to FIG. 10) so as to perform the fast-forwarding determination mode signal determination processing 5110 again.

When the rotation direction of the first detection signal is the "counterclockwise direction", it means that the counterclockwise rotary operation of the crown 50 is continuously input twice. Accordingly, the control device 150 sets "rearward rotation direction-continuous correction command" (S11E), and stops the fast-forwarding determination timer 171 (S119). Then, similarly to a case where the clockwise rotary operation of the crown 50 is continuously input twice, the control device 150 sets the continuous correction quantity corresponding to the current correction target in the continuous correction counter 172 (S11A), sets the signal determination mode to the "fast-forwarding stop determination mode" (S11B), and completes the fast-forwarding determination mode signal determination processing 5110.

Referring back to FIG. 9, if the fast-forwarding determination mode signal determination processing 5110 is completed, the initial mode signal determination processing S100 is also completed. Accordingly, the step returns to S85 in FIG. 8. Therefore, it is determined that the continuous correction operation has been performed in S85 (Yes in S85), and the display target is driven in any direction of the forward and rearward rotation directions in S86 to S88. In S89, "−1" is subtracted from the continuous correction counter 172, and the processing from S84 is repeatedly continued.

Repeated processing from S84 causes every single correction quantity of the display device 20 to be continuously corrected. Then, if the "fast-forwarding stop determination mode" is set in the fast-forwarding determination mode signal determination processing 5110 (refer to FIG. 11), it is determined as No in both S91 and S92 in the crown rotary operation determination processing S90 (refer to FIG. 9) during the continuous correction. Accordingly, the fast-forwarding stop determination mode signal determination processing 5120 (refer to FIG. 12) is performed.

Stop Determination Mode Signal Determination Processing

Figure 12:
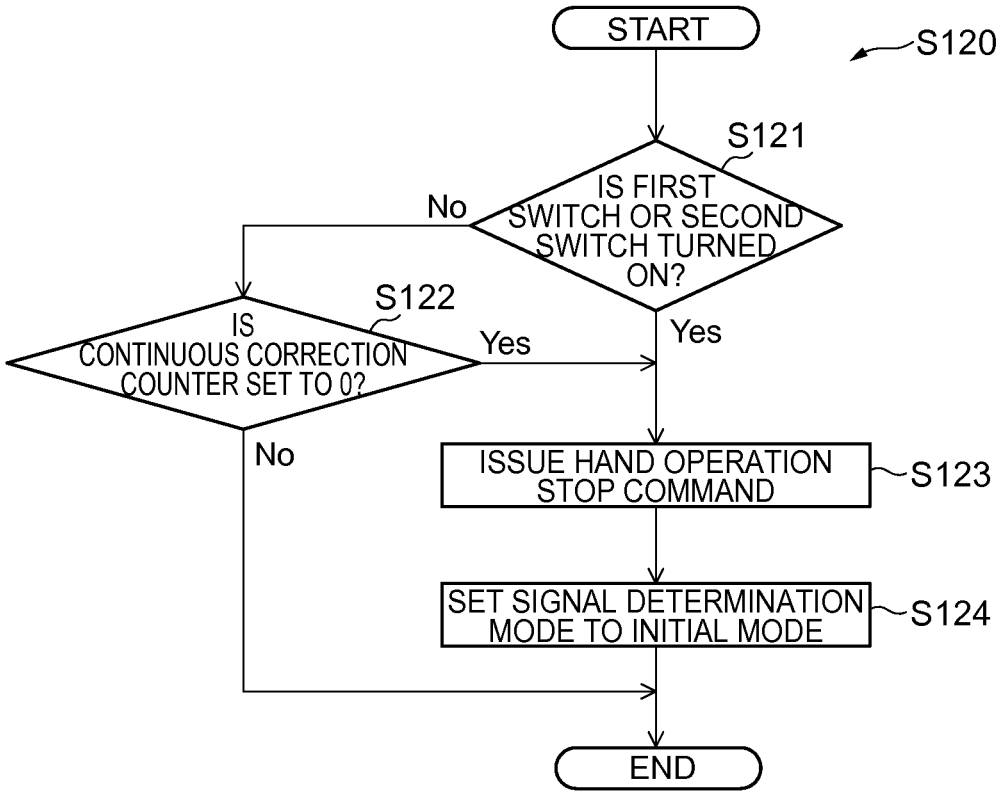
FIG. 12 is a flowchart of the signal determination processing in a fast-forwarding stop determination mode in FIG. 7.

In FIG. 12, the crown rotary operation determination unit 170 first determines whether the first switch 56A or the second switch 56B is turned on, that is, whether or not the rotary operation of the crown 50 is detected (S121). When the rotary operation is not performed (No in S121), it is determined whether or not the continuous correction counter 172 (starting countdown in S11A) shows "0" (S122).

Unless the continuous correction counter 172 shows "0" (No in S122), the control device 150 completes the fast-forwarding stop determination mode signal determination processing 5120, and returns to the processing in FIG. 8. The control device 150 repeatedly perform the processing for driving the correction target (S86 to S88) and the processing for setting "−1" in the continuous correction counter 172 (S89).

Continuous Correction Completion Operation

If the continuous correction counter 172 shows "0" (Yes in S122), the control device 150 issues the hand operation stop command (S123), returns the signal determination mode to the "initial mode", completes the fast-forwarding stop determination mode signal determination processing 5120, and returns to the processing in FIG. 8.

Since the control device 150 returns to the initial mode, the control device 150 does not perform the processing in S86 to S88 and the processing S89 for setting "−1" in the continuous correction counter 172.

In this manner, the continuous correction counter 172 completes the continuous correction operation. A state of the display device 20 is as follows until the continuous correction counter 172 shows "0" in this way, that is, when the correction is performed to a degree set by the continuous correction quantity 169C in FIG. 7.

That is, when the display information (e.g. displayed measurement information) of the correction target is the indicating hand 21 serving as the one-fifth second chronograph hand, the indicating hand 71 serving as the minute chronograph hand, the indicating hand 91 serving as the hour chronograph hand, the indicating hand 81 serving as the second hand, thee indicating hands 22 and 23 serving as the hour-minute hand, and the calendar wheel 16, the continuous correction quantity is set to the total correction quantity. Accordingly, the continuous correction is performed until each returns to the original position after each is rotated by one round.

On the other hand, in a case of the time zone selection mode, the continuous correction quantity of the indicating hand 21 is "1" which is the same as the single correction quantity. Accordingly, even when the continuous correction counter 172 shows "0", the indicating hand 21 moves only one step, that is, only to a position for indicating the subsequent time zone.

Continuous Correction Stop Processing

On the other hand, when the operation of the crown is performed during the continuous correction, it is determined Yes in S121. The control device 150 issues the hand operation stop command (S123), returns the signal determination mode to the "initial mode", completes the fast-forwarding stop determination mode signal determination processing 5120, and returns to the processing in FIG. 8. Since the control device 150 returns to the initial mode, the control device 150 does not perform the processing in S86 to S88 and the processing (S89) for setting "−1" in the continuous correction counter 172.

In this manner, the continuous correction operation using the operation of the crown 50 is stopped.

Specific Example of Display Correction Operation

In the embodiment, the display correction operation performed according to processing procedures in FIGS. 8 to 12 described above is performed in a display correction mode of each item in the display correction mode 169A in FIG. 7 described above. Hereinafter, a specific example thereof will be described with reference to the schematic view of the electronic timepiece 10.

Time Zone Selection Mode

Figure 13A:
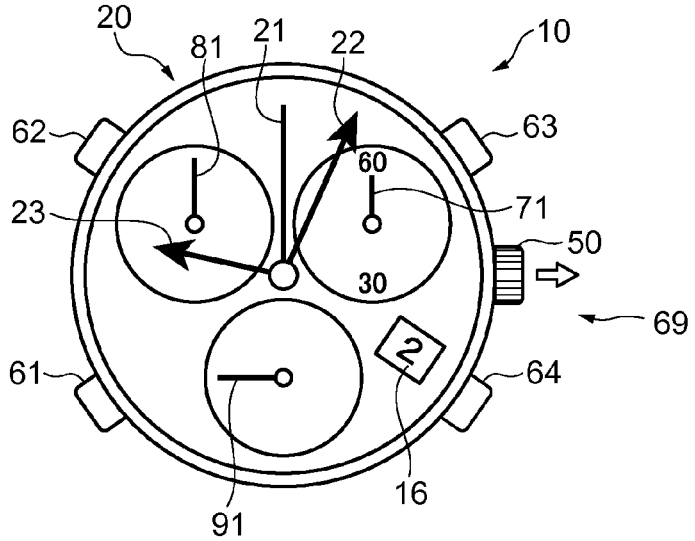
FIG. 13A is a schematic view illustrating an operation in a time zone operation mode according to the first embodiment.

In FIG. 13A, the electronic timepiece 10 according to the embodiment has the indicating hands 21, 22, 23, 71, 81, and 91, and the calendar wheel 16 as the display device 20, and has the crown 50, the A-button 61, the B-button 62, the C-button 63, and the D-button 64, as the input device 69.

The time zone selection is selected by the indicating hand 21 indicating the corresponding portion of the time zone display 46. Accordingly, in the time zone selection mode, the display position of the indicating hand 21 is changed.

First, in a state illustrated in FIG. 13A, the crown 50 is pulled to the first stage. This causes the control device 150 to be in a "time zone selection mode". In the display correction data in FIG. 7, the "time zone selection mode" is selected in the display correction mode 169A so that the single correction quantity 169B is set to "1" and the continuous correction quantity 169C is set to "1".

In this state, if the crown 50 is operated once (clicked once) clockwise (arrow direction in FIG. 13B), the control device 150 performs the correction processing in the single correction mode in the forward rotation direction, based on the flow in FIGS. 8 to 12.

Figure 13B:
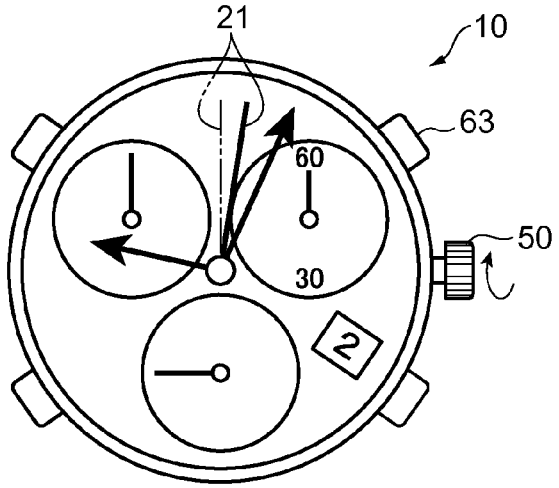
FIG. 13B is a schematic view illustrating an operation in the time zone operation mode according to the first embodiment.

In this manner, the indicating hand 21 is moved in the forward rotation direction by the correction quantity "1" as illustrated in FIG. 13B, and indicates the subsequent time zone in a positive direction.

If the indicating hand 21 performs single correction operation in the forward rotation direction and the time zone is changed, the control device 150 changes the current display time in response to the selected time zone.

Figure 13C:
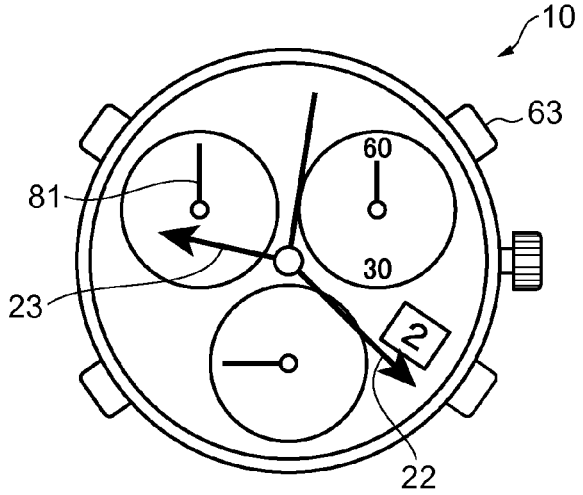
FIG. 13C is a schematic view illustrating an operation in the time zone operation mode according to the first embodiment.

In this manner, as illustrated in FIG. 13C, the indicating hands 22, 23, and 81 indicating the current time are moved to the current time in response to a newly selected time zone.

On the other hand, if the crown 50 is operated clockwise twice or more (clicked twice or more), the control device 150 performs the correction processing in the continuous correction mode in the forward rotation direction, based on the flow in FIGS. 8 to 12.

However, the continuous correction quantity is "1" in the "time zone selection mode", and the continuous correction counter 172 immediately shows "0". Accordingly, the mode does not become the fast-forwarding mode, and becomes the operation which is the same as the single correction operation. In addition, if the continuous correction counter 172 shows "0", the mode returns to the "initial mode". Accordingly, even if the operation is input multiple times until then, the indicating hand 21 is moved by the correction quantity "1".

Figure 14A:
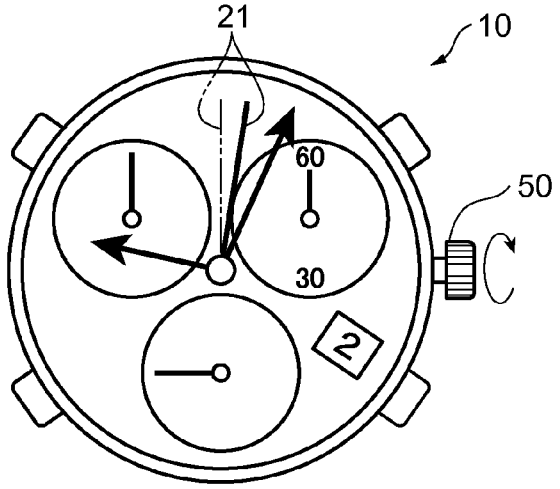
FIG. 14A is a schematic view illustrating continuation of the operation in the time zone operation mode according to the first embodiment.
Figure 14B:
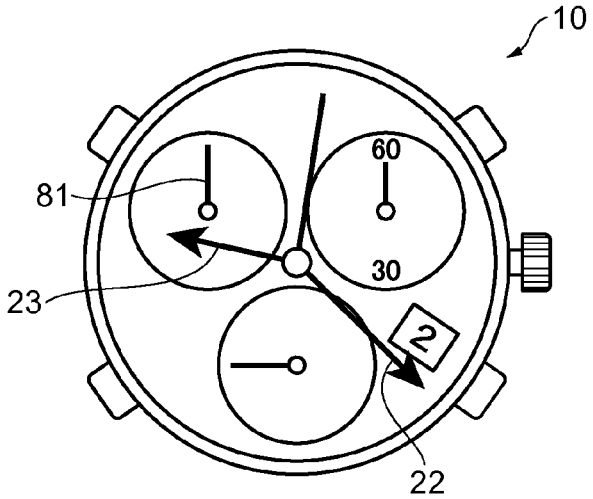
FIG. 14B is a schematic view illustrating continuation of the operation in the time zone operation mode according to the first embodiment.

As a result, as illustrated in FIG. 14A, the indicating hand 21 indicates the subsequent time zone in the positive direction. As illustrated in FIG. 14B, the indicating hands 81, 22, and 23 displaying the current time are moved to the current time in response to the newly selected time zone.

If the initial time zone is selected, the crown 50 is returned to the normal position (zero stage).

Figure 14C:
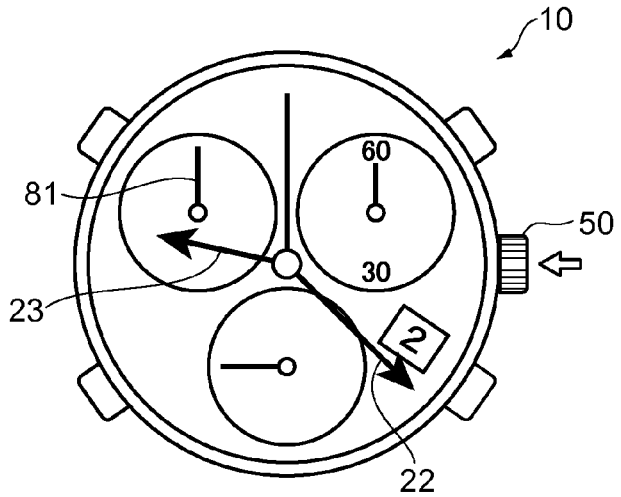
FIG. 14C is a schematic view illustrating continuation of the operation in the time zone operation mode according to the first embodiment.

In this manner, the time zone selection mode is released. As illustrated in FIG. 14C, in a state where the current time is displayed in the newly selected time zone, the normal hand operation of the indicating hands 81, 22, and 23 is started again.

Reference Position Alignment Mode of Chronograph Hand

Figure 15A:
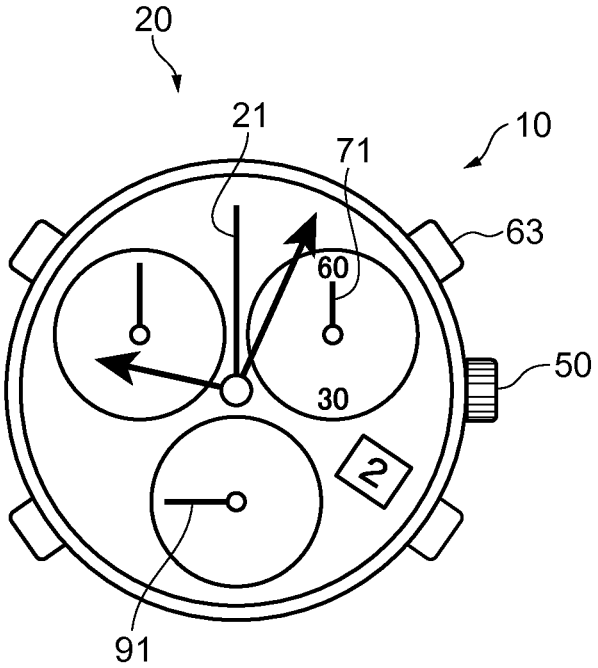
FIG. 15A is a schematic view illustrating an operation in a reference position alignment mode of a chronograph hand according to the first embodiment.

In FIG. 15A, the chronograph function is displayed in such a way that, within the display device 20, the indicating hand 21 serves as the one-fifth second chronograph hand, the indicating hand 71 serves as the chronograph minute hand, and the indicating hand 91 serves as the chronograph hour hand.

Figure 15B:
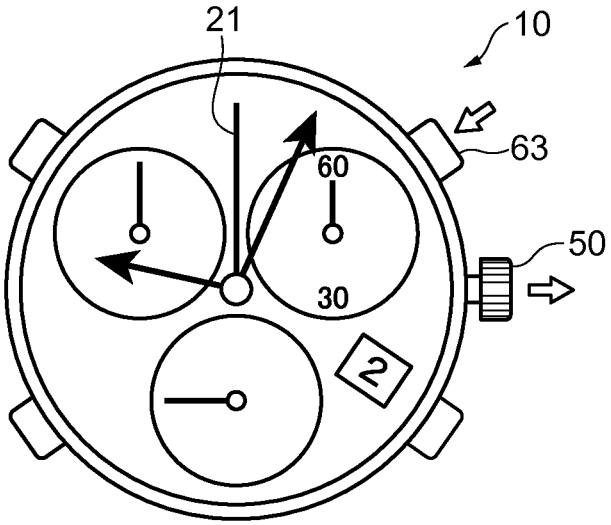
FIG. 15B is a schematic view illustrating an operation in the reference position alignment mode of the chronograph hand according to the first embodiment.

As illustrated in FIG. 15B, the crown 50 is first pulled to the second stage, and further the C-button 63 is continuously pressed for three seconds or more. This causes the control device 150 to be in a "one-fifth second chronograph hand mode". In the examples of FIGS. 16A through 18C, it is assumed that a user wants to calibrate (e.g. manually "zero") his chronograph function (i.e. wants to manually move the chronograph indicating hands to their predetermined reference position, i.e. their starting, or "zero", position).

In the display correction data in FIG. 7, the "one-fifth second chronograph hand mode" is selected in the display correction mode 169A so that the single correction quantity 169B is set to "1" and the continuous correction quantity 169C is set to "300".

Figure 16A:
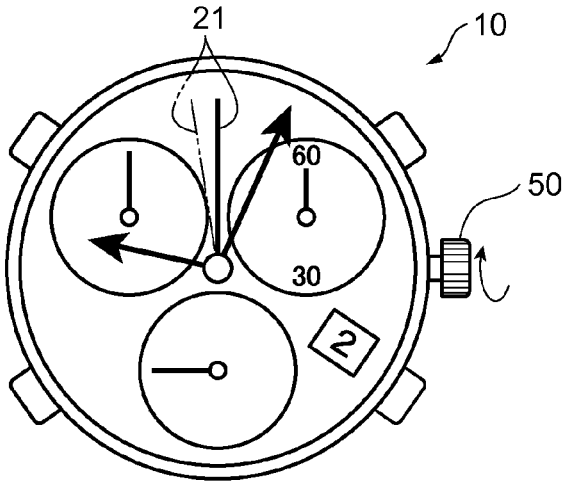
FIG. 16A is a schematic view illustrating continuation of the operation in the reference position alignment mode of the chronograph hand according to the first embodiment.

In this state, if the crown 50 is operated once (clicked once) clockwise as illustrated in FIG. 16A, the control device 150 performs the correction processing in the single correction mode in the forward rotation direction, based on the flow in FIGS. 8 to 12. In this manner, the indicating hand 21 is moved in the forward rotation direction by the correction quantity "1". Specifically, the indicating hand 21 is moved by the scale of one-fifth seconds.

Figure 16B:
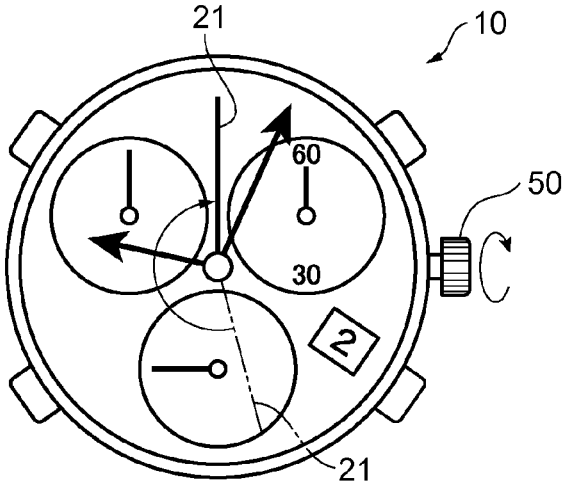
FIG. 16B is a schematic view illustrating continuation of the operation in the reference position alignment mode of the chronograph hand according to the first embodiment.

On the other hand, as illustrated in FIG. 16B, when the indicating hand 21 is greatly deviated from the reference position, if the crown 50 is operated twice or more (clicked twice or more) clockwise, the control device 150 performs the correction processing in the continuous correction mode in the forward rotation direction, based on the flow in FIGS. 8 to 12. In this case, the indicating hand 21 is fast-forwarded in the forward rotation direction, and is moved until the total correction quantity becomes a maximum of "300", that is, until the indicating hand 21 is rotated by one revolution. If the crown 50 performs the rotary operation while the indicating hand 21 is moving (i.e. before the total correction quantity reaches the maximum of "300" scale-unit movements), the fast-forwarding of the indicating hand 21 is stopped. The single correction operations can then be performed from the stopped position, thereby enabling the indicating hand 21 to be moved more precisely to the user's intended correction position (e.g. the predetermined reference position, or zero second position in the present example).

Figure 16C:
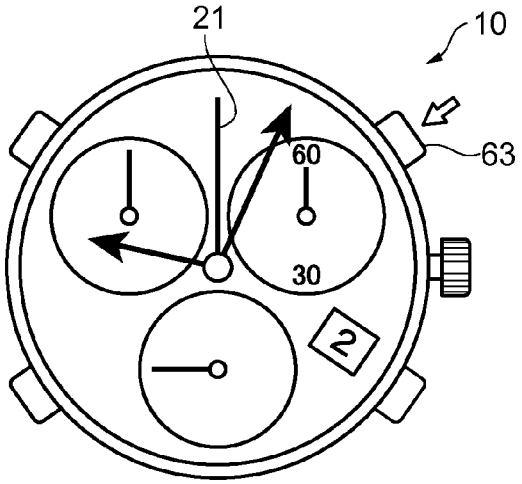
FIG. 16C is a schematic view illustrating continuation of the operation in the reference position alignment mode of the chronograph hand according to the first embodiment.

If the indicating hand 21 is moved to the reference position, the C-button 63 is pressed as illustrated in FIG. 16C. This causes the control device 150 to be shifted to a "minute chronograph hand correction mode".

In the display correction data in FIG. 7, the "minute chronograph hand mode" is selected in the display correction mode 169A so that the single correction quantity 169B is set to "1" and the continuous correction quantity 169C is set to "60".

Figure 17A:
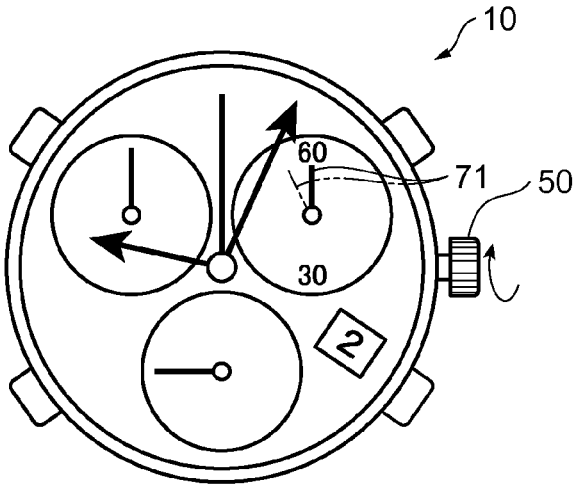
FIG. 17A is a schematic view illustrating continuation of the operation in the reference position alignment mode of the chronograph hand according to the first embodiment.

In this state, if the crown 50 is operated once (clicked once) clockwise as illustrated in FIG. 17A, the control device 150 performs the correction processing in the single correction mode in the forward rotation direction, based on the flow in FIGS. 8 to 12. In this manner, the indicating hand 81 is moved in the forward rotation direction by the correction quantity "1" (i.e. one correction step, e.g. one scale-step on the minute scale of the relevant display). Specifically, the indicating hand 81 is moved by a scale increment of one minute.

Figure 17B:
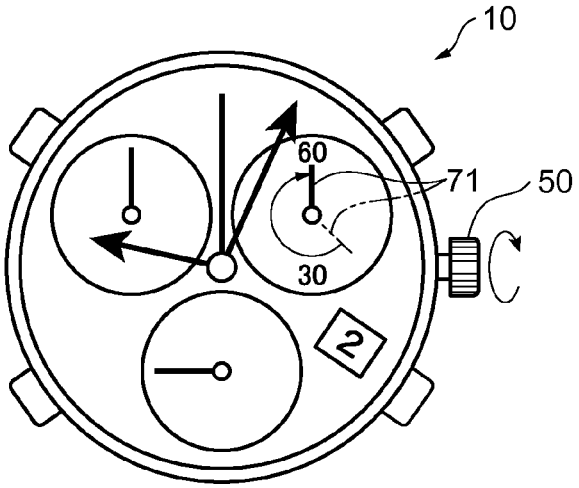
FIG. 17B is a schematic view illustrating continuation of the operation in the reference position alignment mode of the chronograph hand according to the first embodiment.

On the other hand, as illustrated in FIG. 17B, when the indicating hand 71 is greatly deviated from the reference position, if the crown 50 is operated twice or more (clicked twice or more) clockwise, the control device 150 performs the correction processing in the continuous correction mode in the forward rotation direction, based on the flow in FIGS. 8 to 12. In this case, the indicating hand 71 is fast-forwarded in the forward rotation direction, and is moved until the total correction quantity reaches a maximum value of "60" minute increments, that is, until the indicating hand 71 is rotated by one revolution. If the crown 50 performs the rotary operation while the indicating hand 71 is still moving (i.e. before a revolution is completed), the fast-forwarding of the indicating hand 71 is stopped. The user can then perform the single correction operation from the stopped position, thereby enabling the indicating hand 71 to be moved more precisely/carefully to the predetermined reference position (zero minute position), e.g. user's intended correction position in the present example.

Figure 17C:
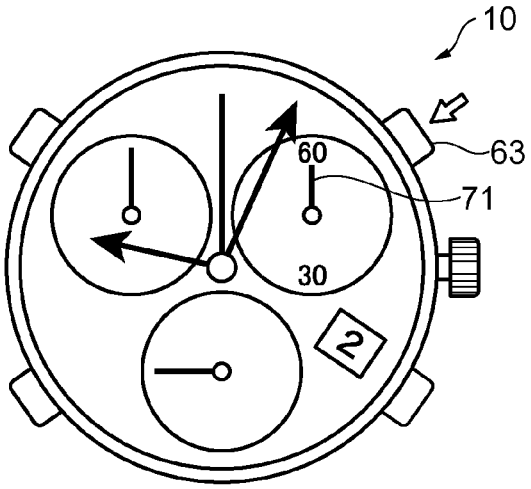
FIG. 17C is a schematic view illustrating continuation of the operation in the reference position alignment mode of the chronograph hand according to the first embodiment.

If the indicating hand 81 is moved to the reference position, the C-button 63 is pressed as illustrated in FIG. 17C. This causes the control device 150 to be shifted to an "hour chronograph hand correction mode".

In the display correction data in FIG. 7, the "hour chronograph hand mode" is selected in the display correction mode 169A so that the single correction quantity 169B is set to "1" and the continuous correction quantity 169C is set to "60".

Figure 18A:
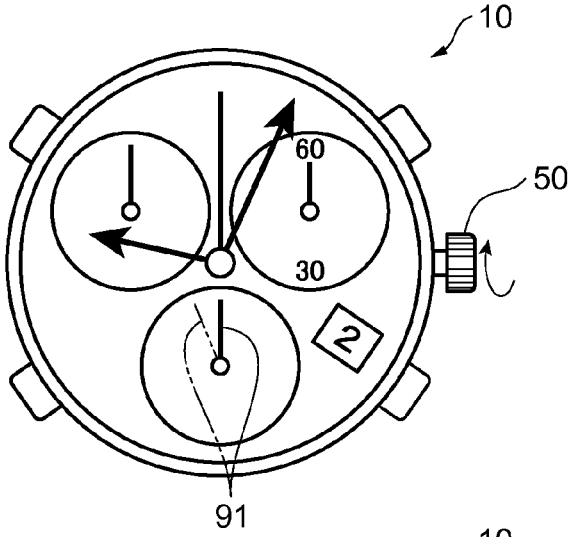
FIG. 18A is a schematic view illustrating continuation of the operation in the reference position alignment mode of the chronograph hand according to the first embodiment.

In this state, if the crown 50 is operated once (clicked once) clockwise as illustrated in FIG. 18A, the control device 150 performs the correction processing in the single correction mode in the forward rotation direction, based on the flow in FIGS. 8 to 12. In this manner, the indicating hand 91 is moved in the forward rotation direction by the correction quantity "1". Specifically, the indicating hand 91 is moved by the scale of 0.2 hours.

Figure 18B:
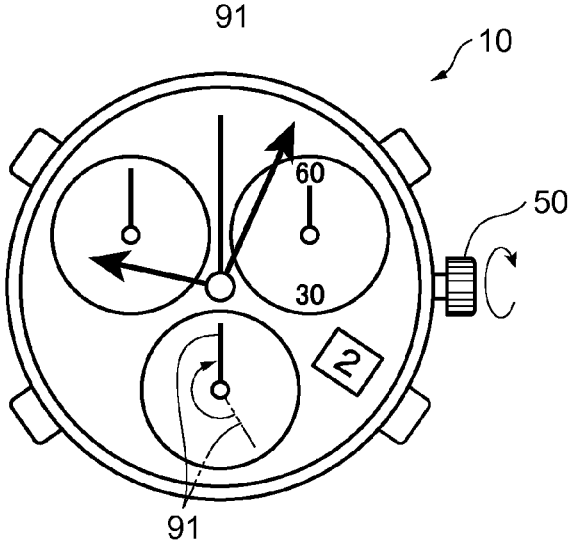
FIG. 18B is a schematic view illustrating continuation of the operation in the reference position alignment mode of the chronograph hand according to the first embodiment.

On the other hand, as illustrated in FIG. 18B, when the indicating hand 91 is greatly deviated from the reference position, if the crown 50 is operated twice or more (clicked twice or more) clockwise, the control device 150 performs the correction processing in the continuous correction mode in the forward rotation direction, based on the flow in FIGS. 8 to 12. In this case, the indicating hand 91 is fast-forwarded in the forward rotation direction, and is moved until the total correction quantity becomes "60", that is, until the indicating hand 91 is rotated by one revolution. If the crown 50 performs the rotary operation while the indicating hand 91 is being moved, the fast-forwarding of the indicating hand 91 is stopped. The user can then perform the single correction operation from the stopped position to move the indicating hand 91 more precisely to the predetermined reference position (zero hour position in the present example).

Figure 18C:
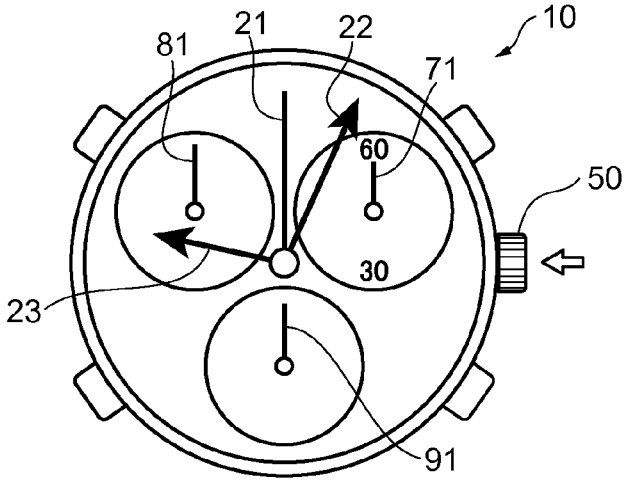
FIG. 18C is a schematic view illustrating continuation of the operation in the reference position alignment mode of the chronograph hand according to the first embodiment.

As described above, if the indicating hands 21, 71, and 91 are respectively corrected to the reference position, the crown 50 is returned to the normal position (zero stage) as illustrated in FIG. 18C.

In this manner, the reference position alignment mode of the chronograph hand is released, and the normal hand operation of the indicating hands 22, 23, and 81 indicating the current time is started again.

Date Correction Mode

Figure 19A:
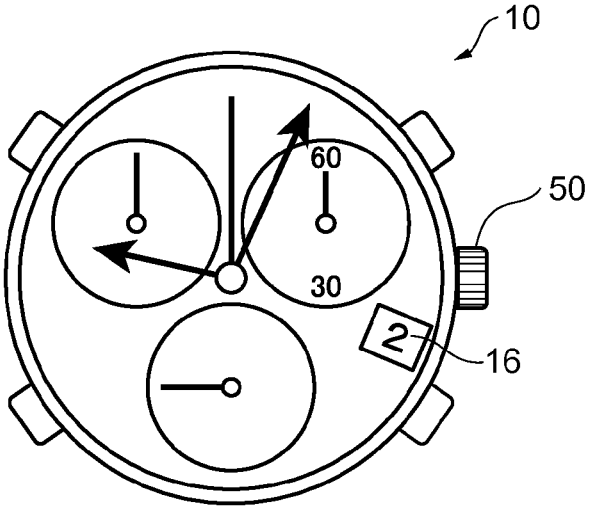
FIG. 19A is a schematic view illustrating an operation in a date correction mode according to the first embodiment.

In FIG. 19A, the measured date display function of the electronic timepiece 10 is displayed by the calendar wheel 16 within the display device 20.

Figure 19B:
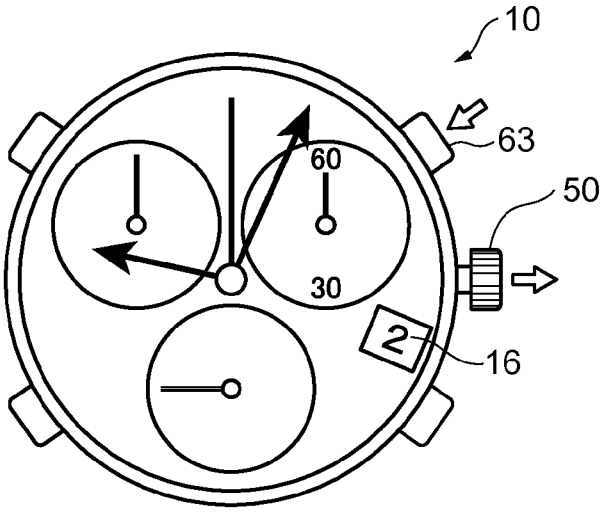
FIG. 19B is a schematic view illustrating an operation in the date correction mode according to the first embodiment.

As illustrated in FIG. 19B, the crown 50 is first pulled to the first stage, and further the C-button 63 is continuously pressed for three seconds or more. If the selection operation of the date correction mode is performed in this manner, the control device 150 is in the "date correction mode".

In the display correction data in FIG. 7, the "date correction mode" is selected in the display correction mode 169A so that the single correction quantity 169B is set to "1" and the continuous correction quantity 169C is set to "31".

Figure 20A:
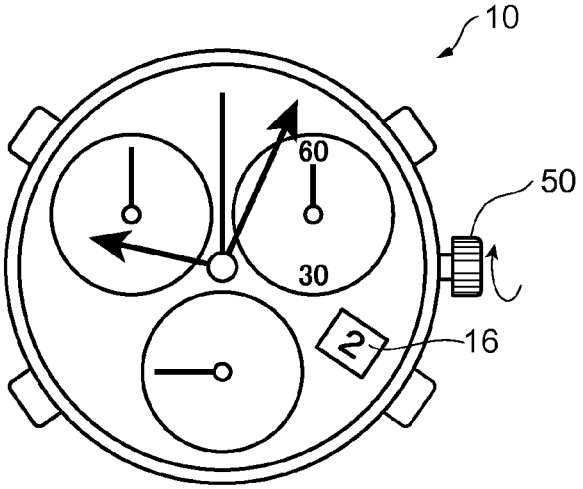
FIG. 20A is a schematic view illustrating an operation in the date correction mode according to the first embodiment.

In this state, if the crown 50 is operated once (clicked once) clockwise as illustrated in FIG. 20A, the control device 150 performs the correction processing in the single correction mode (i.e. a one-day increment) in the forward rotation direction, based on the flow in FIGS. 8 to 12. In this manner, the calendar wheel 16 is moved in the forward rotation direction by the correction quantity "1". Specifically, the calendar wheel 16 is moved by a scale increment of one day.

Figure 20B:
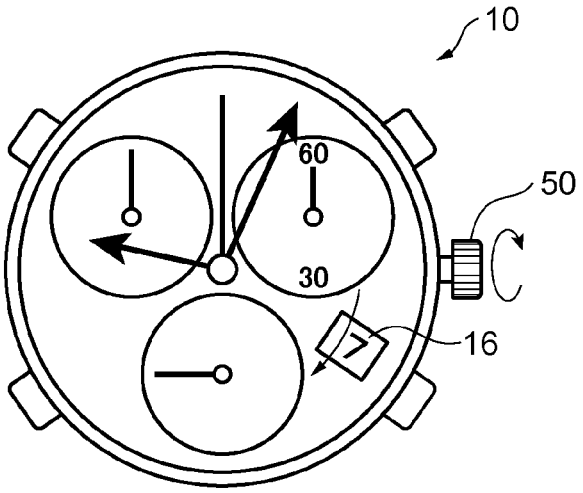
FIG. 20B is a schematic view illustrating an operation in the date correction mode according to the first embodiment.

On the other hand, as illustrated in FIG. 20B, if the crown 50 is operated twice or more (clicked twice or more) clockwise, the control device 150 performs the correction processing in the continuous correction mode in the forward rotation direction, based on the flow in FIGS. 8 to 12. In this case, the calendar wheel 16 is fast-forwarded in the forward rotation direction, and is moved until the total correction quantity reaches "31", that is, until the calendar wheel 16 is rotated by one revolution, and then stops. If the crown 50 performs the rotary operation while the calendar wheel 16 is moving, the fast-forwarding of the calendar wheel 16 is stopped. The user can then perform the single correction operation from the stopped position, thereby enabling the calendar wheel 16 to be moved to the user's intended display position (e.g. a predetermined reference position or other correction position).

Figure 20C:
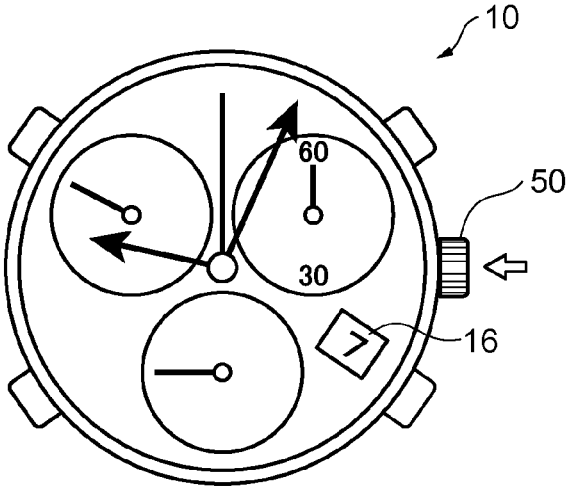
FIG. 20C is a schematic view illustrating an operation in the date correction mode according to the first embodiment.

As described above, if the calendar wheel 16 is corrected to the intended display position, the crown 50 is returned to the normal position (zero stage) as illustrated in FIG. 20C.

In this manner, the date correction mode is released, and the normal hand operation of the indicating hands 22, 23, and 81 indicating the current time is started again.

In any case of the single correction operation and the continuous correction operation according to the embodiment, the forward rotation direction has been described as an example. However, in the embodiment, the single correction operation and the continuous correction operation can also be similarly performed in the rearward rotation direction. In this case, the rotation direction of the correction operation depends on the rotation direction of the crown 50.

Description has been omitted with regard to the correction mode of the indicating hands 22 and 23 serving as the minute hand and the hour hand and the indicating hand 81 serving as the second hand. However, the description is schematically as follows. If the crown 50 is pulled to the second stage position, the indicating hands are in a standby state for the correction. Here, if the C-button 63 is continuously pressed for three seconds or more, the mode is shifted to the indicating hand correction mode of the above-described chronograph function. On the other hand, if the A-button 61 is pressed in the standby state, the mode becomes the indicating hand correction mode of the current time, the indicating hand 81 serving as the second hand is operated in the forward rotation direction, and stops at the zero second position. Then, the indicating hands 22 and 23 serving as the hour-minute hand are operated in the forward rotation, and stop at the position for indicating the subsequent minute. In this state, the crown 50 is operated, thereby enabling the indicating hands 22 and 23 to be corrected to the current time. Thereafter, the crown 50 is pressed and returned to the zero stage position so as to meet exact timing obtained from time signal announcement, thereby causing the respective indicating hands to return to the normal hand operation.

Advantageous Effect of First Embodiment

According to this embodiment, the display information (e.g. displayed measurement information) in the display device 20 can be corrected by the rotary operation of the crown 50 serving as the operation member. In this case, the operation of the crown 50 can select the single correction mode or the continuous correction mode. Therefore, if the single correction mode is selected, the display device 20 can be moved by each single correction quantity which is the minimum correction unit for each display information (e.g. displayed measurement information) in the display device 20. Accordingly, delicate setting can be performed. In addition, for example, if the continuous correction quantity is set to the total correction quantity by using the continuous correction mode, the fast-forwarding correction of the display device 20 can be performed, and the correction operation can be performed quickly.

In the embodiment, the control device 150 refers to the display correction data, thereby enabling the continuous correction quantity 169C to be set corresponding to the display correction mode 169A. In this manner, the correction quantity is variable depending on the types of display information (e.g. displayed measurement information). Therefore, more delicate correction can be performed in accordance with the total correction quantity.

In particular, as in the time zone selection mode, if the continuous correction quantity 169C is set to a total sum of correction quantity, when the continuous correction operation is performed by mistake, there is high possibility that the indicating hand 21 may be moved to an unintended position. In this case, the continuous correction quantity 169C can be set to be the same as the single correction quantity 169B.

As described above, the continuous correction quantity 169C can be set depending on the types of display information (e.g. displayed measurement information). Accordingly, it is possible to provide the electronic timepiece 10 in which a user is likely to correct the display device 20 at the user's intended position.

Furthermore, in the embodiment, to select the single correction mode or the continuous correction mode can be determined by determining whether or not the rotary operation of the crown 50 is performed multiple times within a predetermined time period. Therefore, when performing the display correction, a user can easily select any mode by simply adjusting the operation of the crown 50.

In the embodiment, the continuous correction quantity 169C except for the time zone selection mode is set to the total correction quantity for each display information (e.g. displayed measurement information) in the display device 20. Therefore, even when the continuous correction operation is performed by mistake, the operation to intermediately stop the continuous correction operation is not performed. Accordingly, the corresponding display device 20 returns to the original position after being rotated by one round. For example, in a case of the indicating hand 21, the indicating hand 21 is rotated by one round on the dial 11, and stop at the position which is the same as that prior to the operation.

Therefore, even when the continuous correction operation is performed by mistake, there is no possibility that the indicating hand 21 may be greatly deviated from the user's intended correction position. Therefore, the correction operation is continuously performed in the single correction mode, thereby enabling the user to easily correct the indicating hand 21 at the user's intended correction position.

Furthermore, in the embodiment, with regard to the display of the time zone whose value is configured not to be rotated by one round at regular intervals as the display information (e.g. displayed measurement information), the continuous correction quantity 169C is set to the correction quantity which is the same as the single correction quantity 169B. Accordingly, even when the continuous correction operation is performed by mistake, the continuous correction operation is limited to the movement of the single correction quantity. Therefore, it is possible to prevent the display unit from passing over the user's intended correction position, and thus, it is possible to improve correction operability.

Second Embodiment

FIGS. 21 to 24 illustrate a second embodiment of the invention.

An electronic timepiece 10A according to the embodiment is different from the electronic timepiece 10 according to the above-described first embodiment in that the chronograph function is not provided and the day display is provided.

However, the basic configuration other than the display device 20, the input device 69, and the control device 150 which relate to the above-described different points is the same as that in the electronic timepiece 10 according to the above-described first embodiment. The same reference numerals are given to the same configuration elements, and repeated description will be omitted.

Figure 22A:
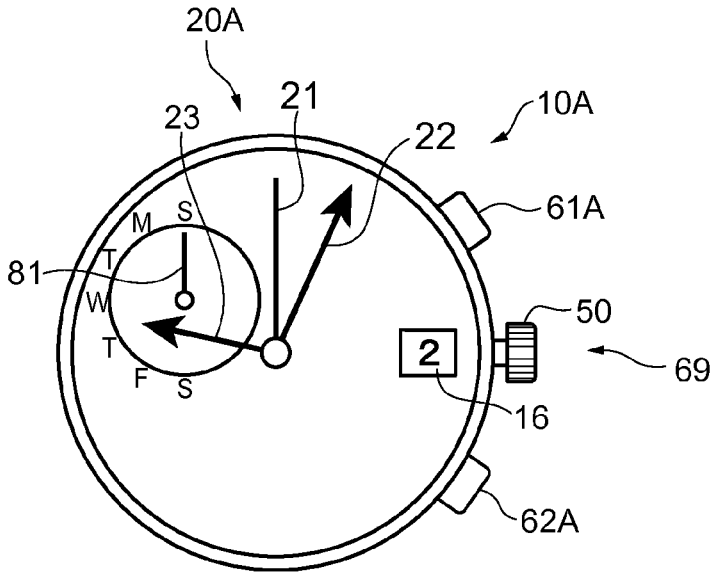
FIG. 22A is a schematic view illustrating an electronic timepiece according to a second embodiment of the invention, and is a view illustrating a normal hand operation state.

In FIG. 22A, the electronic timepiece 10A according to the embodiment has the indicating hands 21, 22, 23, and 81, and the calendar wheel 16, as a display device 20A. The indicating hands 21, 22, and 23 respectively display the second, the minute, and the hour of the current time which are measured display items. The indicating hand 81 displays the measured current day in the embodiment. The calendar wheel 16 displays the measured current date.

In the electronic timepiece 10A, the input device 69 is configured to include the crown 50 serving as the operation unit, an A-button 61A, and a B-button 62A.

FIG. 21 illustrates display correction data according to the embodiment. Similarly to the above-described first embodiment, the display correction data is stored in the display correction data storage unit 169 (refer to FIG. 5).

Among the respective modes set in the display correction mode 169A, the "time zone selection mode", the "current time-second correction mode", the "current time-hour and minute correction mode", and the "date correction mode" are the same as those in the above-described first embodiment. However, the button operation for activating the "date correction mode" is changed to a method of pressing an "AB-button for six seconds or more", and subsequently, the "day correction mode" to which the mode can be shifted by using the A-button is set. In the "day correction mode", the day display using the indicating hand 81 of the display device 20A is corrected.

The display correction of the date and the day is performed by the following procedures.

Figure 22B:
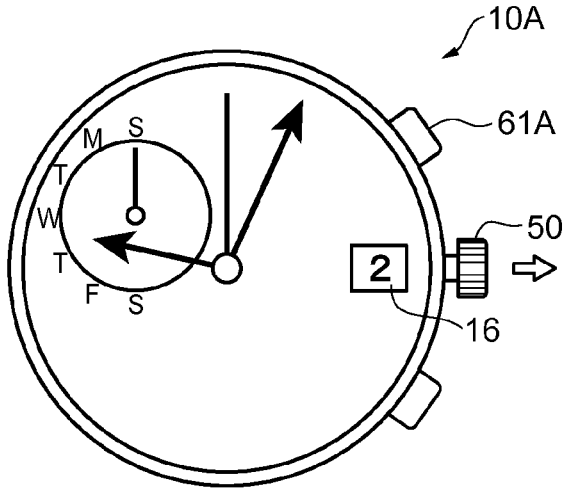
FIG. 22B is a schematic view illustrating the electronic timepiece according to the second embodiment, and is a view illustrating an operation to enter a date correction mode.

In FIG. 22B, the crown 50 is pulled to the first stage, and further both the A-button 61A and the B-button 62A are continuously pressed for six seconds or more. This causes the control device of the electronic timepiece 10A to be in the "date correction mode".

In the display correction data in FIG. 21, the "date correction mode" is selected in the display correction mode 169A so that the single correction quantity 169B is set to "1" and the continuous correction quantity 169C is set to "31".

Figure 23A:
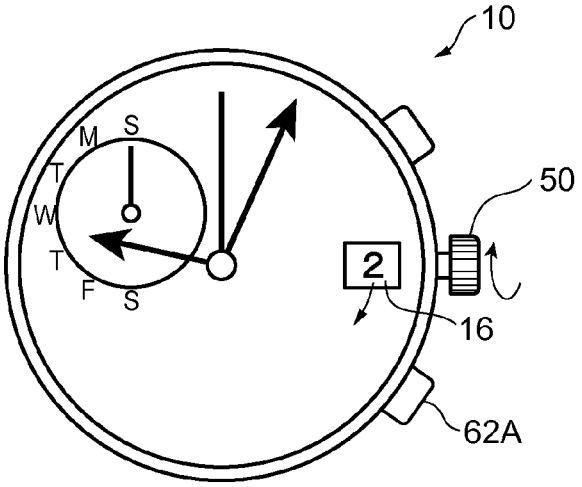
FIG. 23A is a schematic view illustrating an operation in the date correction mode according to the second embodiment.

In this state, if the crown 50 is operated once (clicked once) "clockwise" as illustrated in FIG. 23A, the electronic timepiece 10A performs the correction processing in the single correction mode in the forward rotation direction. In this manner, the calendar wheel 16 is moved in the forward rotation direction by the correction quantity of "1" day.

Figure 23B:
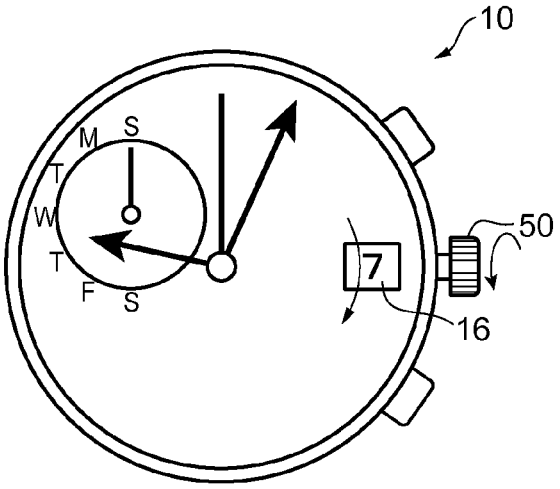
FIG. 23B is a schematic view illustrating an operation in the date correction mode according to the second embodiment.

On the other hand, as illustrated in FIG. 23B, if the crown 50 is operated twice or more (clicked twice or more) "counterclockwise", the electronic timepiece 10A performs the correction processing in the continuous correction mode in the rearward rotation direction. In this case, the calendar wheel 16 is fast-forwarded in the rearward rotation direction, and is moved until the total correction quantity reaches "31", (that is, to a position where the calendar wheel 16 is rotated by one revolution). If the crown 50 performs an operation while the calendar wheel 16 is moving in fast forward, the fast-forwarding of the calendar wheel 16 is stopped. The single correction operation can then be performed from the stopped position, thereby enabling the calendar wheel 16 to move to the intended display position.

When the crown 50 performs the continuous correction operation clockwise, the calendar wheel 16 is fast-forwarded in the forward rotation direction. When the crown 50 performs the single correction operation counterclockwise, the calendar wheel 16 is moved in the rearward rotation direction by the correction quantity "1", and is returned/reversed by one day.

Figure 23C:
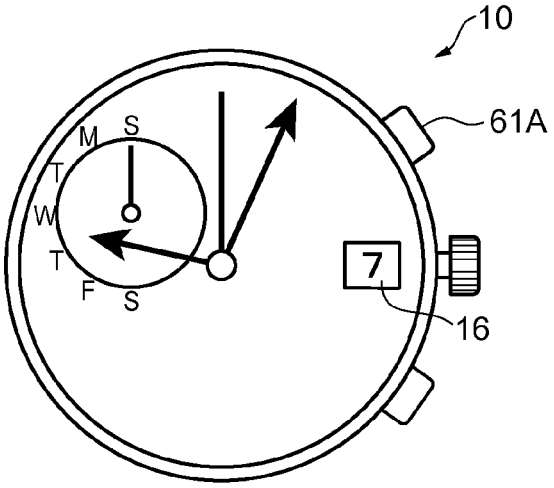
FIG. 23C is a schematic view illustrating an operation in the date correction mode according to the second embodiment.

As described above, if the calendar wheel 16 can be corrected at the intended display position, the A-button 61A is pressed as illustrated in FIG. 23C. This causes the electronic timepiece 10A to be shifted to the "day correction mode".

In the display correction data in FIG. 21, the "day correction mode" is selected in the display correction mode 169A so that the single correction quantity 169B is set to "1" and the continuous correction quantity 169C is set to "1".

Here, the total correction quantity in the "day correction mode" is normally "7". Accordingly, the continuous correction quantity 169C may be set to "7". However, when the total correction quantity is small (for example, smaller than 10), even if the continuous correction operation is performed, the display device is rotated by one round, that is, returns to the original position within a very short time period. Reversely, it is difficult to intermediately perform the stop operation. Consequently, an advantageous effect of the continuous correction operation is less likely to be obtained. Therefore, in the embodiment, the continuous correction quantity 169C in the 'day correction mode" is set to "1" which is the same as the single correction quantity 169B.

Figure 24A:
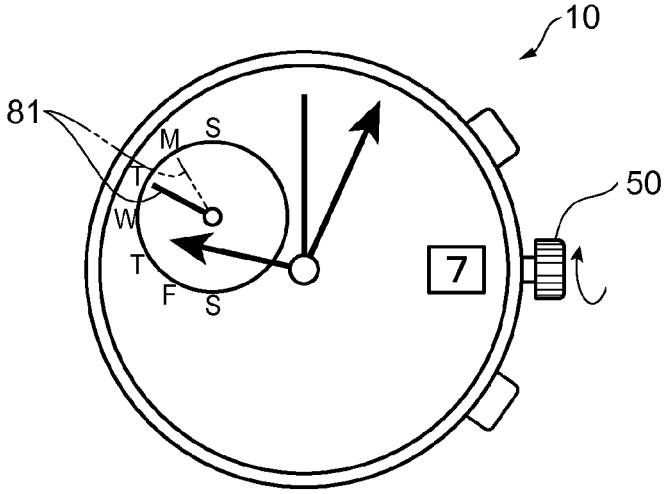
FIG. 24A is a schematic view illustrating an operation in a day correction mode according to the second embodiment.

In this state, if the crown 50 is operated once (clicked once) "clockwise" as illustrated in FIG. 24A, the electronic timepiece 10A performs the correction processing in the single correction mode in the forward rotation direction. In this manner, the indicating hand 81 is moved in the forward rotation direction by the correction quantity "1".

Figure 24B:
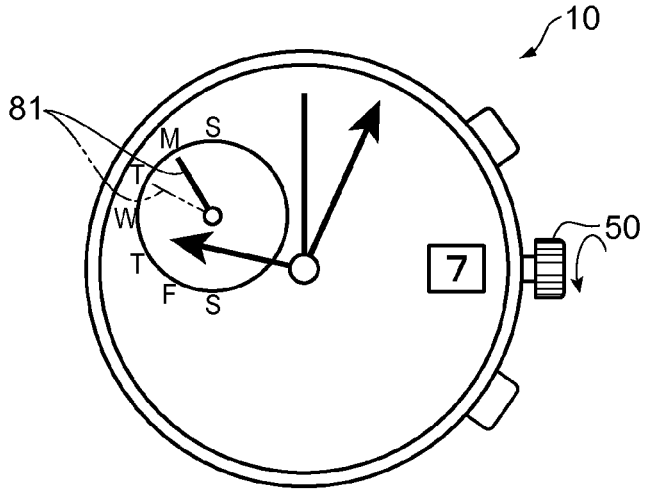
FIG. 24B is a schematic view illustrating an operation in the day correction mode according to the second embodiment.

On the other hand, as illustrated in FIG. 24B, if the crown 50 is operated twice or more (clicked twice or more) "counterclockwise", the electronic timepiece 10A performs the correction processing in the continuous correction mode in the rearward rotation direction. In this manner, the indicating hand 81 is fast-forwarded in the rearward rotation direction. However, since the continuous correction quantity 169C is "1", the indicating hand 81 is moved in the rearward rotation direction by the correction quantity "1". Therefore, the operation is performed similarly to the single correction operation in the rearward rotation direction.

Even when the crown 50 performs the continuous correction operation clockwise, the indicating hand 81 is moved in the forward rotation direction by the correction quantity "1". When the crown 50 performs the single correction operation counterclockwise, the indicating hand 81 is moved in the rearward rotation direction by the correction quantity "1".

Figure 24C:
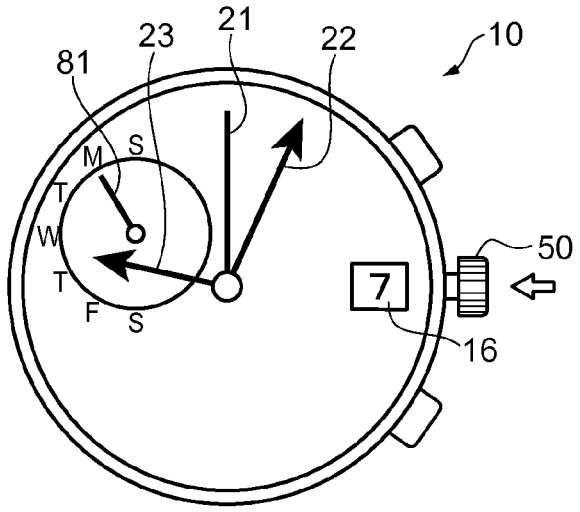
FIG. 24C is a schematic view illustrating an operation in the day correction mode according to the second embodiment.

As described above, if the display position of the calendar wheel 16 and the indicating hand 81 is corrected, the crown 50 is returned to the normal position (zero stage) as illustrated in FIG. 24C.

In this manner, the normal hand operation of the indicating hands 21, 22, and 23 indicating the current time is started again.

According to this embodiment, in the date correction mode, a user can perform the operation by switching the single correction operation and the continuous correction operation. Therefore, it is possible to obtain advantageous effects which are the same as those in the above-described first embodiment.

Furthermore, in the embodiment, the continuous correction quantity 169C in the "day correction mode" is set to "1" which is the same as the single correction quantity 169B. Accordingly, even when the continuous correction operation is performed, it is possible to avoid a disadvantageous case where the display device is rotated by one round, that is, returns to the original position within a very short time period, and where reversely, it becomes difficult to intermediately perform the stop operation.

Another Embodiment

In the respective correction modes (except for the time zone selection mode) according to the above-described first embodiment, the total correction quantity (numeric value of 10 or more) of each display item is set as the continuous correction quantity 169C (refer to FIG. 7), and each display item is configured so as to be rotatable by one round in the forward rotation direction (forward direction) or by one round in the rearward rotation direction (rearward direction). However, in the invention, the embodiment can adopt different setting.

For example, with regard to the display information (e.g. displayed measurement information) which can be corrected only in the forward direction or only in the rearward direction, the continuous correction quantity 169C may be set to be the same as the single correction quantity 169B.

For example, when a thick indicting hand member is used as the indicating hand 23 for performing the time display of the current time in the first embodiment, a limitation may be imposed on specifications of the hour-minute hand motor 142 (limitation on an operating voltage of the timepiece). Consequently, in some cases, the rotation direction of the indicating hands 22 and 23 is to be a one-way direction (forward rotation direction only). When the correction operation of the display information (e.g. displayed measurement information) is performed in this one-way direction, if the continuous correction quantity 169C is large, there is a possibility that the display device may pass over the user's intended correction position.

In contrast, if the continuous correction quantity 169C is set to be the same as the single correction quantity 169B, even when the continuous correction operation is performed by mistake, the correction quantity is the same as that of the single correction operation. Accordingly, there is no possibility that the display device may be greatly deviated from the user's intended correction position. Therefore, an erroneous operation can be recovered easily.

If the display information (e.g. displayed measurement information) is information which can be corrected in the forward rotation direction only, when the crown 50 is rotated in the rearward rotation direction, the display device 20 of the correction target may be moved by invalidating the rotary operation of the crown 50.

In the above-described second embodiment, in the day correction mode, when the total correction quantity "7" of the display information (e.g. displayed measurement information) is equal to or smaller than a preset reference value (for example, smaller than 10), the continuous correction quantity 169C is set to be the same as the single correction quantity 169B.

In contrast, instead of the total correction quantity, in view of the required time during which the display information (e.g. displayed measurement information) is rotated by one round due to the correction, when the required time is equal to or shorter than a preset setting time (shorter than the time for one round), the processing may be performed similarly.

Even in this embodiment, even when the continuous correction operation is performed, it is possible to avoid a disadvantageous case where the display device is rotated by one round, that is, returns to the original position within a very short time period, and where reversely, it becomes difficult to intermediately perform the stop operation.

FIG. 25 illustrates an example of the required time during which the display information (e.g. displayed measurement information) is rotated by one round due to the correction.

In FIG. 25, the number of steps represents the total correction quantity for each correction target.

Here, if the required time during which the indicating hand or the date indicator of each correction target is rotated by one round is examined, the required time is equal to or less than four seconds when items having a mark of "*", that is, the "second hand" (indicating hand 81 in the first embodiment), the "chronograph second hand" (indicating hand 21), the "chronograph minute hand" (indicating hand 71), and the "chronograph hour hand" (indicating hand 91) are rotated in the forward rotation direction. Furthermore, among these, the required time for the indicating hands other than the "chronograph second hand" (indicating hand 21) is equal to or less than two seconds.

Therefore, with regard to the display information (e.g. displayed measurement information) rotated by one round within a short time in this way, it is also difficult to be intermediately stopped during the continuous correction operation. Instead that the continuous correction quantity is set to the total correction quantity as in the first embodiment, the continuous correction quantity may be set to "1" which is the same as the single correction quantity as described in another embodiment in FIG. 25.

However, in a case of the "chronograph second hand", the required time for one round is equal to or more than three seconds, and the number of steps is as many as "300". One-round rotation of the chronograph second hand by using only the single correction operation is operationally large burden. Therefore, the continuous correction quantity of the "second hand", the "chronograph minute hand" and the "chronograph hour hand" may be set to "1" which is the same as the single correction quantity, and the continuous correction quantity of the "chronograph second hand" may be set to "300" similar to that in the first embodiment.

As described above, when the continuous correction quantity is to be set, it is desirable to appropriately set the continuous correction quantity while considering prerequisites (drive frequency or the number of steps) for each display item such as the indicating hand, and taking account of a user's operational feeling.

In addition, the invention is not limited to the above-described respective embodiments, and includes modifications within a scope not departing from the spirit of the invention.

The continuous correction operation is not limited to the above-described embodiments, and may include a specific rotary operation of the crown 50 or an operation in which the button operation is added to the rotary operation of the crown 50. For example, the continuous correction operation may be performed when the crown 50 is rotated in the forward rotation direction, the rearward rotation direction, and the forward rotation direction within a predetermined time period.

The continuous correction quantity is not limited to the total correction quantity of the display information (e.g. displayed measurement information) or the same quantity as the single correction quantity. For example, the continuous correction quantity may be set to half of the total correction quantity.

Furthermore, when the drive mechanism can be corrected in one direction only, the continuous correction quantity may be set to the total correction quantity of the display information (e.g. displayed measurement information) or half of the total correction quantity.

Third Embodiment

Hereinafter, a third embodiment of the invention will be described with reference to the drawings.

In the following description, the same reference numerals are given to configuration elements which are the same as those in the electronic timepiece 10 according to the first embodiment, and description thereof will be simplified or omitted.

Configuration of Timepiece

Figure 26:
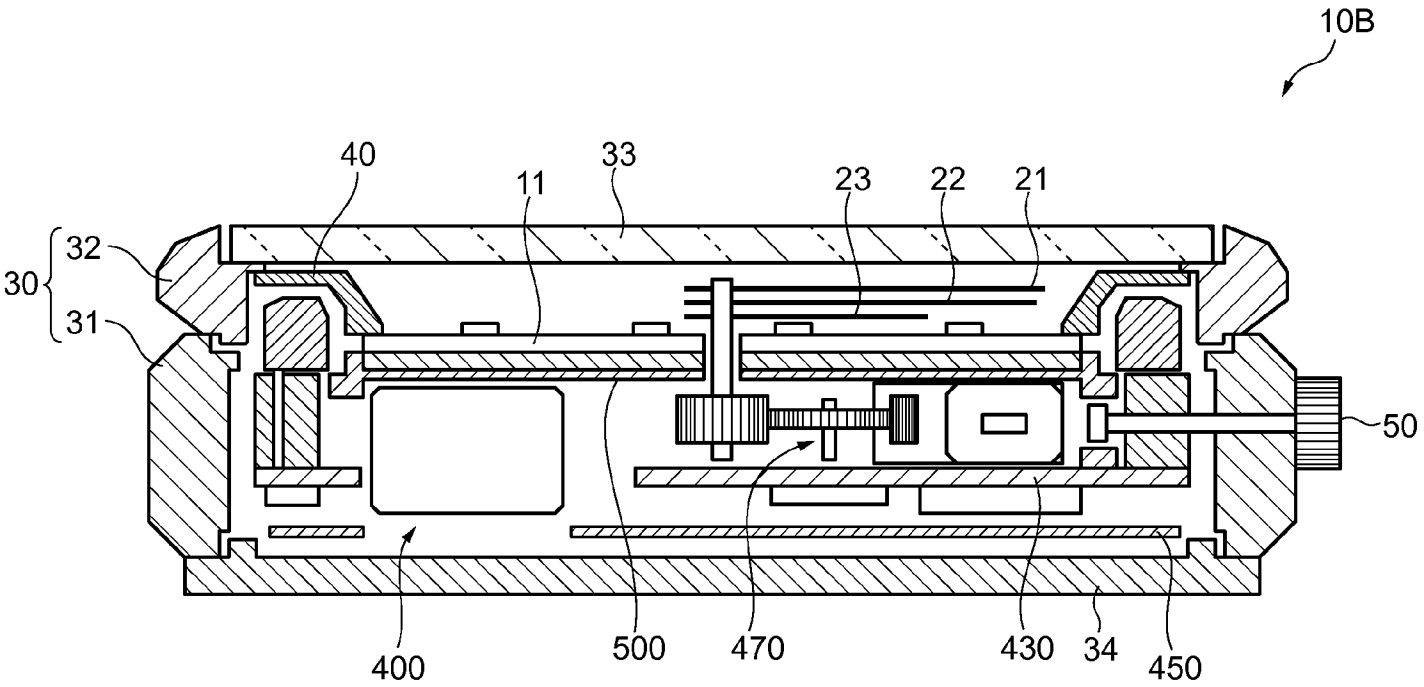
FIG. 26 is a cross-sectional view illustrating an electronic timepiece according to a third embodiment of the invention.

FIG. 26 is a cross-sectional view illustrating a schematic configuration of a timepiece 10B. The front surface of the timepiece 10B is the same as that in the electronic timepiece 10, and description thereof will be omitted.

The timepiece 10B includes a movement 400 accommodated inside the exterior case 30. The respective indicating hands 21 to 23, 71, 81, and 91 (refer to FIG. 1) are attached to the movement 400, and are driven by the movement 400. The respective indicating hands 21 to 23, 71, 81, and 91 are arranged on the front surface side of the dial 11, and the movement 400 is arranged on the rear surface side of the dial 11.

As illustrated in FIG. 26, in addition to the above-described calendar wheel (date indicator) 16, the movement 400 includes a main plate 500, a drive mechanism 470 for driving the respective indicating hands 21 to 23, 71, 81, and 91, and the date indicator 16, a circuit board 430, and a circuit holder 450.

Figure 29:
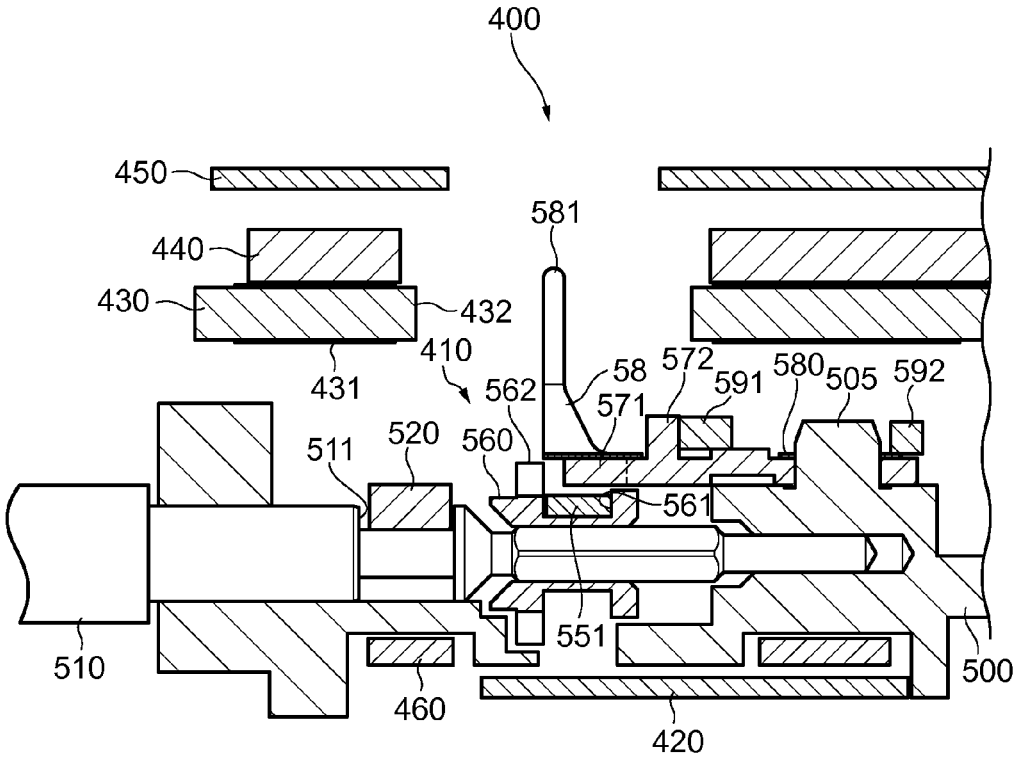
FIG. 29 is a partial cross-sectional view illustrating the movement when the winding stem is located at the zero stage position.

Although not illustrated in FIG. 26, the movement 400 additionally includes a rotary switch mechanism 410, a magnetic shield plate 440 (refer to FIG. 29), and an hour wheel presser 460 refer to FIG. 29).

Rotary Switch Mechanism

Figure 27:
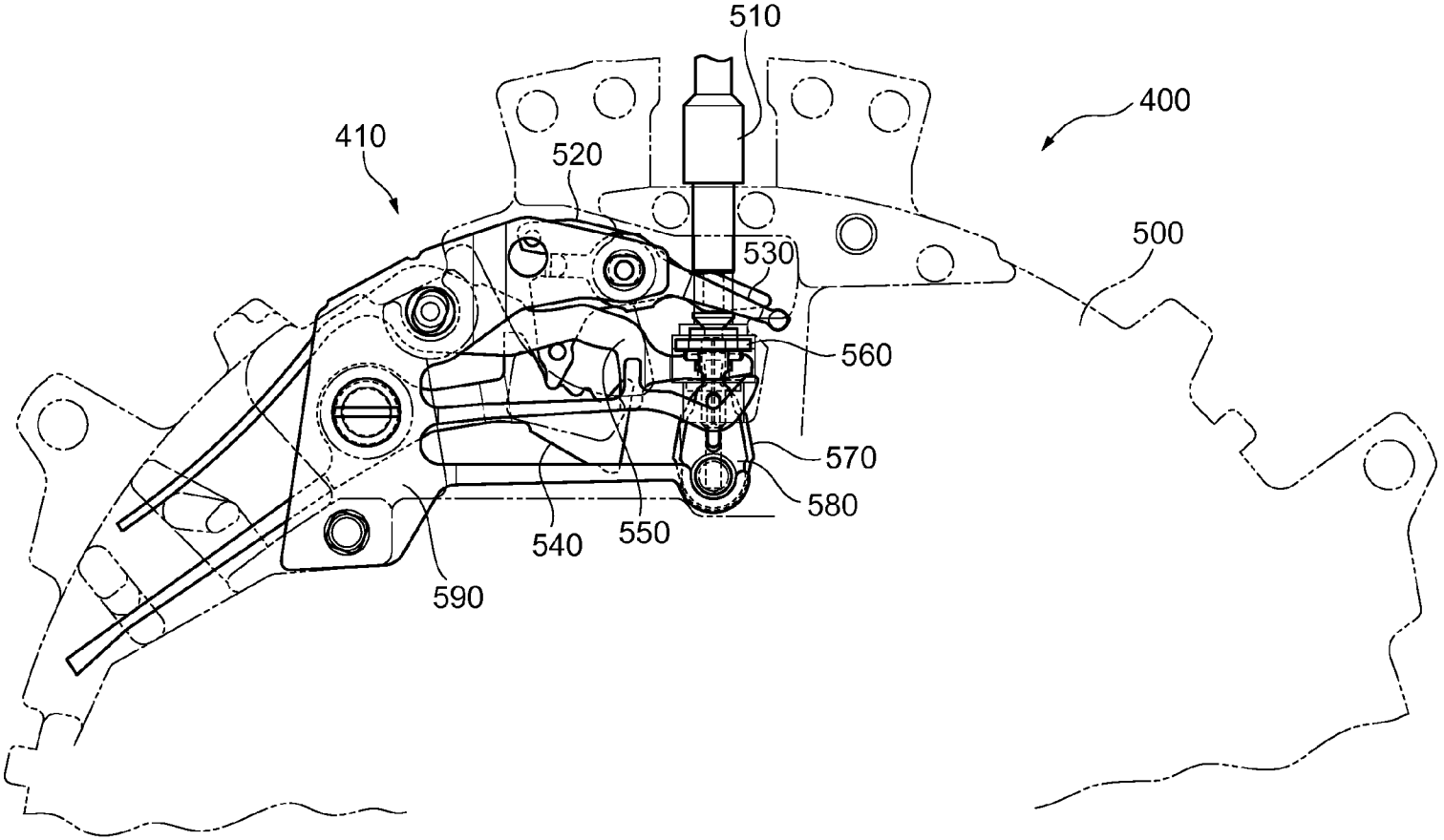
FIG. 27 is a partial plan view illustrating a movement according to the third embodiment.
Figure 28:
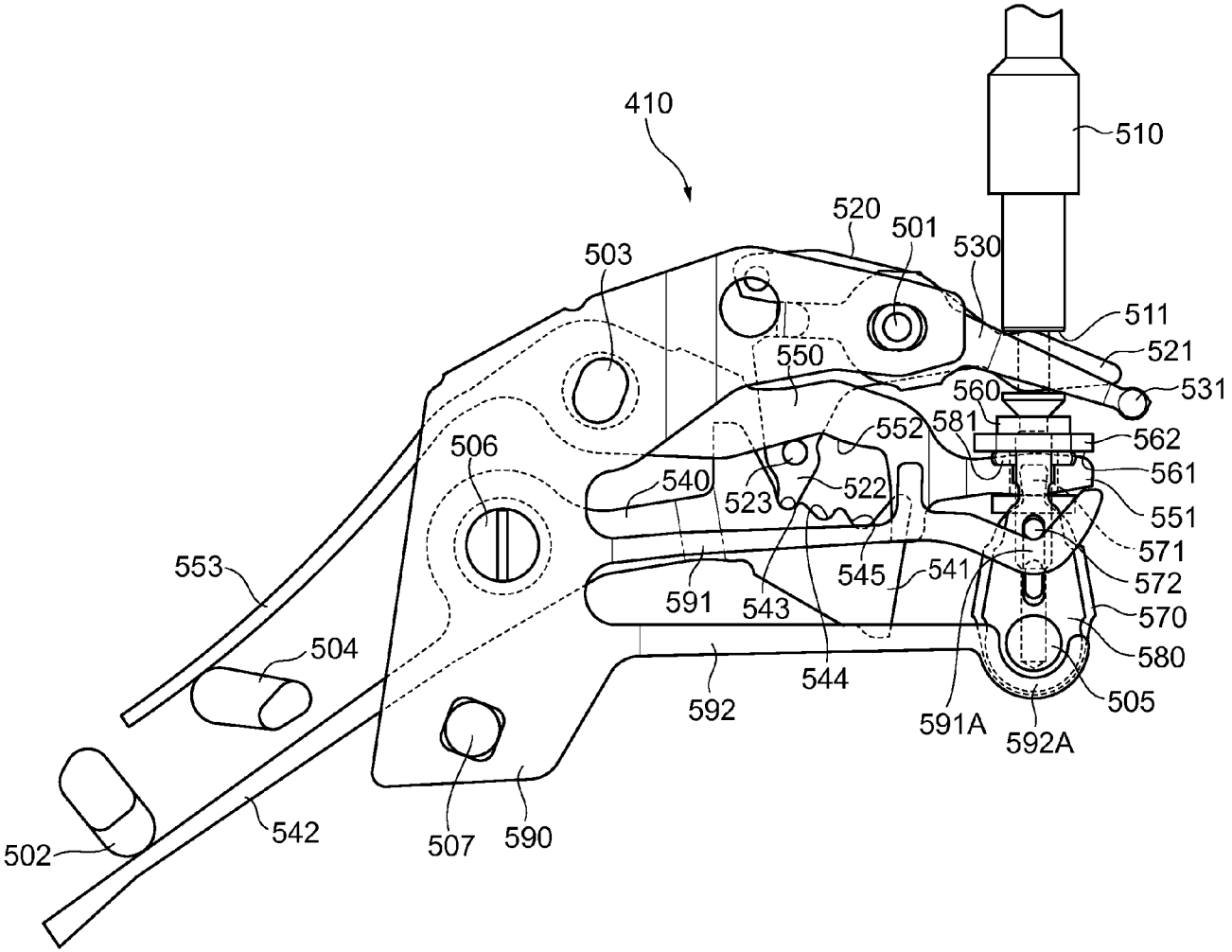
FIG. 28 is a plan view illustrating a rotary switch mechanism when a winding stem is located at a zero stage position according to the third embodiment.

FIG. 27 is a partial plan view when the movement 400 of the timepiece 10B is viewed from the case back 34 side. FIG. 28 is a plan view when the rotary switch mechanism 410 of the movement 400 is viewed from the case back 34 side. FIG. 29 is a partial cross-sectional view when the movement 400 is viewed in a direction orthogonal to the axial direction of a winding stem 510. FIGS. 27 to 29 illustrate a case where the winding stem 510 is located at the zero stage position.

As illustrated in FIG. 27, the movement 400 includes the rotary switch mechanism. 410 including the winding stem. 510 which is supported by the main plate 500 and engages with the crown 50.

As illustrated in FIGS. 27 and 28, the rotary switch mechanism 410 includes the winding stem 510, a setting lever 520, a switch lever 530, a click spring 540, a yoke 550, a switch wheel 560, a switch contact point spring body 570, a switch contact point spring 580, and a setting lever spring 590.

The setting lever 520, the yoke 550, and the setting lever spring 590 are arranged from the main plate 500 side in this order. In addition, the switch lever 530 is arranged between the setting lever 520 and the setting lever spring 590. The click spring 540 is arranged on the same layer as the setting lever 520. The switch contact point spring body 570 and the switch contact point spring 580 are arranged between the main plate 500 and the setting lever spring 590, and are arranged from the main plate 500 side in this order.

The winding stem 510 engages with the crown 50, and is moved in the axial direction by pulling the crown 50. That is, the winding stem 510 is normally located at the zero stage position, and is moved to the first stage position or the second stage position by pulling the crown 50.

As illustrated in FIGS. 28 and 29, an engagement groove 511 for engaging with the setting lever 520 is disposed in the winding stem 510.

As illustrated in FIG. 28, the setting lever 520 is pivotally supported so as to be rotatable around an axle 501. An end portion 521 of the setting lever 520 engages with the engagement groove 511 of the winding stem 510. In this manner, the setting lever 520 is rotated around the axle 501 in conjunction with the winding stem 510.

The other end portion 522 of the setting lever 520 engages with an engagement groove disposed in thee click spring 540.

A protruding portion (dowel) 523 for positioning the yoke 550 is disposed in the setting lever 520.

The switch lever 530 is fixed to the setting lever 520. This causes the switch lever 530 to be rotated around the axle 501 integrally with the setting lever 520.

A distal end portion 531 of the switch lever 530 comes into contact with an electrode layer 431 (refer to FIG. 29) disposed on a rear surface of the circuit board 430 (refer to FIG. 29). The electrode layer 431 includes three electrodes disposed at different positions. When the winding stem 510 is located at the zero stage position, the first stage position, and the second stage position, the distal end portion 531 of the switch lever 530 comes into contact with respective different electrodes so as to be conductive. Therefore, by detecting which electrode is in contact with the distal end portion 531, it is possible to detect the position of the winding stem 510, that is, whether the position of the crown 50 is located at any one of the zero stage position, the first stage position, and the second stage position.

The click spring 540 is pivotally supported by the axle 506. Three engagement grooves 543, 544, and 545 which engage with the end portion 522 of the setting lever 520 are disposed in the click spring 540. When the winding stem 510 is located at the zero stage position, the end portion 522 engages with the engagement groove 543.

A spring portion 542 of the click spring 540 is attached so as to presses against the protruding portion 502 disposed in the main plate 500. This causes the end portion 541 to bias the end portion 522 of the setting lever 520 in a pressing direction.

The click spring 540 causes the end portion 522 of the setting lever 520 to engage with any one of the engagement grooves 543 to 545. In this manner, when the crown 50 is pressed inward and pulled out, the position of the setting lever 520 is regulated, and the position of the winding stem 510, that is, the position of the crown 50 is regulated to the zero stage position, the first stage position, and the second stage position, thereby allowing a user to feel a sense of click.

The yoke 550 is pivotally supported by the axle 503. A spring portion 553 of the yoke 550 is attached so as to press against a projection 504 disposed in the main plate 500. In this manner, the yoke 550 is biased so that the end portion 551 is oriented in a direction of the timepiece center. Here, the yoke 550 is deflected so that the end portion 551 is movable in a direction toward the timepiece center and the end portion 551 is movable in a direction toward the timepiece outer edge. That is, the yoke 550 is disposed to be movable in a first direction where the switch wheel 560 is moved close to the switch contact point spring body 570 and in a second direction where the switch wheel 560 is moved apart from the switch contact point spring body 570.

A side surface portion 552 which comes into contact with the protruding portion 523 disposed in the setting lever 520 is disposed on a side surface on the timepiece center side in the yoke 550. The protruding portion 523 comes into contact with the side surface portion 552, thereby regulating the position of the yoke 550. That is, the position of the yoke 550 is determined by the protruding portion 523. In other words, the protruding portion 523 is arranged at a position which regulates the movement of the yoke 550 in the direction of the timepiece center and permits the movement of the yoke 550 in the direction of the timepiece outer edge. That is, the protruding portion 523 is arranged at a position which regulates the movement of the yoke 550 in the first direction and permits the movement of the yoke 550 in the second direction.

The end portion 551 of the yoke 550 engages with an engagement groove 561 of the switch wheel 560 attached to the winding stem 510.

As illustrated in FIGS. 28 and 29, the switch wheel 560 includes a gear 562 and the engagement groove 561 engaging with the end portion 551 of the yoke 550. A hole passing through the rotation center is disposed in the switch wheel 560, and the winding stem 510 is inserted into the hole.

A cross-sectional shape of the winding stem 510 is rectangular. Accordingly, the switch wheel 560 is movable to the winding stem. 510 in the axial direction of the winding stem 510, and is attached thereto so as not to be rotatable.

That is, the switch wheel 560 is moved along the axial direction of the winding stem 510 in conjunction with the yoke 550, and engages with the winding stem 510 so as to be rotated integrally with the winding stem 510.

The switch contact point spring body 570 is rotatably and pivotally supported by an axle 505 arranged at a position overlapping the winding stem 510 in a plan view when viewed from the case back 34 side. This causes the switch contact point spring body 570 to be rotated around the axle 505. In addition, a protruding portion 572 is disposed in the switch contact point spring body 570.

When the switch contact point spring body 570 is located at the reference position, a contact portion 571 of the switch contact point spring body 570 is arranged at a position overlapping the winding stem 510 in the plan view.

When the winding stem 510 is located at the zero stage position, the contact portion 571 is arranged apart from the gear 562 of the switch wheel 560 in the axial direction of the winding stem 510. That is, the contact portion 571 does not mesh with the gear 562. Therefore, even if the switch wheel 560 is rotated integrally with the winding stem 510, there is no possibility that the gear 562 may come into contact with the contact portion 571.

The switch contact point spring 580 is fixed to the switch contact point spring body 570. This causes the switch contact point spring 580 to be rotated around the axle 505 integrally with the switch contact point spring body 570.

The distal end portion 581 of the switch contact point spring 580 is inserted into a hole 432 disposed in the circuit board 430.

As illustrated in FIG. 28, the setting lever spring 590 is positioned by axles 503, 506, and 507, and is fixed to the axle 506 by using a screw. Then, the setting lever spring 590 presses the setting lever 520, the switch lever 530, the click spring 540, and the yoke 550 against the main plate 500, thereby preventing these components from falling down from the main plate 500.

The setting lever spring 590 includes a return spring portion 591 and a switch contact point spring holder 592.

A distal end portion 591A of the return spring portion 591 includes a bent side surface. When the switch contact point spring body 570 is located at the reference position, a bent point of the side surface is in contact with the protruding portion 572 of the switch contact point spring body 570. Then, if the switch contact point spring body 570 is rotated by the gear 562 of the switch wheel 560, the protruding portion 572 moves along the side surface from the bent point of the distal end portion 591A, and presses the side surface in the direction of the timepiece center. In this manner, the return spring portion 591 is deflected, and the protruding portion 572 is biased in a direction of returning to the original position by the return spring portion 591. Then, when the switch wheel 560 and the switch contact point spring body 570 are no longer in contact with each other, the return spring portion 591 causes the switch contact point spring body 570 to return to the original position.

The switch contact point spring holder 592 includes a distal end portion 592A curved in an arcuate shape. The distal end portion 592A presses the switch contact point spring body 570 and the switch contact point spring 580 against the main plate 500. This prevents the switch contact point spring body 570 and the switch contact point spring 580 from tilting toward a rotation plane when the switch contact point spring body 570 and the switch contact point spring 580 are rotated around the axle 505.

The above-described axles 501, 503, 506, and 507 are all arranged on the same side with respect to the winding stem 510 in a plan view when viewed from the case back 34 side.

Operation when Pulled Out to First Stage Position

Next, an operation when the winding stem 510 is pulled out to the first stage position from the zero stage position.

Figure 30:
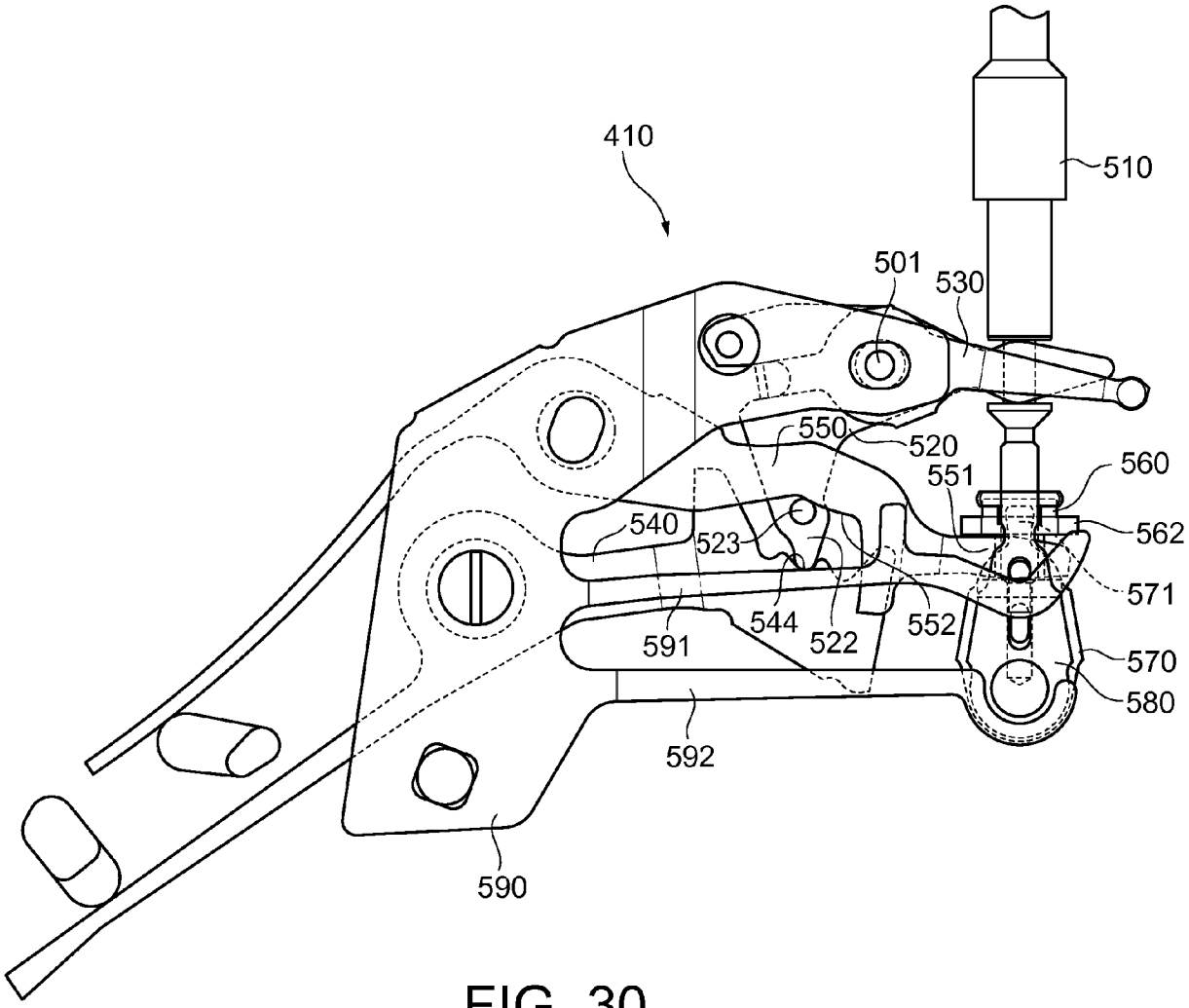
FIG. 30 is a plan view illustrating the rotary switch mechanism when the winding stem is located at a first stage position.
Figure 31:
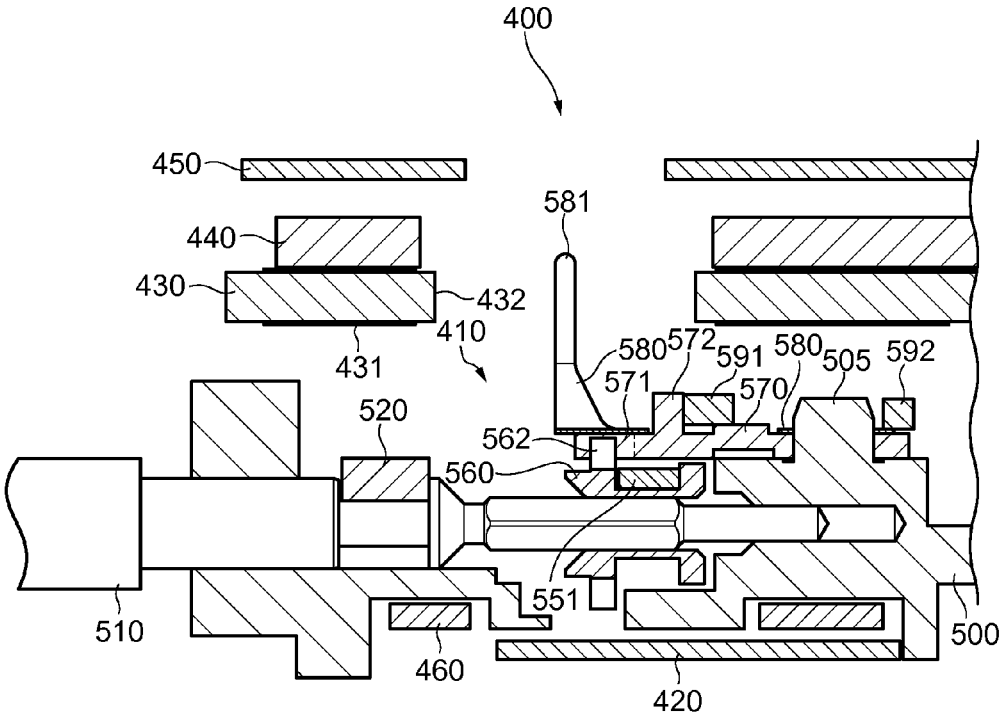
FIG. 31 is a partial cross-sectional view illustrating the movement when the winding stem is located at the first stage position.

FIG. 30 is a plan view when the winding stem 510 is located at the first stage position and the rotary switch mechanism 410 is viewed from the case back 34 side. FIG. 31 is a partial cross-sectional view when the winding stem 510 is located at the first stage position and the movement 400 is viewed in a direction orthogonal to the axial direction of the winding stem 510.

As illustrated in FIG. 30, if the winding stem 510 is pulled from the zero stage position to the first stage position, the setting lever 520 in conjunction with the winding stem 510 is rotated around the axle 501 counterclockwise when viewed from the case back 34 side. The end portion 522 of the setting lever 520 engages with an engagement groove 544 of the click spring 540.

The setting lever 520 is rotated, thereby moving the position of the protruding portion 523. In response to this movement, the end portion 551 of the yoke 550 moves in the direction of the timepiece center. Furthermore, in response to this movement, as illustrated in FIGS. 30 and 31, the switch wheel 560 is pressed by the end portion 551 of the yoke 550, and is moved in the direction of the timepiece center (direction of moving close to the switch contact point spring body 570) so that the gear 562 meshes with the contact portion 571 of the switch contact point spring body 570. In this manner, if the gear 562 is rotated integrally with the winding stem 510, the gear 562 come into contact with thee contact portion 571.

Figure 32:
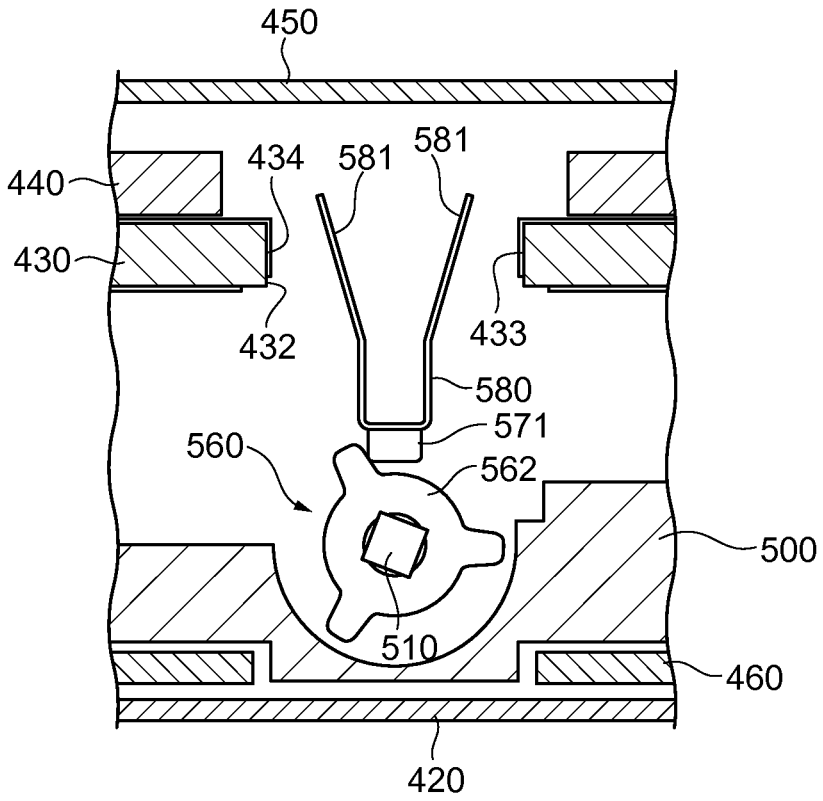
FIG. 32 is a partial cross-sectional view illustrating the movement when the winding stem is located at the first stage position and a second stage position.

FIG. 32 is a partial cross-sectional view when the movement 400 is viewed in the axial direction of the winding stem 510.

As illustrated in FIG. 32, the distal end portion 581 of the switch contact point spring 580 is inserted into the hole 432 disposed in the circuit board 430, as described above.

If the switch wheel 560 is rotated, the contact portion 571 of the switch contact point spring body 570 comes into contact with and presses the gear 562, thereby the switch contact point spring body 570 and the switch contact point spring 580 to move. At this time, in response to the rotation direction of the gear 562, the distal end portion 581 of the switch contact point spring 580 comes into contact with any one of the electrode 433 formed on one inner surface of the hole 432 in the circuit board 430 and the electrode 434 formed on the other inner surface. Specifically, if the gear 562 is rotated clockwise in the drawing, the distal end portion 581 of the switch contact point spring 580 moves to the right in the drawing and comes into contact with the electrode 433. If the gear 562 is rotated counterclockwise in the drawing, the distal end portion 581 moves to the left in the drawing and comes into contact with the electrode 434. In this manner, by detecting whether the switch contact point spring 580 comes into contact with any electrode, it is possible to detect the rotation direction of the winding stem 510, that is, the rotation direction of the crown 50.

In the embodiment, when the crown 50 is located at the first stage position, if the crown 50 is rotated, it is possible to correct the time zone setting. That is, if the crown 50 located at the first stage position is rotated, the indicating hand 21 is moved. The time zone stored in the timepiece 10B is corrected in response to the time zone display 46 indicated by the indicating hand 21.

Operation when Pulled Out to Second Stage Position

Next, an operation when the winding stem 510 is pulled out to the second stage position from the first stage position.

Figure 33:
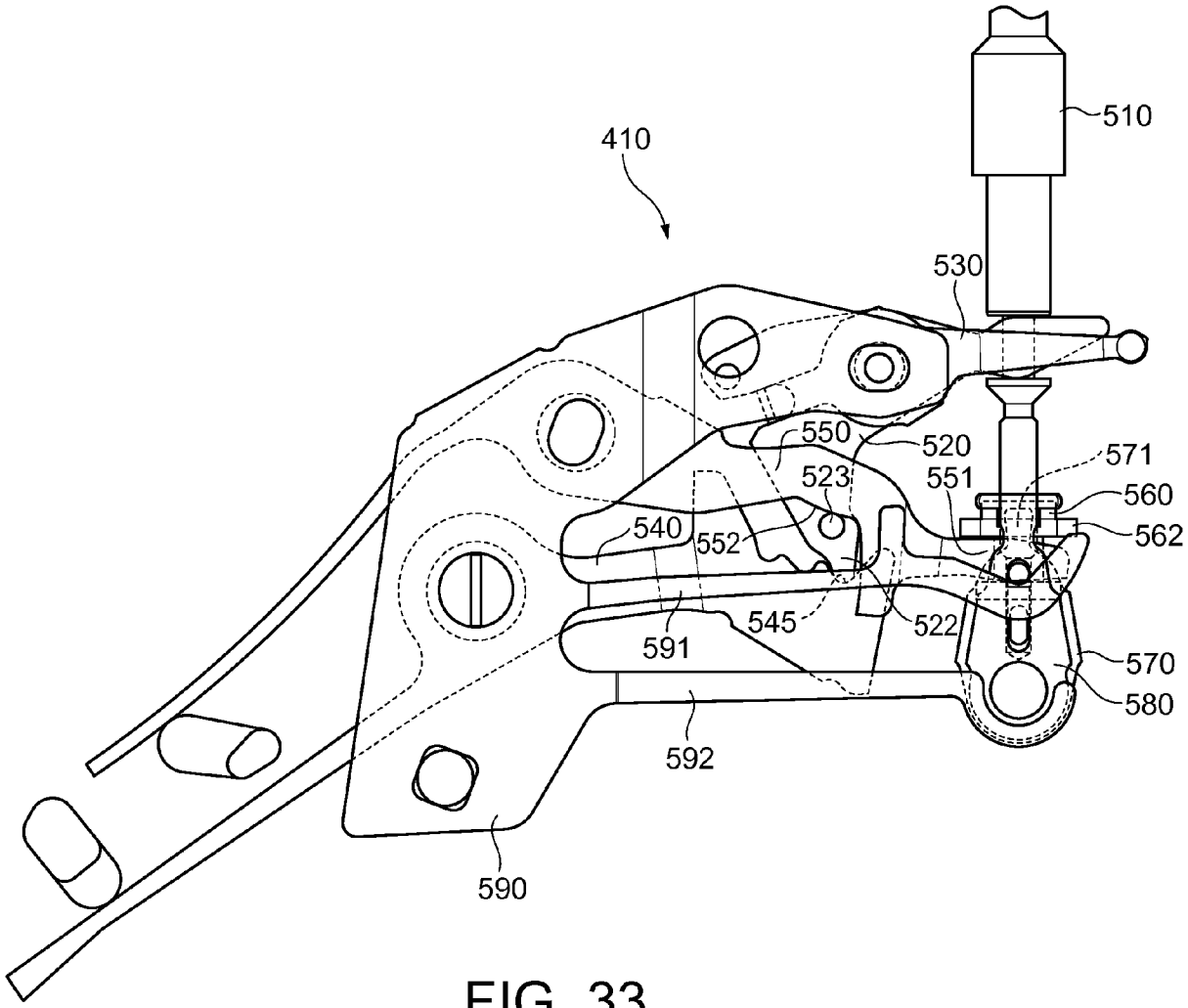
FIG. 33 is a plan view illustrating the rotary switch mechanism when the winding stem is located at the second stage position.
Figure 34:
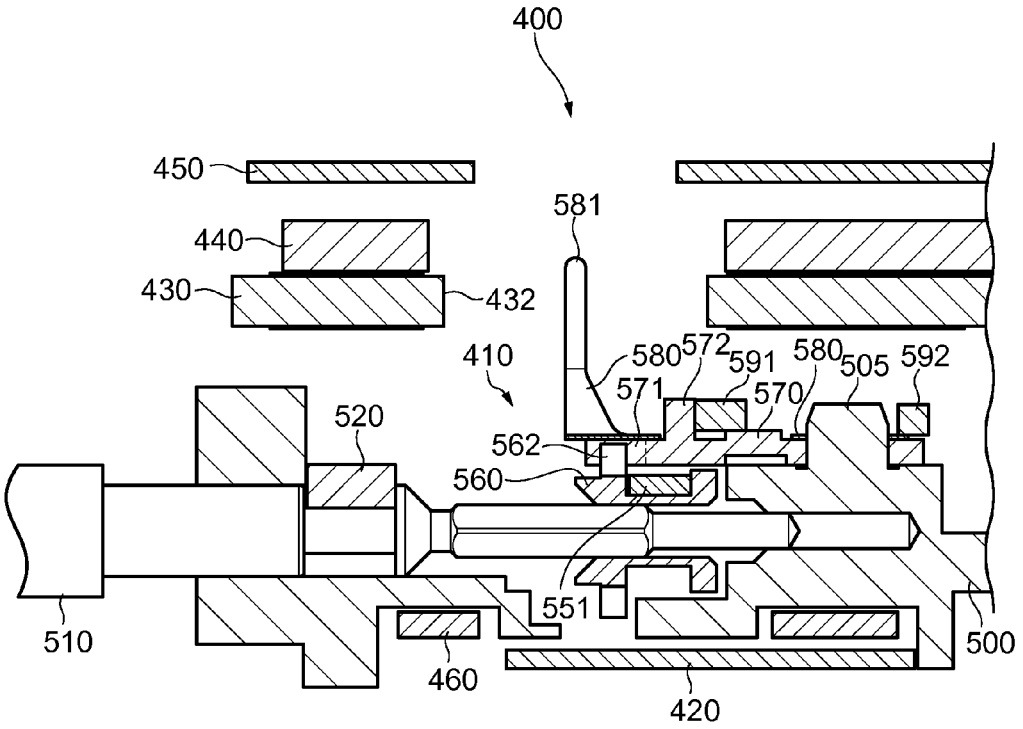
FIG. 34 is a partial cross-sectional view illustrating the movement when the winding stem is located at the second stage position.

FIG. 33 is a plan view when the winding stem 510 is located at the second stage position and the rotary switch mechanism 410 is viewed from the case back 34 side. FIG. 34 is a partial cross-sectional view when the winding stem 510 is located at the second stage position and the movement 400 is viewed in a direction orthogonal to the axial direction of the winding stem 510.

As illustrated in FIG. 33, if the winding stem 510 is pulled from the first stage position to the second stage position, the setting lever 520 in conjunction with the winding stem 510 is rotated around the axle 501 counterclockwise when viewed from the case back 34 side. The end portion 522 of the setting lever 520 engages with an engagement groove 545 of the click spring 540.

At this time, the setting lever 520 is rotated, thereby moving the position of the protruding portion 523. However, due to a related shape of the side surface portion 552 of the yoke 550, the yoke 550 hardly moves. That is, the switch wheel 560 is positioned at a location which is substantially the same as the location when the winding stem 510 is located at the first stage position. Therefore, if the gear 562 is rotated integrally with the winding stem 510, the gear 562 comes into contact with the contact portion 571 of the switch contact point spring body 570.

When the crown 50 is located at the second stage position, the button is operated so as to rotate the crown 50. In this manner, reference position alignment can be performed for the respective indicating hands 21 to 23, 71, 81, and 91, and the date indicator 16. In addition, when crown 50 is located at the second stage position, a predetermined button is operated. In this manner, it is possible to reset the system.

Operation when Pressed into Zero Stage Position

If the crown 50 and the winding stem 510 which are located at the second stage position or the first stage position are pressed inward in the direction of the movement 400 and are returned to the zero stage position, the setting lever 520 is rotated clockwise when viewed from the case back 34 side. As illustrated in FIG. 28, the end portion 522 of the setting lever 520 engages with the engagement groove 543 of the click spring 540. In response to this, the protruding portion 523 of the setting lever 520 is moved, and the yoke 550 in contact with the protruding portion 523 is also moved. Therefore, the end portion 551 of the yoke 550 and the switch wheel 560 are moved in the direction of the timepiece outer edge (direction apart from the switch contact point spring body 570). In this manner, even when the crown 50 is rotated, the switch wheel 560 is not brought into contact with the switch contact point spring body 570. Accordingly, no input operation is performed.

Operation Effect in Third Embodiment

When the crown 50 is located at the zero stage position, even if the switch wheel 560 is rotated, the switch contact point spring body 570 does not come into contact with the switch wheel 560. Accordingly, a user does not feel a sense of resistance, even when the crown 50 is rotated. Therefore, the user can intuitively recognize that no input operation is performed. In addition, when the crown 50 is located at the first stage position and the second stage position, the user feels the sense of resistance by rotating the crown 50. In this manner, the user can intuitively recognize that the input operation is performed. This can improve usability.

Even if the crown 50 is rotated at the zero stage position, the switch wheel 560 does not come into contact with the switch contact point spring body 570. Accordingly, there is no possibility that components such as the switch contact point spring 580 or the return spring portion 591 of the setting lever spring 590 may be deflected. Accordingly, it is possible to prevent the component from being degraded.

When the crown 50 is located at the zero stage position, even if the crown 50 is rotated, the switch contact point spring 580 does not come into contact with the electrodes 433 and 434 of the circuit board 430. Accordingly, it is possible to prevent the detection current from flowing and being increasingly consumed in a state where no input operation is performed.

The switch wheel 560 is mechanically moved in conjunction with the winding stem 510 by the setting lever 520 and the yoke 550. Accordingly, the switch wheel 560 can be reliably moved to a position corresponding to the position of the winding stem 510 (zero stage position, first stage position, and second stage position). In this manner, when the winding stem 510 is located at the first stage position and the second stage position, the switch wheel 560 can be reliably moved to a position of coming into contact with the switch contact point spring body 570 by rotating the winding stem 510. When the winding stem 510 is located at the zero stage position, the switch wheel 560 can be reliably moved to a position of not coming into contact with the switch contact point spring body 570, even if the winding stem 510 is rotated.

The yoke 550 is positioned by the protruding portion 523 disposed in the setting lever 520 moving in direct conjunction with the winding stem 510. Accordingly, the yoke 550 can be reliably arranged at a position corresponding to the position of the winding stem 510.

When the end portion 551 of the yoke 550 is moved in the direction of the timepiece center, if the tooth of the gear 562 of the switch wheel 560 collides with the contact portion 571 of the switch contact point spring body 570, and the switch wheel 560 and the switch contact point spring body 570 do not mesh with each other, the end portion 551 of the yoke 550 can escape in the direction of the timepiece outer edge. Accordingly, it is possible to prevent the movement 400 from being damaged due to the pulling-out operation of the crown 50. In addition, in this case, the crown 50 is rotated so that the position of the tooth of the gear 562 is deviated therefrom. In this manner, the switch wheel 560 and the switch contact point spring body 570 can mesh with each other.

The setting lever spring 590 includes the return spring portion 591. Accordingly, it is possible to reduce the costs of the movement 400, as compared to a case where the return spring for returning the position of the switch contact point spring body 570 to the original position is configured to have a member which is separate from the setting lever spring 590.

The setting lever spring 590 includes the switch contact point spring holder 592. Accordingly, as described above, the setting lever spring 590 can prevent the switch contact point spring body 570 and the switch contact point spring 580 from being tilted.

The switch lever 530 can be used to detect whether the crown 50 and the winding stem 510 are located at the first stage position and the second stage position. In addition, when the crown 50 and the winding stem 510 are located at the first stage position and the second stage position, the switch wheel 560 can be rotated and bought into contact with the switch contact point spring body 570. Therefore, when the crown 50 is located at the second stage position, it is possible to input another type of command which is different from the input command at the first stage position. Accordingly, for example, it is possible to increase the types of command which can be input, as compared to a case where the input operation can be performed only when the crown 50 is located at the first stage position. In this manner, it is possible to increase functions which can be realized by operating the crown 50.

Another Embodiment

The invention is not limited to the configuration according to the respective embodiments, and can be modified in various ways within the scope not departing from the gist of the invention.

In the third embodiment, the switch wheel 560 is moved by using the setting lever 520 moving in conjunction with the winding stem 510 or the yoke 550, thereby controlling the meshing between the switch wheel 560 and the switch contact point spring body 570. However, the invention is not limited thereto. For example, the meshing can be controlled in such a way that the switch lever 530 is used to electrically detect the position of the winding stem 510, and that based on the detection result, a piezoelectric motor is used to move the switch wheel 560.

In the third embodiment, the crown 50 can be pulled out to the first stage position and the second stage position, but may be configured so that the crown 50 can be pulled out to only the first stage position. In this case, the zero stage position and the first stage position can be determined whether or not the input operation is performed. Accordingly, the switch lever 530 for detecting the position of the winding stem 510 may not be provided.

In the third embodiment, if the winding stem 510 is moved from the zero stage position to the first stage position, the end portion 551 of the yoke 550 is moved in the direction of the timepiece center, but the invention is not limited thereto. For example, a configuration may be adopted in which the end portion 551 of the yoke 550 is moved in the direction of the timepiece outer edge. In this case, for example, when the winding stem 510 is moved from the zero stage position to the first stage position, the switch wheel 560 is moved in the direction of the timepiece outer edge, and the switch contact point spring body 570 is arranged in the direction of the timepiece outer edge with respect to the switch wheel 560. In addition, the protruding portion 523 disposed in the setting lever 520 is arranged in the direction of the timepiece outer edge with respect to the yoke 550. According to this configuration, when the winding stem 510 is moved from the zero stage position to the first stage position, if the switch wheel 560 and the switch contact point spring body 570 do not mesh with each other, the end portion 551 of the yoke 550 can escape in the direction of the timepiece center.

In the third embodiment, the timepiece 10B includes the chronograph function, but may include a small timepiece instead of or in addition to the chronograph function. The small timepiece can display the time which is different from the time in th basic timepiece. For example, when a user travels abroad, the basic timepiece displays the time of the travelling destination, and the small timepiece can display the time in Japan.

In this case, when the crown 50 is located at the first stage position, the display time of the small timepiece can be corrected by rotating the crown 50.

Fourth Embodiment

Hereinafter, a fourth embodiment of the invention will be described with reference to the drawings. In the following respective drawings, in order to illustrate a recognizable size of each layer or each member, dimensions of each layer or each member are employed differently from those employed in practice.

An electronic timepiece according to the embodiment has a world time function and a chronograph function. For example, the world time function is to display the current time by receiving a satellite signal transmitted from a navigation satellite such as the GPS (GPS satellite) and calculating position information and time information of the current location. The chronograph function has a so-called stopwatch function which integrates and displays the time.

Similarly to the electronic timepiece 10 according to the first embodiment, the electronic timepiece according to the embodiment is a wrist timepiece which receives a radio wave (satellite signal) from the GPS satellite 8 and corrects the internal time. The GPS satellite 8 is a navigation satellite turning around on a predetermined orbit of the earth in space, and transmits a superimposed navigation message to the ground on the earth using the radio wave (L1 wave) of 1.57542 GHz. In the following description, the radio wave of 1.57542 GHz in which the navigation message is superimposed is referred to as a satellite signal. The satellite signal is a circularly polarized wave of a right handed polarized wave.

In order to identify which GPS satellite 8 transmits the satellite signal, each GPS satellite 8 superimposes a unique pattern of 1023 chip (cycle of 1 ms) which is called a Coarse/Acquisition code (C/A code) on the satellite signal. The C/A code is configured so that each chip is either +1 or −1, and appears as a random pattern. Therefore, it is possible to detect the C/A code superimposed on the satellite signal by correlating the satellite signal with each C/A code.

The GPS satellite 8 has an atomic clock mounted thereon, and the satellite signal includes very accurate GPS time information measured by the atomic clock. In addition, a control segment on the ground measures a minor time difference of the atomic clock mounted on each GPS satellite 8, the satellite signal includes a time correction parameter for correcting the time difference. The electronic timepiece receives the satellite signal transmitted from one of the GPS satellites 8, and adopts the GPS time information contained therein and accurate time obtained by using the time correction parameter (time information) as internal time.

The satellite signal also includes orbit information indicating a position on the orbit of the GPS satellite 8. The electronic timepiece 10 can perform positioning calculation by using the GPS time information and the orbit information. The positioning calculation is performed on the assumption that the internal time of the electronic timepiece includes a certain degree of error.

That is, time error also becomes unknown in addition to parameters x, y, and z for identifying a three-dimensional position of the electronic timepiece. Therefore, the electronic timepiece generally receives the satellite signals respectively transmitted from four or more GPS satellites 8, and performs the positioning calculation using the GPS time information contained therein and the orbit information so as to obtain the position information of the current location.

Next, a schematic configuration of the electronic timepiece 10C according to the embodiment will be described.

Figure 35:
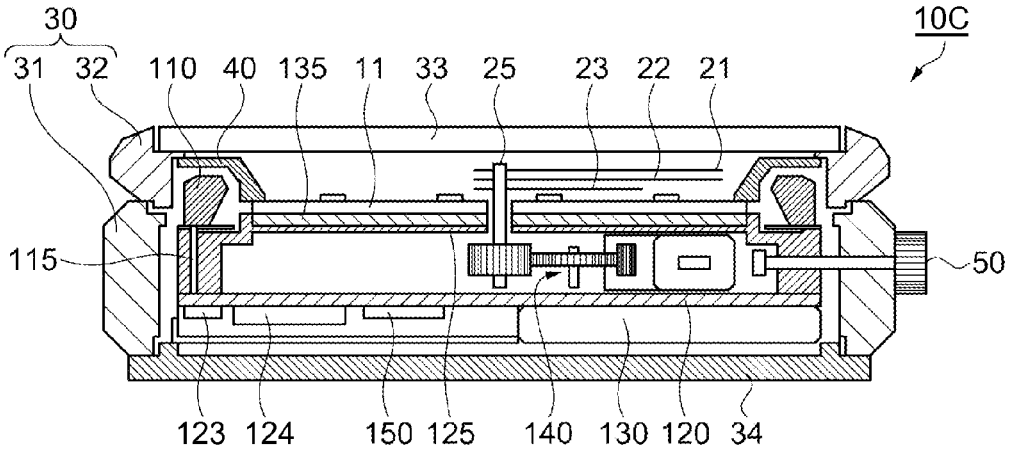
FIG. 35 is a partial cross-sectional view schematically illustrating an electronic timepiece according to a fourth embodiment of the invention.

FIG. 35 is a partial cross-sectional view illustrating the schematic configuration of an electronic timepiece 10C.

In the following description, the same reference numerals are given to configuration elements which are the same as those in the electronic timepiece 10 according to the first embodiment, and description thereof will be simplified or omitted. In addition, the front surface of the electronic timepiece 10C is the same as that of the electronic timepiece 10, and thus description thereof will be omitted.

As illustrated in FIG. 35, the electronic timepiece 10C includes the exterior case 30, the cover glass 33, and the case back 34.

A side surface of the exterior case 30 has the crown 50 at the position in the direction of 3 o'clock from the center of the dial 11. The crown 50 shows a normally positioned state (position of a zero stage 50*a* (refer to FIG. 36)) where the crown 50 is pressed into the exterior case 30 of the electronic timepiece 10C. The crown 50 includes each operation position of a first stage 50*b* (refer to FIG. 36) in which the crown 50 is pulled out by one stage and a second stage 50*c* (refer to FIG. 36) in which the crown 50 is pulled out by two stages. In addition, the electronic timepiece 10C includes the rotation detection unit described in the above-described embodiment, and detects the rotary operation for performing the input operation by rotating the crown 50. The crown 50 is operated so as to output an input signal in response to the operation position and the rotary operation of the crown 50.

The circuit board 120 includes a balun 123, a reception unit (GPS module) 124, a control unit 180, and a secondary battery 130. The secondary battery 130 is charged by using electric power generated by a solar panel 135, and accumulates the electric power. This enables the electronic timepiece 10C to be driven continuously. In addition, the circuit board 120 and an antenna body 110 are connected to each other by using an antenna connection pin 115. The balun 123 is balance-unbalance transducer, and converts a balanced signal transmitted from the antenna body 110 operated by balanced power supply into an unbalanced signal which can be handled by the reception unit 124.

In the embodiment, the electronic timepiece 10C employs the power generation using the solar panel 135 and the secondary battery 130 as a drive source. However, a primary battery system, or the other charging system may be employed. It is possible to simplify a mechanism inside the exterior case 30 by employing the primary battery system as the drive source. In addition, the electronic timepiece 10C according to the invention can be used even in a place having light illumination insufficient for employing the secondary battery charged using a charging system such as electromagnetic induction as the drive source, or even in a place where battery replacement is difficult.

Figure 36:
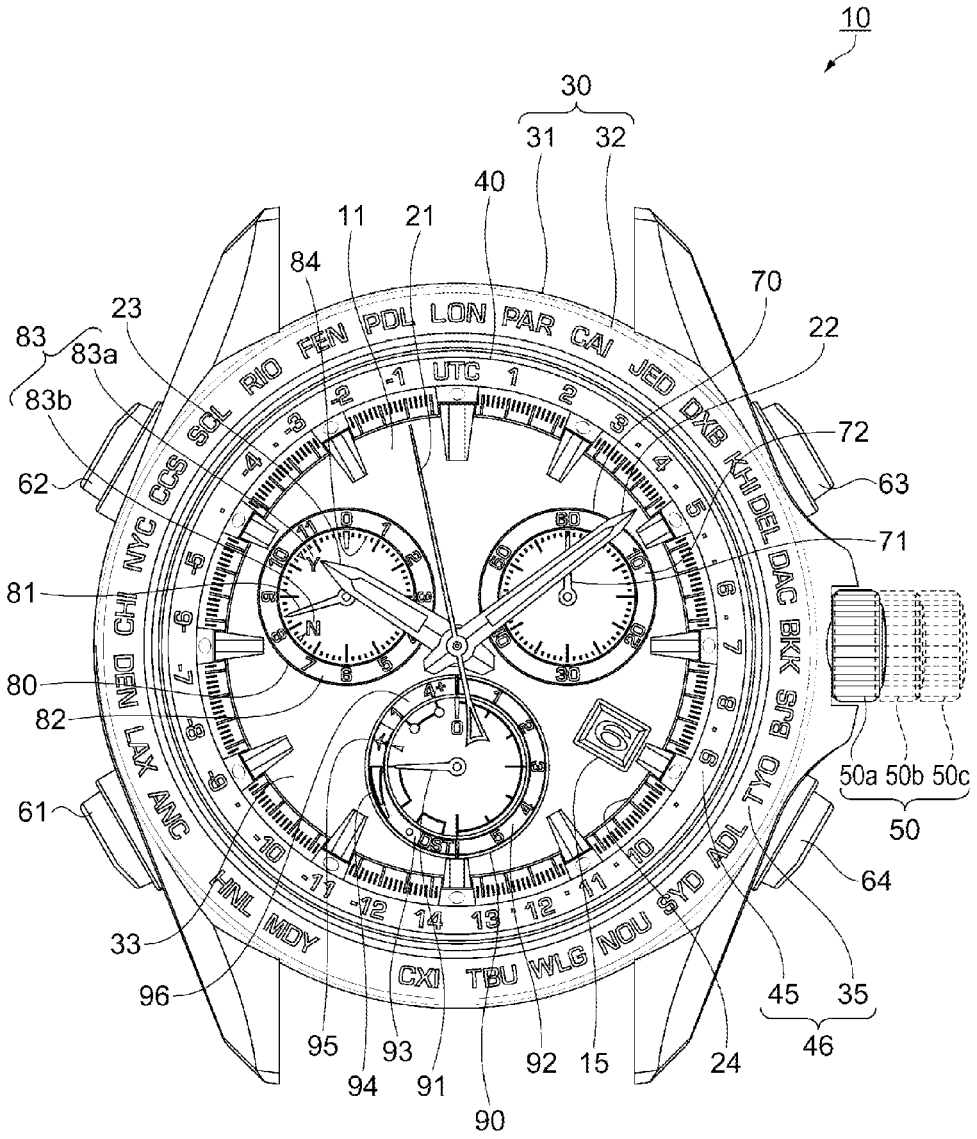
FIG. 36 is a schematic plan view illustrating appearance of the electronic timepiece.

Next, a display function of the electronic timepiece 10C will be described. FIG. 36 is a schematic plan view illustrating appearance of the electronic timepiece.

In the electronic timepiece 10C according to the embodiment, the dial 11 includes a time display for displaying the current time (internal time) obtained by the world time function, and an integration display for displaying the time integrated by the chronograph function.

The time display includes the time-hour display indicating the "hour", the time-minute display indicating the "minute", and the time-second display indicating the "second".

The integration display includes the integrated hour display indicating the "hour", the integrated minute display indicating the "minute", and the integrated second display indicating the "second".

First, a display function of the dial 11 will be described. As illustrated in FIG. 36, the dial 11 includes time-minute display 24 having a marked scale dividing the outer periphery into 60 portions, and time-hour display having a marked scale (bar index) dividing the outer periphery into 12 portions. The indicating hand 22 indicates the "minute" of the local time (internal time) obtained by the world time function using the time-minute display 24.

The indicating hand 23 indicates the "hour" of the local time (internal time) obtained by the world time function using the time-hour display.

The outermost periphery of the dial 11 includes integrated second display having a marked one-fifth scale which further divides the scale of the time-minute display 24 into five portions. The indicating hand 21 indicates the "second" of the time integrated by the chronograph function using the integrated second display.

Next, a display function of a first small timepiece 70*a* will be described. The first small timepiece 70*a* includes a scale dividing the outer periphery of the first small timepiece 70*a* into 60 portions, and an integrated minute display 72 having a marked 10-digit numbers from 10 to 60. The indicating hand 71 indicates the "minute" of the time integrated by the chronograph function using the integrated minute display 72.

Next, a display function of a second small timepiece 80*a* will be described. The second small timepiece 80*a* includes a captured satellite number display 82 indicating the number of satellites from which a satellite signal can be received, a reception result display 83 of the satellite signal, and a time-second display 84 indicating the second of the local time (internal timepiece).

The captured satellite number display 82 is disposed on the outer periphery of the second small timepiece 80*a*. The captured satellite number display 82 has a marked scale dividing the outer periphery into 12 portions and marked numbers from "0" to "11". When a user operates the B-button 62 to cause the electronic timepiece 10C to manually receive the satellite signal, the indicating hand 81 indicates the captured satellite number showing the number of the GPS satellites 8 from which the satellite signal can be received, by using any one number from "0" to "11". In this manner, the captured satellite number is displayed.

The time-second display 84 is disposed on the outer periphery of the second small timepiece 80*a*. The time-second display 84 has a marked scale dividing the outer periphery into 60 portions. The indicating hand 81 indicates the "second" of the local time (internal time) by using the time-second display 84.

The reception result display 83 is disposed on the inner periphery of the second small timepiece 80*a*. In the time-second display 84, the reception result display 83 has a "Y" mark 83*a* in a range from 45 seconds to 60 seconds and an "N" mark 83*b* in a range from 30 seconds to 45 seconds. The "Y' mark 83*a* and the "N" mark 83*b* are disposed at positions which are line-symmetric to a straight line connecting 15 seconds and 45 seconds, and do not overlap a scale (long scale) dividing the outer periphery of the second small timepiece 80*a* into 12 portions. In this manner, the scale dividing the outer periphery of the second small timepiece 80*a* into 12 portions, the scale dividing the same into 60 portions, and the reception result display 83 can be arranged within the second small timepiece 80*a* having a small area by using well-balanced layout while readability is ensured. The "Y" mark 83*a* and the "N" mark 83*b* represent setting for the reception result of the satellite signal (Y: reception successful, N: reception in failure) and the automatic reception of the satellite signal (Y: automatic reception ON, N: automatic reception OFF).

A user operates the B-button 62 so that the indicating hand 81 indicates either the "Y" mark 83*a* or the "N" mark 83*b*, thereby displaying the reception result of the satellite signal. In addition, the user operates the A-button 61 and the B-button 62 so that the indicating hand 81 is aligned with either the "Y" mark 83*a* or the "N" mark 83*b*, thereby enabling the user to set the automatic reception ON/OFF of the satellite signal.

In the embodiment, the "Y" mark 83*a* is disposed at the position of 52 seconds, and the "N" mark 83*b* is disposed at the position of 38 seconds, but the configuration is not limited thereto. It is preferable to dispose the "Y" mark 83*a* and the "N" mark 83*b* at a visible position, depending on a position of providing the small timepiece including the reception result display 83.

Next, a display function of a third small timepiece 90*a* will be described. The outer periphery of the third small timepiece 90*a* includes combined displays of an integration display (integrated hour display 92) related to the chronograph function, a summer time display 93 related to the world time function, a charged capacity display 94, a reception prohibition display 95 of the satellite signal, and a reception mode display 96 of the satellite signal.

The integrated hour display 92 is disposed in the range in the direction from 12 o'clock to 6 o'clock on the outer periphery of the third small timepiece 90*a*. A scale dividing the range into six portions and numbers from "0" to "5" are marked in the integrated hour display 92. The indicating hand indicates the "hour" of the time integrated by the chronograph function using the integrated hour display 92.

The summer time display 93 is disposed in the range in the direction from 6 o'clock to 7 o'clock on the outer periphery of the third small timepiece 90*a*. Letters "DST" and a symbol "O" are marked in the summer time display 93. The daylight saving time (DST) means the summer time, and the letters and the symbol display the setting of the summer time (DST: summer time ON, O: summer time OFF). A user operates the crown 50 and the B-button 62, and aligns the indicating hand 91 with the letters "DST" or the symbol "O". In this manner, the user can set the summer time ON/OFF in the electronic timepiece 10C.

The charged capacity display 94 is disposed in the range in the direction from 7 o'clock to 9 o'clock on the outer periphery of the third small timepiece 90*a*. In the charged capacity display 94, a power indicator of the secondary battery 130 (refer to FIG. 36) is marked using a crescent sickle-shaped symbol in which a proximal end in the direction of 9 o'clock is thick and a distal end in the direction of 7 o'clock is thin is disposed along the outer circumference. Depending on the battery residual capacity, the indicating hand 91 indicates any one of the proximal end, the middle, and the distal end.

The charged capacity display 94 also serves as a reception permission display. A user operates the A-button 61 so as to move a tip indicated by the indicating hand 91 from the reception prohibition display 95 (to be described later) to the charged capacity display 94, thereby enabling the electronic timepiece 10C to receive the satellite signal. In the embodiment, a case has been described where the charged capacity display 94 also serves as the reception permission display.

However, the charged capacity display 94 and the reception permission display may be disposed individually.

The reception prohibition display 95 is disposed in the range in the direction from 9 o'clock to 10 o'clock on the outer periphery of the third small timepiece 90*a*. The reception prohibition display 95 has an airplane-shaped symbol marked thereon, and displays the reception prohibition setting of the satellite signal. During takeoff and landing of aircraft, reception of the satellite signal is prohibited by the Aviation Law. Accordingly, this setting is called a flight mode. A user operates the A-button 61, moves a tip indicated by the indicating hand 91, and selects the reception prohibition display 95 (flight mode). In this manner, it is possible to cause the electronic timepiece 10C to stop the reception of the satellite signal.

The reception mode display 96 is disposed in the range in the direction from 10 o'clock to 12 o'clock on the outer periphery of the third small timepiece 90*a*. Numbers "1" and "4+" and a symbol are marked in the reception mode display 96, and these numbers and symbol displays the reception mode of the satellite signal. The number "1" means that the GPS time information is received and the internal time is corrected, and the number "4+" means that the GPS time information and the orbit information are received and the internal time and the time zone (to be described later) are corrected. A user operates the B-button 62 so that the indicating hand 91 indicates either the number "1" or the number "4+". In this manner, the electronic timepiece 10C displays the reception mode of the satellite signal received immediately before.

The operation using the A-button 61, the B-button 62, the C-button 63, the D-button 64, and the crown 50 has been described as an example. The operation may be performed by using an input device which is different from those in the description.

Next, the time zone display 46 disposed in the dial ring 40 and the bezel 32 will be described. The time zone display 46 is a general term of a time difference display (time difference information) 45 marked on the dial ring 40 and a city display (city information) 35 marked in the bezel 32.

In a plan view from the front surface side, the dial ring 40 has letters "UTC" indicating the Universal Time Coordinated serving as the reference of the time difference, and a time difference display 45 having marks of a numeric value or a symbol which indicates the time difference between the standard time used in the time zone and the UTC.

The time difference between the local time indicated by the indicating hands 21, 22, and 23 and the UTC can be confirmed using the time difference display 45 indicated by the indicating hand 21 by pulling out the crown 50 to the operation position of the first stage 50*b*. In the embodiment, the Universal Time Coordinated is marked by the letters "UTC", and the time difference between the standard time and the UTC is marked by using an integer and a symbol ".". The time difference may be expressed by using another letter or another symbol.

A city display 35 having a marked code representing a representative city name in the time zone corresponding to the time difference marked in the dial ring 40 is disposed in the bezel 32. In the embodiment, a three-letter code is used by abbreviating the representative city name to three letters. "LON" represents London, "PAR" represents Paris, "CAI" represents Cairo, "JED" represents Jeddah, "DXB" represents Dubai, "KHI" represents Karachi, "DEL" represents Delhi, "DAC" represents Dacca, "BKK" represent Bangkok, "BJS" represents Beijing, "TYO" represents Tokyo, "ADL" represents Adelaide, "SYD" represents Sydney, "NOU" represents Nemea, "WLG" represents Wellington, "TBU" represents Nuku'alofa, "CXI" represents Christmas Island, "MDY" represents Midway Island, "HNL" represents Honolulu, "ANC" represents Anchorage, "LAX" represents Los Angeles, "DEN" represents Denver, "CHI" represents Chicago, "NYC" represents New York, "CCS" represents, Caracas, "SCL" represents San Diego, "RIO" represents Rio de Janeiro, "FEN" represents Fernando de Noronha Islands, and "PDL" represents the Azores, respectively. For example, the code of "TYO" represents Tokyo. The number "9" of the time difference display 45 which is jointly marked in the dial ring 40 corresponding to this code enables a user to easily understand that Tokyo uses the standard time of UTC+9 hours.

Due to the limited display space and in order to improve the visibility, marks for representative city names corresponding to the time difference in the time difference display 45 are partially omitted. In addition, a marking method of the representative city names is an example, and another method may be used for the marking.

The time zone of the local time (internal time) indicated by the indicating hands 21, 22, and 23 can be confirmed through the time zone display 46 indicated by the indicating hand 21 by pulling out the crown 50 to the operation position of the first stage 50*b*. For example, the indicating hand 21 indicates "TYO" and "9" of the time zone display 46, thereby enabling a user to understand that he or she lives in a time zone of +9 hours in which Tokyo is the representative city.

Next, an electrical configuration of the electric timepiece 10C will be described.

Figure 37:
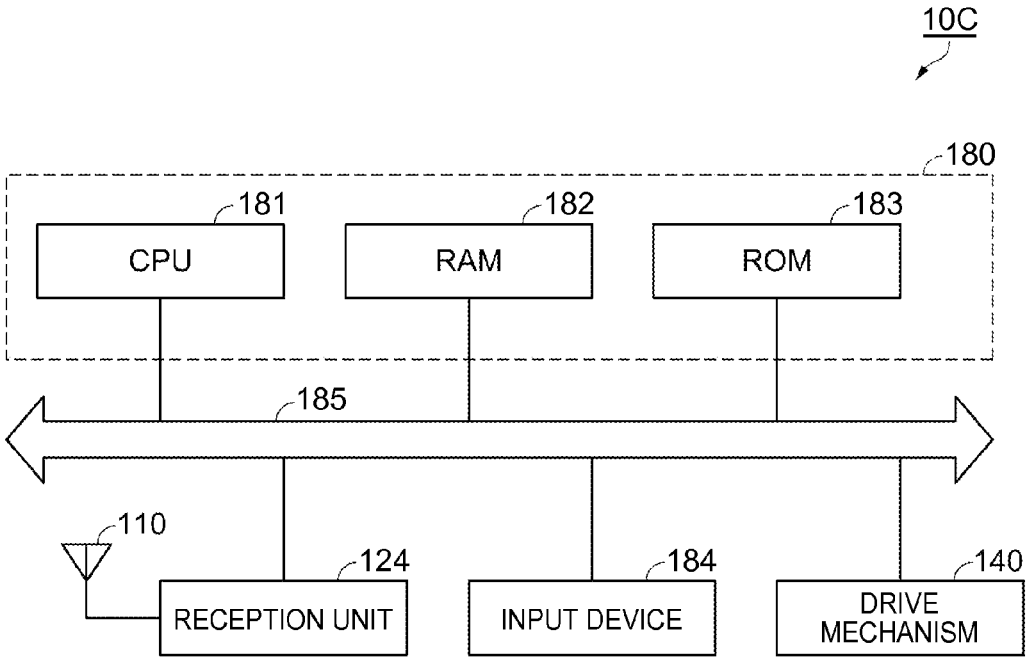
FIG. 37 is an electrical control block diagram of the electronic timepiece.

FIG. 37 is an electrical control block diagram of the electronic timepiece. As illustrated in FIG. 37, the electronic timepiece 10C includes a control unit 180 configured to basically have a central processing unit (CPU) 181, a random access memory (RAM) 182, and a read only memory (ROM) 183, a reception unit (GPS module) 124, an input device 184, and a peripheral device of a drive mechanism 140. These respective devices transmit and receive data via database 185. The input device 184 includes the crown 50 illustrated in FIG. 35, the A-button 61, the B-button 62, the C-button 63, and the D-button 64. The rechargeable secondary battery 130 (refer to FIG. 35) serving as power supply is incorporated in the electronic timepiece 10C.

The reception unit 124 includes the antenna body 110, performs processing on the satellite signal received via the antenna body 110, and acquires the GPS time information or the position information. The antenna body 110 receives a radio wave of the satellite signal which is transmitted from multiple GPS satellites 8 (refer to FIG. 1) turning around on a predetermined orbit of the earth in space and which passes through the cover glass 33 and the dial ring 40 illustrated in FIG. 35.

Then, similarly to a general GPS device, the reception unit 124 includes a radio frequency (RF) unit which receives the satellite signal transmitted from the GPS satellite 8 (refer to FIG. 1) and converts the satellite signal into a digital signal, a baseband unit (BB unit) which performs correlation determination of the received satellite signal so as to demodulate a navigation message, and an information acquisition unit which acquires the GPS time information or the orbit information from the navigation message demodulated in the BB unit and outputs the information. That is, the reception unit 124 functions as a reception unit which receives the satellite signal transmitted from the GPS satellite 8 and which outputs the GPS time information and the orbit information based on the reception result.

The RF unit includes a band pass filter, a PLL circuit, an IF filter, a voltage controlled oscillator (VCO), an A/D converter (ADC), a mixer, a low noise amplifier (LNA), and an IF amplifier. The satellite signal extracted from the band pass filter is amplified by the LAN. Thereafter, the satellite signal is mixed with a signal of the VCO by the mixer, and is down-converted into intermediate frequency (IF). The IF mixed by the mixer passes through the IF amplifier and the IF filter, and is converted into a digital signal by the ADC.

The BB unit includes a local code generator which generates a local code formed of a C/A code the same as that used when the GPS satellite 8 transmits the satellite signal, and a correlation unit which calculates a correlation value between the local code and the received signal output from the RF unit. Then, if the correlation value calculated by the correlation unit is equal to or greater than a predetermined threshold value, the C/A code used in the received satellite signal and the generated local code become coincident with each other, thereby enabling the satellite signal to be captured (synchronized). Therefore, the received satellite signal is subjected to correlation processing using the local code, thereby enabling the navigation message to be demodulated.

The information acquisition unit acquires the GPS time information and the orbit information from the navigation message demodulated by the BB unit. The navigation message includes time of week (TOW, also referred to as "Z count") of preamble data and a HOW word, and each sub-frame data. The sub-frame data is configured to have a sub-frame 1 to a sub-frame 5. For example, each sub-frame includes data such as satellite correction data including week number data or satellite health state data, the ephemeris (detailed orbit information for each GPS satellite 8), and the almanac (schematic orbit information of all GPS satellites 8). Therefore, the information acquisition unit extracts a predetermined data item from the received navigation message. In this manner, it is possible to acquire the GPS time information and the orbit information.

The RAM 182 and the ROM 183 serves as a storage unit of the electronic timepiece 10C.

The ROM 183 stores a program executed in the CPU 181 or the time zone information. The time zone information is data for managing the position information (latitude and longitude) of a territory (time zone) which uses the standard time in common, and the time difference from the UTC.

The CPU 181 uses the RAM 182 as a work region, and causes a program stored in the ROM 183 to be executed, thereby performing various types of calculation, control, and time measurement. For example, the time measurement is performed by counting the number of pulses of a reference signal transmitted from an oscillation circuit (not illustrated).

In automatic setting of the time zone, the CPU 181 sets (automatically sets) the time information calculated based on the GPS time information and the time correction parameters, the position information of the current location (latitude and longitude) calculated based on the GPS time information and the orbit information, and the time zone information stored in the ROM 183 (storage unit), in the RAM 182, and corrects the internal time. The CPU 181 performs a drive control on the drive mechanism 140 so as to indicate the internal time. In this manner, the electronic timepiece 10C is configured so that the internal time is displayed using the time display indicated by the indicating hands 21, 22, and 23 (refer to FIG. 36).

In manual setting of the time zone, the CPU 181 detects the input signal of the input device 184 (crown 50), and selects the time zone. The CPU 181 sets (manually sets) the selected time zone in the RAM 182, and corrects the internal time. The CPU 181 performs the drive control on the drive mechanism 140 so as to indicate the internal time. In this manner, the electronic timepiece 10C is configured so that the internal time is displayed using the time display indicated by the indicating hands 21, 22, and 23 (refer to FIG. 36).

Figure 38:
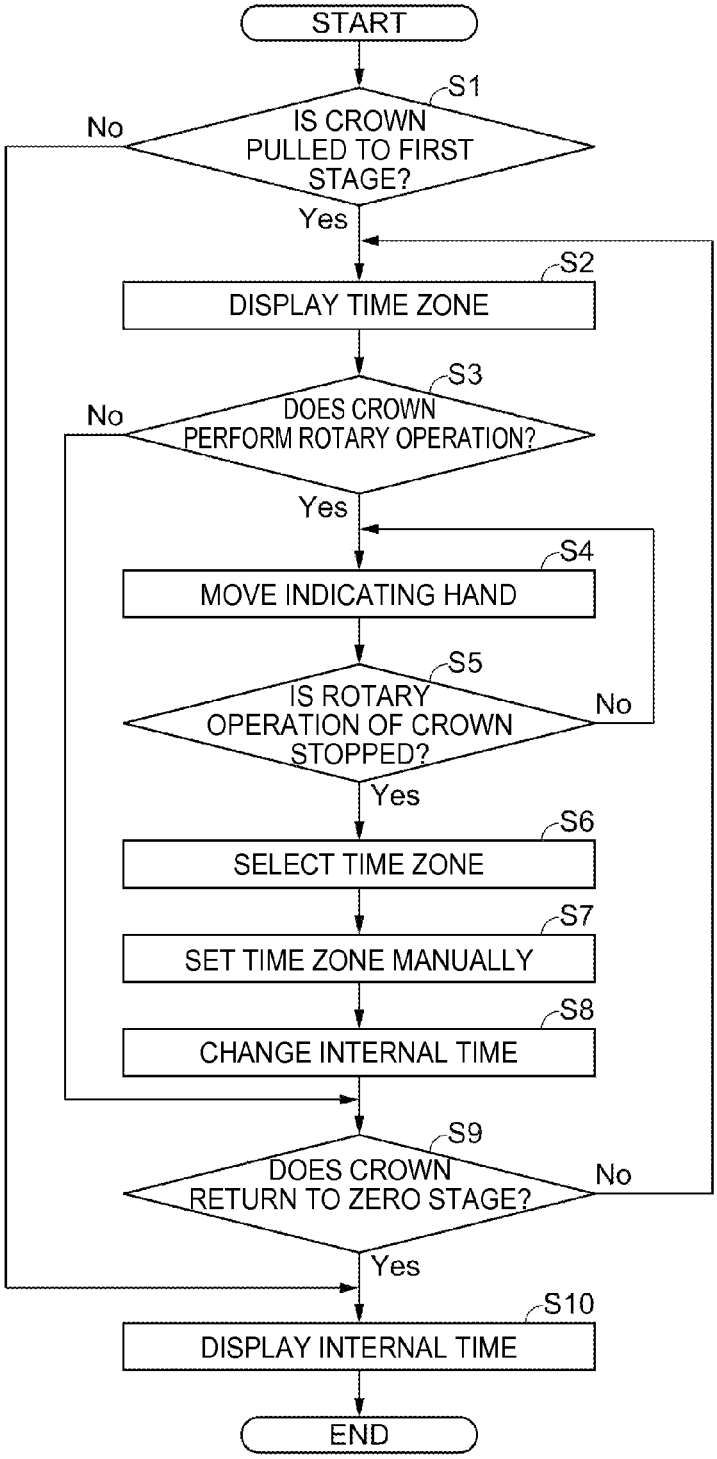
FIG. 38 is a flowchart illustrating a manual setting operation of the electronic timepiece.

Next, an operation for the manual setting of the electronic timepiece 10C will be described. FIG. 38 is a flowchart illustrating flow of the manual setting for the time zone in the electronic timepiece 10C.

First, in Step S1, the CPU 181 determines whether or not the crown 50 is pulled to the operation position of the first stage 50*b*. When the crown 50 is pulled to the operation position of the first stage 50*b* (S1: Yes), the process proceeds to Step S2. When the crown 50 is not pulled to the operation position of the first stage 50*b* (S1: No), the process proceeds to Step S10.

In Step S2, the time zone set in the electronic timepiece 10C is displayed. The CPU 181 detects the input signal indicating that the crown 50 is pulled to the operation position of the first stage 50*b*, and drives the drive mechanism 140 (refer FIG. 35). In this manner, the indicating hand 21 (refer to FIG. 36) indicates the time zone display 46 (refer to FIG. 36) corresponding to the time zone set in the RAM 182.

In Step S3, the CPU 181 determines whether or not the crown 50 performs the rotary operation. When the rotary operation is performed (S3: Yes), the process proceeds to Step S4. When the rotary operation is not performed (S3: No), the process proceeds to Step S9.

In Step S4, the CPU 181 moves the indicating hand 21. The CPU 181 detects the input signal of the clockwise rotary operation of the crown 50, and drives the drive mechanism 140 (refer to FIG. 35), thereby driving the indicating hand 21 clockwise. In addition, the CPU 181 detects the input signal of the counterclockwise rotary operation of the crown 50, and drives the drive mechanism 140 (refer to FIG. 35), thereby driving the indicating hand 21 counterclockwise. Specifically, a user rotates the crown 50 so as to move a tip indicated by the indicating hand 21 toward an arbitrary time zone which the user wants to manually set. The relationship between the rotation direction of the crown 50 and the rotation direction of the indicating hand 21 has been described as an example. The embodiment is not limited thereto.

In Step S5, the CPU 181 determines whether or not the rotary operation of the crown 50 is stopped. When the rotary operation is stopped (S5: Yes), the process proceeds to Step S6. When the rotary operation is not stopped (S5: No), the process returns to Step S4.

In Step S6, the CPU 181 selects the time zone. If the input signal of the rotary operation of the crown 50 is interrupted, the CPU 181 stops driving the drive mechanism 140 (refer to FIG. 35). In this manner, the movement of the indicating hand 21 is stopped. Then, the CPU 181 selects the time zone indicated by the stopped indicating hand 21 as an arbitrary time zone which is to be manually set. Specifically, a user rotates the crown 50 so as to move the indicating hand 21. If the indicating hand 21 indicates the arbitrary time zone which the user wants to manually set, the rotation of the crown 50 is stopped.

In Step S7, the CPU 181 manually sets the time zone. The CPU 181 sets the arbitrary time zone selected in Step S6 in the RAM 182. Since the user operates the crown 50 so as to select the arbitrary time zone from the time zone display 46 (refer to FIG. 36), this operation is referred to as time zone manual setting.

In Step S8, the CPU 181 changes the internal time by using the manually set time zone.

In Step S9, the CPU 181 determines whether or not the crown 50 returns to the zero stage 50*a*. When the crown 50 returns to the zero stage 50*a* (S9: Yes), the process proceeds to Step S10. When the crown 50 does not return to the zero stage 50*a* (S9: No), the process returns to Step S2.

In Step S10, the CPU 181 detects the input signal indicating that the crown 50 returns to the zero stage 50*a*, and drives the drive mechanism 140 (refer to FIG. 35) so as to display the internal time.

The electronic timepiece 10C according to the embodiment can select the arbitrary time zone by using one input device (crown 50). In addition, since the rotation direction of the crown 50 is the same as the movement direction of the indicating hand 21 for selecting the time zone, the operation can be intuitively performed. Furthermore, the crown 50 has an excellent waterproofing property, and can prevent moisture from permeating due to the selection operation of the time zone. Accordingly, it is possible to improve reliability of the electronic timepiece 10C.

In the embodiment, the radio wave transmitted from the GPS satellite 8 is used as the satellite signal, but the satellite signal is not limited thereto. For example, the satellite signal (radio wave) from the global navigation satellite system (GNSS) such as the Galileo (EU) and the global navigation satellite system (GLONASS) can be used.

As described above, according to the electronic timepiece 10C of the embodiment, the following advantageous effects can be obtained.

The electronic timepiece 10C includes the time zone display 46 indicating the time zone of the displayed time. The electronic timepiece 10C includes the function which receives the satellite signal, calculates the position information and the time information of the current location, automatically sets the time zone of the current location, and displays the local time, and the function which manually sets the arbitrary time zone selected from the time zone display 46, and displays the local time of the set time zone. The electronic timepiece 10C has the crown 50 provided with the operation position of the first stage 50*b* and the second stage 50*c*, and the rotary operation for performing the input operation by rotating the crown 50. The time zone displayed by the time zone display 46 is indicated by the indicating hand 21 in response to the rotary operation of the crown 50 pulled out to the operation position of the first stage 50*b*. The arbitrary time zone which is to be manually set is selected from the time zone displayed in the time zone display 46 by stopping the rotary operation of the crown 50. This enables the time zone to be manually set using a simple input operation. Therefore, it is possible to provide the electronic timepiece which can manually set the time zone by the simple and easily understandable input operation.

A case has been described where the selection and the setting of the arbitrary time zone are performed when the crown 50 is located at the operation position of the first stage 50*b*, but the embodiment is not limited thereto. The selection and the setting may be performed when the crown 50 is located at the operation position of the second stage 50*c*. The crown 50 may include the operation position of more stages, and the selection and the setting may be performed at the operation position of any desired stage.

The invention is not limited to the above-described embodiments, and various modifications or improvements can be added to the above-described embodiments. Modification examples are as follows.

Another Embodiment

The invention is not limited to the configuration according to the fourth embodiment, and can be modified in various ways within the scope not departing from the gist of the invention.

Figure 39:
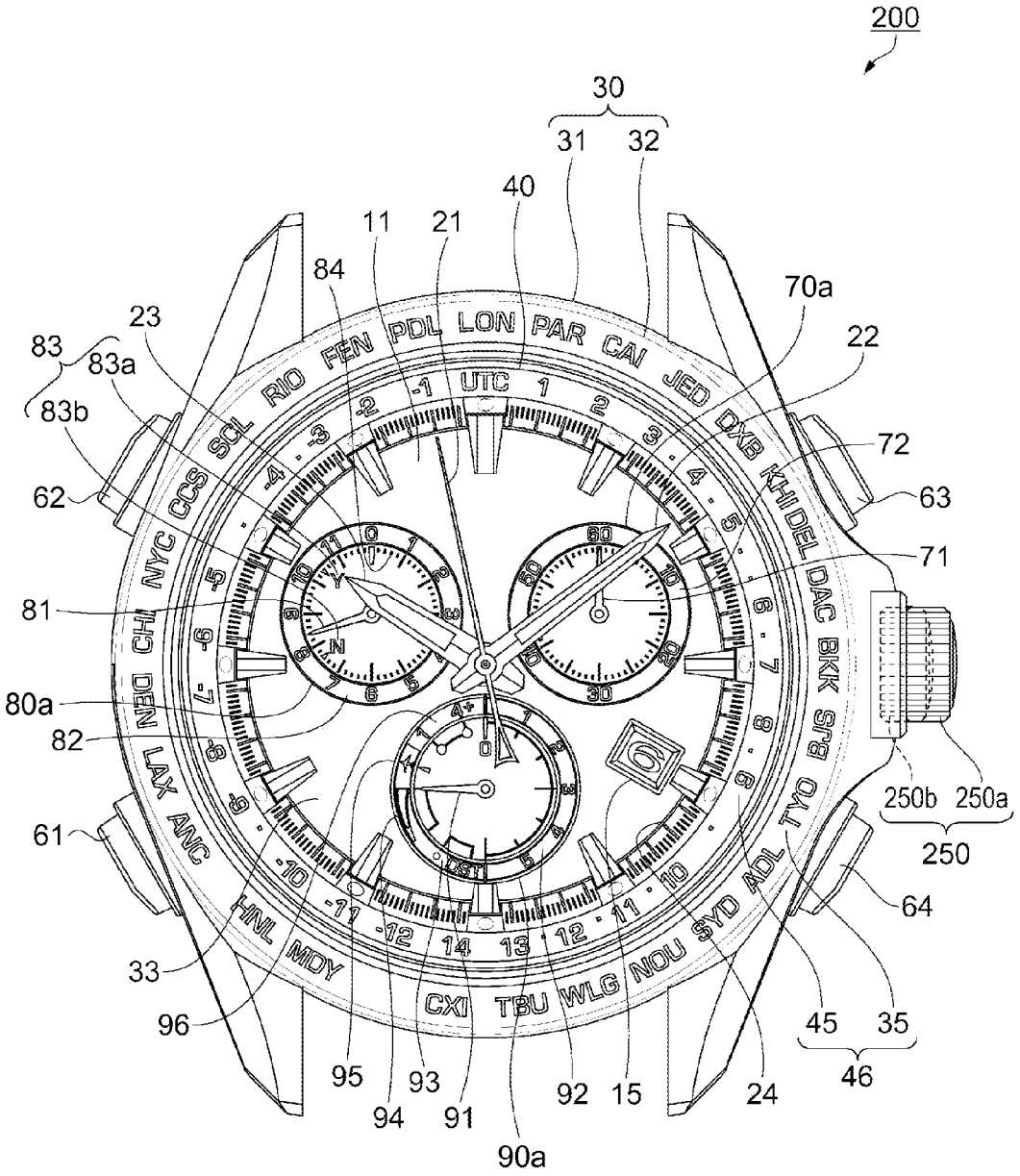
FIG. 39 is a schematic plan view illustrating appearance of an electronic timepiece according to a modification example of the fourth embodiment.

FIG. 39 is a schematic plan view illustrating appearance of an electronic timepiece according to a modification example of the above-described fourth embodiment.

In the fourth embodiment, a case has been described where the arbitrary time zone is selected by the rotary operation of the crown 50, but the embodiment is not limited thereto.

Hereinafter, an electronic timepiece 200 according to the modification example will be described. The same reference numerals are given to configuration elements which are the same as those in the fourth embodiment, and thus repeated description will be omitted.

The electronic timepiece 200 detects a button operation (refer to FIG. 39) of a crown 250 being pressed, as an input operation. The crown 250 is caused to perform the button operation, thereby outputting an input signal in response to the button operation of the crown 250. A crown 250*a* represents a normal position, and a crown 250*b* represents a state where the input operation is performed.

Figure 40:
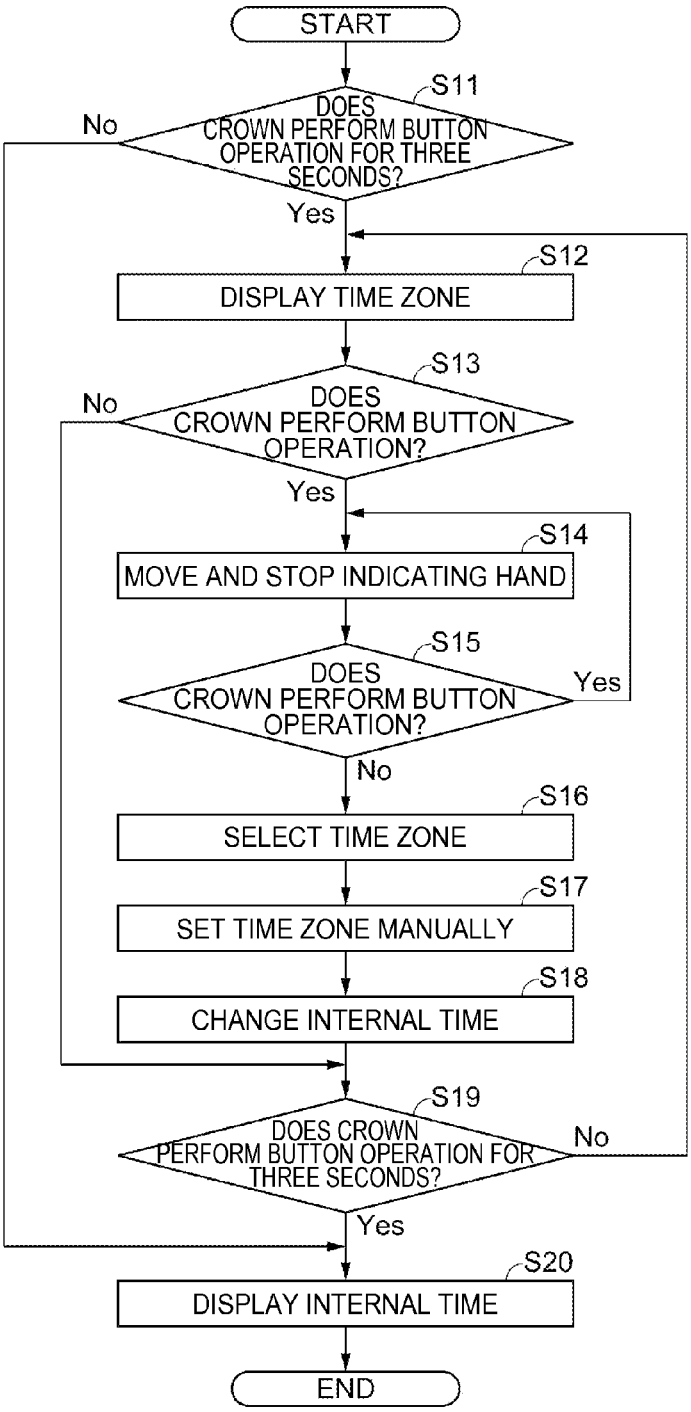
FIG. 40 is a flowchart illustrating the manual setting operation of the electronic timepiece.

Next, an operation of manual setting of the electronic timepiece 200 will be described. FIG. 40 is a flowchart illustrating flow of the manual setting of a time zone in the electronic timepiece 200.

First, in Step S11, the CPU 181 determines whether or not the crown 250 performs the button operation for three seconds. When the crown 250 performs the button operation for three seconds (S11: Yes), the process proceeds to Step S12. When the crown 250 does not perform the button operation for three seconds (S11: No), the process proceeds to Step S20.

In Step S12, the time zone set in the electronic timepiece 200 is displayed. The CPU 181 detects the input signal indicating that the crown 250 performs the button operation for three seconds, and drives the drive mechanism 140 (refer to FIG. 35). In this manner, the indicating hand 21 (refer to FIG. 39) indicates the time zone display 46 (refer to FIG. 39) corresponding to the time zone set in the Ram 182.

In Step S13, the CPU 181 determines whether or not the crown 250 performs the button operation. When the crown 250 performs the button operation (S13: Yes), the process proceeds to Step S14. When the crown 250 does not perform the button operation (S13: No), the process proceeds to Step S19.

In Step S14, the CPU 181 moves the indicating hand 21. The CPU 181 detects the input signal of the button operation of the crown 250, and drives the drive mechanism 140 (refer to FIG. 35), thereby driving the indicating hand 21 and moving a tip indicated by the indicating hand 21 to the adjacently displayed time zone.

In Step S15, the CPU 181 determines whether or not the crown 250 performs the button operation. When the crown 250 performs the button operation (S15: Yes), the process returns to Step S14. When the crown 250 does not perform the button operation (S15: No), the process proceeds to Step S16. Specifically, a user presses the crown 250 as many times as required so as to move a tip indicated by the indicating hand 21 to the arbitrary time zone which the user wants to manually set.

In Step S16, the CPU 181 selects the time zone. The CPU 181 selects the time zone indicated by the indicating hand 21 as the arbitrary time zone which is to be manually set.

In Step S17, the CPU 181 manually sets the time zone. The CPU 181 sets the arbitrary time zone selected in Step S16 in the RAM 182. Since the user operates the crown 250 so as to select the arbitrary time zone from the time zone display 46 (refer to FIG. 39), this operation is referred to as time zone manual setting.

In Step S18, the CPU 181 changes the internal time based on the manually set time zone.

In Step S19, the CPU 181 determines whether or not the crown 250 performs the button operation for three seconds. When the crown 250 performs the button operation for three seconds (S19: Yes), the process proceeds to Step S20. When the crown 250 does not perform the button operation for three seconds (S19: No), the process returns to Step S12.

In Step S20, the CPU 181 detects the input signal indicating that the crown 250 performs the button operation for three seconds, and drives the drive mechanism 140 (refer to FIG. 35) so as to display the internal time.

As described above, according to the electronic timepiece 200 of the embodiment, the following advantageous effect can be obtained.

The electronic timepiece 200 is configured so as to be capable of detecting the button operation in which the crown 250 is pressed to perform the input operation. The arbitrary time zone which is to be manually set is indicated from the time zone displayed in the time zone display 46 by the indicating hand 21 in response to the button operation of the crown 250 and selected. Therefore, it is possible to provide the electronic timepiece 200 which can manually set the time zone by the simple and easily understandable input operation.

What is claimed is:

1. An electronic timepiece comprising:

a display unit that displays measurement information;

a drive mechanism that drives the display unit;

an operation member that is rotarily operated; and a control unit that corrects the measurement information displayed on the display unit in accordance with the rotary operation of the operation member;

wherein the control unit has a single-measurement correction mode and a continuous-measurement correction mode that are selectable by the rotary operation of the operation member;

wherein in the single-measurement correction mode, a single correction signal is output to the drive mechanism so that the measurement information on the display unit is corrected by a single measurement unit;

wherein in the continuous-measurement correction mode, a continuous correction signal is output to the drive mechanism so that the measurement information on the display unit is corrected by continuously altering the measurement information in continuous measurement units up to a maximum of a continuous correction quantity, and wherein the continuous correction quantity is set depending on the type of the measurement information to be corrected in the continuous correction mode.

2. The electronic timepiece according to claim 1, wherein:

rotary operation is detected if the operation member is rotated by a predetermined angle in a first direction or in a second direction opposite the first direction;

the control unit selects the single-measurement correction mode if rotary operation is detected once within a predetermined time period; and the control unit selects the continuous-measurement correction mode if multiple rotary operations are consecutively detected in a single one of said first or second direction within the predetermined time period.

3. The electronic timepiece according to claim 1, wherein:

the display unit has a predefined, maximum displayable range for each type of measurement information; and the control unit sets the continuous correction quantity to the maximum displayable range of the type of measurement information that is to be corrected in the continuous correction mode.

4. The electronic timepiece according to claim 1, wherein:

a first type of measurement information can be corrected by incrementing and decrementing its displayed measurement information;

a second type of measurement information can be corrected only by incrementing its displayed measurement information;

a third type of measurement information can be corrected only by decrementing its displayed measurement information;

the control unit sets the continuous correction quantity equal to a value of one if the type of measurement information to be corrected in the continuous correction mode is of the second type or third type.

5. The electronic timepiece according to claim 1, wherein:

the display unit has a predefined, maximum displayable range for each type of measurement information; and the control unit sets the continuous correction quantity to a value of one if the type of measurement information to be corrected in the continuous correction mode has a maximum displayable range that is equal to or smaller than a preset setting value.

6. The electronic timepiece according to claim 1, wherein:

the display unit has a predefined, maximum displayable range for each type of measurement information; and the control unit sets the continuous correction quantity to a value of one if a preset time period for correcting the measurement information from its lowest value to its maximum displayable value is equal to or shorter than a preset setting time period.

7. The electronic timepiece according to claim 1, wherein the control unit sets the continuous correction quantity to a value of one if the type of measurement information to be corrected in the continuous correction mode is any one of a type of measurement information dependent upon receiving a satellite signal, a type of measurement information whose consecutive unit changes are not constant, and a type of measurement information has no continuity.

* * * * *